US006999701B2

(12) United States Patent
Yoshino et al.

(10) Patent No.: US 6,999,701 B2
(45) Date of Patent: Feb. 14, 2006

(54) IMAGE FORMING APPARATUS WITH ADJUSTABLE REMOVAL AND DEVELOPING NIPS

(75) Inventors: Mie Yoshino, Tokyo (JP); Tohru Nakano, Tokyo (JP); Yusuke Takeda, Tokyo (JP); Noriyasu Takeuchi, Tokyo (JP); Tsutomu Sasaki, Tokyo (JP); Tsuneo Kurotori, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/826,414

(22) Filed: Apr. 19, 2004

(65) Prior Publication Data

US 2004/0197116 A1 Oct. 7, 2004

Related U.S. Application Data

(62) Division of application No. 10/101,872, filed on Mar. 21, 2002, now Pat. No. 6,735,408.

(30) Foreign Application Priority Data

| | | |
|---|---|---|
| Mar. 21, 2001 | (JP) | 2001-080032 |
| Mar. 22, 2001 | (JP) | 2001-083471 |
| Mar. 22, 2001 | (JP) | 2001-083535 |
| Mar. 26, 2001 | (JP) | 2001-087126 |
| Apr. 5, 2001 | (JP) | 2001-106779 |
| Jul. 26, 2001 | (JP) | 2001-225952 |

(51) Int. Cl.
*G03G 15/10* (2006.01)

(52) U.S. Cl. ..... 399/237; 399/239; 399/240

(58) Field of Classification Search ..... 399/222, 399/237, 239, 240, 343, 345, 357, 249, 296
See application file for complete search history.

(56) References Cited

U.S. PATENT DOCUMENTS

| | | | | |
|---|---|---|---|---|
| 4,624,559 | A | 11/1986 | Haneda et al. | |
| 5,911,101 | A | 6/1999 | Park | |
| 6,085,054 | A * | 7/2000 | Kusayanagi | 399/249 |
| 6,167,225 | A | 12/2000 | Sasaki et al. | |
| 6,393,243 | B1 | 5/2002 | Satoh et al. | |
| 6,459,865 | B1 | 10/2002 | Kusayanagi | |
| 6,496,676 | B1 * | 12/2002 | Caruthers et al. | 399/296 |

FOREIGN PATENT DOCUMENTS

| | | |
|---|---|---|
| JP | 7-56434 | 3/1995 |
| JP | 8-328392 | 12/1996 |
| JP | 2000-242088 | 9/2000 |
| JP | 2001-228717 | 8/2001 |

* cited by examiner

*Primary Examiner*—Hoan Tran
(74) *Attorney, Agent, or Firm*—Oblon, Spivak, McClelland, Maier & Neustadt, P.C.

(57) ABSTRACT

A removal nip having a predetermined width is formed by a sweep roller pressurizing mechanism, which adjusts the length of a tension spring by rotating an adjustment screw, and adjusting the size of an energizing force of a sweep roller with respect to a photosensitive drum. A pressurizing mechanism similar to the sweep roller pressurizing mechanism is also provided in a developing roller, to adjust the energizing force of the developing roller, to thereby form a developing nip having a predetermined width.

100 Claims, 22 Drawing Sheets

DIAGRAM IN THE DIRECTION OF ARROW A (TOP PLAN DIAGRAM)

DIAGRAM IN THE DIRECTION OF ARROW B (TOP PLAN DIAGRAM)

IMAGE FORMING APPARATUS WITH ADJUSTABLE REMOVAL AND DEVELOPING NIPS

CROSS-REFERENCE TO RELATED APPLICATIONS

This application is a divisional application of Ser. No. 10/101,872 filed Mar. 21, 2002 U.S Pat. No. 6,735,408, filed Mar. 21, 2002, and issued on May 11, 2004, and based upon and claims the benefit of priority from prior Japanese Patent Applications No. 2001-080032, filed on Mar. 21, 2001, No. 2001-083471, filed on Mar. 22, 2001, No. 2001-083535, filed on Mar. 22, 2001, No. 2001-087126, filed on Mar. 26, 2001, No. 2001-106779, filed on Apr. 5, 2001, and No. 2001-225952, filed on Jul. 26, 2001, the entire contents each of which are incorporated herein by reference.

FIELD OF THE INVENTION

The present invention relates to an image formation apparatus such as copying machines, facsimiles and printers, liquid development image formation apparatus, liquid development image formation apparatus which uses the liquid development image formation apparatus, and wet-type image formation apparatus which develops a latent image formed on a latent image support by a liquid developer supported on the developer support.

BACKGROUND OF THE INVENTION

Conventionally in this type of image formation apparatus, there is known a method for forming a developing nip by making a developer support which supports a thin film of a liquid developer on the surface thereof abut against a latent image support, and developing the latent image formed on this latent image support using the liquid developer. For example, in Japanese Patent Application No. 11-38447, the present applicant has proposed an image formation for forming a nip section by making a developer support having an elastic layer abut against a latent image support.

In this image formation method, a thin film of a liquid developer is formed on a developer support, and a toner in the thin film is electrostatically transferred to an image section in the latent image on the latent image support which forms the nip section, to thereby effect development. On the other hand, the toner is not allowed to adhere on the ground section (on the background section) on the latent image support which passes through the nip section.

FIGS. 2A and 2B are schematic diagrams which show the condition of the developer 60 at the developing nip. FIG. 2A shows the developing nip between an image section on a photosensitive drum 1 and a developing roller, and FIG. 2B shows the developing nip between the background section on the photosensitive drum and the developing roller. Prior to entering into the developing nip, the toner density in the developer layer is substantially uniform, but when the toner enters into the developing nip, the toner starts to migrate in the developer layer, and as the toner proceeds in the developing nip, the toner density in the developer layer has a gradient. As shown in FIG. 2A, in the image section, the density of the toner 60*a* in the developer becomes such that it becomes relatively high on the photosensitive drum 1 side and relatively low on the developing roller side. Also as shown in FIG. 2B, in the background section, the gradient of the toner density becomes opposite to that in the image section. Therefore, in the developing nip, it is necessary to secure the developing time (the time for the thin layer of the liquid developer to pass via the nip) so that the toner can electrically migrate sufficiently. By securing sufficient developing time, sufficient development is performed, and high image density contrast (high image density, low ground density), high resolution and excellent uniformity in contact print can be obtained.

The developing time relies on the width of the developing nip (the size of surface migration on the photosensitive drum and the developing roller at the developing nip, and hereinafter referred to as "width of the developing nip"), and the process linear velocity which is the peripheral speed of the latent image support and the developer support. Normally, by setting the width of the developing nip to at least a value obtained by multiplying the process linear velocity by the developing time constant, such developing time can be secured. This developing time constant is a time required for the developed amount to saturate, and is a value obtained by dividing the process linear velocity by a minimum width of the developing nip required for the saturation of the developed amount. For example, if the process linear velocity is 300 mm/sec, and the developing time constant is 10 msec, the width of the developing nip becomes 3 mm.

When the width of the developing nip is too small compared to a predetermined size, sufficient development cannot be performed at the developing nip, and the density of the toner image becomes low. On the other hand, when the width of the developing nip is too large compared to the predetermined size, sufficient density of the toner image can be obtained, but the toner may adhere on the ground section of the latent image support, to thereby cause a phenomenon referred to as fogging (also referred to as greasing). Therefore, the width of the developing nip is set to an optimum value, taking the process linear velocity and the developing time constant into consideration in the designing step.

In Japanese Patent Application No. 11-38447, the applicant of this invention has proposed an image formation method for forming a nip section by making a developer support which has an elastic layer abut against a latent image support. In this image formation method, a thin layer of a liquid developer is formed on the developer support, so that the carrier liquid in the thin layer and the toner are electrostatically transferred to an image section in the latent image on the latent image support which forms the nip section, to thereby effect development. On the other hand, the toner is not allowed to adhere on the ground section (on the background section) on the latent image support which passes through the nip section, and only the carrier liquid is slightly transferred thereto.

Even if the toner adheres on the ground section, it is possible to shift the toner towards the developer support to thereby remove it, while passing through the nip section.

In order to prevent residual toner, there is also a technique which prevents adhesion of the toner onto the background section by forming a sufficient electric field between the background section on the latent image support and the developer support (hereinafter referred to as a background section developing electric field). In the method of preventing the toner from adhering on the background section by this background section developing electric field, the larger the background section developing electric field, the larger the effect of prevention of the toner adhesion onto the background section.

The present applicant has also proposed a method of removing the residual toner remaining in the background section after development by a removal member, in Japanese Patent Application No. 2000-42582. Specifically, an electric field (hereinafter referred to as removal electric field) is formed between the background section and the removal member, to attract the floating residual toner towards the removal member to thereby remove the residual toner from the surface of the latent image support. By this proposal, image fogging due to the residual toner is prevented.

In liquid developing apparatus of an electrostatic latent image which develops an image by a toner, as a method of supplying a liquid developer to the latent image face on an image support, there have been used a method for providing unevenness on the surface of the developing roller which is developer support, and holding a liquid developer in the recess to supply it to the image support, a method for using a sponge roller as the developer support, and supplying the liquid developer absorbed by the sponge roller to the image support by pressing the sponge roller against the image support, a method for supplying the liquid developer to the image support directly, without using the developer support, by soaking the image support in a developer tank which stores a liquid developer.

However, the nip width determined at the time of designing may not be formed as designed in the designing step after completion of the apparatus assembly, due to the influence of the production accuracy and assembly accuracy of the parts. By improving the production accuracy and assembly accuracy of the parts, the width of the developing nip can be formed within the allowable range in the design, but it may cause an increase in the production cost or the structure may become complicated.

If it is tried to increase the image formation speed by using the image formation method proposed in Japanese Patent Application No. 11-38447, the developing speed may not catch up with the speed to thereby cause insufficient image density, or the density in the ground section may become excessive to thereby cause image fogging.

When it is desired to increase the image density, there is a method for increasing the amount of developer to be applied on the developer support. However, if the amount of developer to be applied on the developer support is increased, the distance between the developer support and the latent image support (developing gap) increases, to decrease the electric field. Thereby, there is a problem in that the developing speed cannot catch up with the speed to thereby cause insufficient image density or image fogging.

Depending on the surface smoothness of a transfer material, the amount of developer to be applied on the developer support may be too much, thereby the toner image may collapse, or the image density may be too high. Therefore, when the unevenness on the surface of the transfer material is relatively small, and the surface has excellent smoothness, an excellent image can be obtained by reducing the toner layer in the toner image to be transferred, as compared with when the unevenness on the surface of the transfer material is relatively large, and the surface has poor smoothness. Therefore, a requirement for image density at the time of transfer is different depending on the transfer material to be used.

Hence, it is desired to change the width of the developing nip to a desired size depending on the circumstances.

When the developing nip is formed, it can be formed easier when the elastic layer on the developer support has a low hardness than the instance of having a high hardness, by elastically deforming the elastic layer with a small pressing force, and hence, the load on each member can be reduced, and the durability of the apparatus can be improved. In order to produce an elastic layer of a low hardness, normally oil is contained. However, the elastic layer containing oil has a problem in that the oil begins to leak at the time of use to thereby affect the formed image, or the elastic layer may shrink due to leakage of the oil. The elastic layer containing oil has another problem in that it absorbs the liquid developer or its component and swells with the lapse of time.

In the image formation method proposed in Japanese Patent Application No. 11-38447, the toner adheres on the ground section (background section) on the latent image support which is passing through the nip section, which may remain as a residual toner. In this instance, this residual toner may cause image fogging. Particularly in an instance of a developer having high solid (the toner and other resins, etc.), this tendency becomes conspicuous.

In the method of removing the floating residual toner by forming the removal electric field, as the background section developing electric field increases, a force of pressing the residual toner in the background section against the developer support by the electric field also increases. If the background section developing electric field is excessively increased in order to prevent toner adhesion onto the background section, there has been heretofore a problem in that the toner pressed against the developer support may flocculate on the developer support.

In the method of preventing image fogging by attracting the residual toner towards the removal member by the removal electric field, described below, there is such a problem that as the removal electric field is increased, the residual toner attracted towards the removal member may flocculate.

Thus flocculated residual toner has a large particle diameter, and when this toner is reused for development, reproducibility of fine lines is poor. Therefore, it is desired not to cause flocculation of the residual toner.

In the conventional image formation apparatus, at the time of development, if development is insufficient, the toner is unevenly distributed in a stripe form (ribs), and hence the image does not have a uniform density. In the image formation apparatus using this image formation method, a carrier liquid which is nonvolatile at a normal temperature and has high viscosity is used so that the carrier liquid does not diffuse into the air, taking the environment into consideration, and the liquid is not likely to scatter, taking handling into consideration. The high-viscosity carrier liquid adheres onto transfer paper in a larger amount than the low-viscosity carrier liquid, and there is a problem in that if the carrier liquid adheres on the transfer paper in a large amount, the appearance and touch of the transfer paper changes from the original paper.

With the conventional electrostatic recording apparatus or the like, when a liquid developer is supplied to an image support, a low-viscosity liquid developer is normally used, in which a toner is mixed in IsoparG (registered trademark, manufactured by Exxon Co.) which is an organic solvent at a rate of about 1 to 2%. In order to realize safe and small liquid developing apparatus by suppressing steam generation of the solvent, however, it is desired to use a high-viscosity liquid developer having higher density than the liquid developer used for the conventional apparatus. However, liquid developing apparatus that can supply a developer having stable toner density to an electrostatic drum has not yet been proposed. In the technique disclosed in Japanese Patent Application Laid-Open No. 8-328392, a plurality of rollers is used to control the thickness of a developer layer. However, with this technique, the developing space between an image support and a developer support changes, thereby stable development cannot be performed, and a unit which controls the density of the developer is not described therein. Therefore, when such a high-density and high-viscosity liquid developer is used, it is not clear which method is suitable as a method of supplying a liquid developer to a latent image face on the image support.

SUMMARY OF THE INVENTION

A first object of the present invention is to provide an image formation apparatus that can form high quality images by forming the width of the developing nip in a developing nip to a predetermined size to thereby obtain high image density contrast and prevent image fogging.

A second object is to provide an image formation apparatus that can correspond to a requirement such as image formation speed, the kind of a transfer material and image density to obtain a desired image density, and can prevent image fogging and form high quality images.

A third object is to provide an image formation apparatus which does not have oil leakage or shrinkage due to oil leakage, or swelling due to a liquid developer with the lapse of time, even if a low-hardness elastic layer is used on the surface of the developer support or the like.

A fourth object is to provide liquid development apparatus and liquid development image formation apparatus that can form high quality images while preventing image fogging and density nonuniformity, and can reduce the amount of carrier liquid taken out to the outside of the apparatus without using a material adversely affecting the environment.

A fifth object is to provide wet-type image formation apparatus that can prevent a residual toner removed from the background section from flocculating, in the construction that the residual toner in the background section on a latent image support is removed by a force of an electric field.

A sixth object is to provide liquid development apparatus of an electrostatic latent image that can uniformly supply a liquid developer having stable toner density onto the surface of the latent image on an image support.

According to one aspect of the present invention, there is provided an image formation apparatus comprising: a latent image support; a latent image formation unit which forms a latent image on the latent image support; a developer support which supports a liquid developer containing a toner dispersed in a carrier liquid; a developing unit which develops the latent image on the latent image support by a liquid developer supported on the developer support; and a transfer unit which transfers a manifest image on the latent image support developed by the liquid developer to a transfer material, wherein the image formation apparatus further comprises a developing nip width setting unit which sets the width of the developing nip, being the size in the moving direction on the surface of the developer support and of the latent image support, in a portion at which the developer support comes in contact with the latent image support, to a predetermined size.

According to another aspect of the present invention, there is provided a liquid development apparatus comprising: at least one developer support which supports a liquid developer containing a toner dispersed in a carrier liquid; and an application member which applies the liquid developer onto the developer support, wherein there is provided a before-development toner compression member which compresses the toner before development supported on the developer support, on the downstream side in the moving direction on the surface of the developer support than a portion where the developer support faces the application member, and on the upstream side in the moving direction on the surface thereof than a portion where the developer support faces the latent image support, the before-development toner compression member press-contacts with the developer support via the developer, and an independent voltage is respectively applied to the developer support and the before-development toner compression member.

According to still another aspect of the present invention, there is provided a liquid development apparatus comprising: at least one developer support which supports a liquid developer containing a toner dispersed in a carrier liquid; and an application member which applies the liquid developer onto the developer support, wherein there is provided a before-development toner compression member which compresses the toner before development supported on the developer support, on the downstream side in the moving direction on the surface of the developer support than a portion where the developer support faces the application member, and on the upstream side in the moving direction on the surface thereof than a portion where the developer support faces the latent image support, the before-development toner compression member is arranged so as to face the developer support with a gap, and an independent voltage is respectively applied to the developer support and the before-development toner compression member.

According to still another aspect of the present invention, there is provided a liquid development apparatus comprising: a latent image support; a developer support which supports a liquid developer containing a toner dispersed in a carrier liquid in order to develop a latent image formed on the latent image support; an application member which applies the liquid developer onto the developer support; a before-development toner compression member installed on the downstream side in the moving direction on the surface of the developer support than a portion where the developer support faces the application member, and on the upstream side in the moving direction on the surface thereof than a portion where the developer support faces the latent image support, and having conductivity at least on the surface thereof in order to compress the toner before development supported on the developer support; and a voltage application mechanism independently provided in the developer support and the before-development toner compression member, respectively, wherein the before-development toner compression member faces the developer support via the developer so as not to touch directly with each other.

According to still another aspect of the present invention, there is provided a liquid development apparatus comprising: a latent image support; a developer support which supports a liquid developer containing a toner dispersed in a carrier liquid in order to develop a latent image formed on the latent image support; a before-development toner compression member installed on the developer support and having conductivity at least on the surface thereof in order to compress the toner towards the developer support; and a voltage application mechanism independently provided in the developer support and the before-development toner compression member, respectively, wherein the before-development toner compression member faces the developer support via the developer so as not to directly touch with each other.

According to still another aspect of the present invention, there is provided a liquid development apparatus comprising: a developer support which supports a liquid developer containing a toner dispersed in a carrier liquid, and an application member which applies the liquid developer onto the developer support, wherein there is provided a before-development toner compression member, at least the surface thereof being insulation, on the downstream side in the moving direction on the surface of the developer support than a portion where the developer support faces the application member, and on the upstream side in the moving direction on the surface thereof than a portion where the developer support faces the latent image support, in order to compress the toner before development supported on the developer support, the before-development toner compression member press-contacts with the developer support via the developer, and the developer support is provided with a voltage application mechanism, and the before-development toner compression member is provided with a charging mechanism.

According to still another aspect of the present invention, there is provided a liquid development apparatus comprising: a developer support which supports a liquid developer containing a toner dispersed in a carrier liquid, and an application member which applies the liquid developer onto the developer support, wherein there is provided a before-development toner compression member, at least the surface thereof being insulation, in order to compress the toner during development onto the developer support, the before-development toner compression member press-contacts with the developer support via the developer, and the developer support is provided with a voltage application mechanism, and the before-development toner compression member is provided with a charging mechanism.

According to still another aspect of the present invention, there is provided a liquid development apparatus comprising: a developer support; an application unit which applies a liquid developer having a toner dispersed in an insulation liquid and having a viscosity of from 100 to 1000 mPa·s onto the developer support via a plurality of rollers; a voltage application unit which applies a voltage to at least one roller of the plurality of rollers; a developer tank which stores the liquid developer adjusted to a desired developer density; and a conductive plate internally provided in the developer tank, wherein the plurality of rollers partly has a feed roller soaked in the liquid developer stored in the developer tank, and the voltage application unit applies a voltage between the feed roller and the conductive plate to control the number of revolution of the feed roller, thereby the density of the liquid developer is controlled.

According to still another aspect of the present invention, there is provided a wet-type image formation apparatus comprising: a latent image support which supports an electrostatic latent image; a developer support which supports a liquid developer containing a toner dispersed in a carrier liquid; and an electric field generation unit which generates an electric field between the latent image support and the developer support, to develop the electrostatic latent image on the latent image support with a liquid developer on the developer support, as well as generating a background electric field between a background section on the latent image support and the developer support, to attract the background residual toner remaining in the background section on the latent image support towards the developer support after development by the background electric field to thereby remove the residual toner from the background section, wherein the absolute value of the background electric field is set to be not higher than a value at which the background residual toner attracted towards the developer support does not flocculate.

According to still another aspect of the present invention, there is provided a wet-type image formation apparatus that develops an electrostatic latent image on a latent image support which supports the electrostatic latent image using a liquid developer on a developer support which supports the liquid developer containing a toner dispersed in a carrier liquid, wherein it comprises a removal member which attracts and removes a background residual toner remaining in the background section on the latent image support after development, and a removal electric field generation unit which generates a removal electric field, the absolute value thereof being set to not higher than a value at which the background residual toner attracted towards the developer support does not flocculate, between the background section on the latent image support and the removal member.

Other objects and features of this invention will become understood from the following description with reference to the accompanying drawings.

DETAILED DESCRIPTION

[First Embodiment]

A first embodiment in which the present invention is applied to a printer using an electrographic liquid developer, being image formation apparatus, (hereinafter referred to only as a printer) will now be explained.

At first, the basic construction of this printer will be explained.

Figure 1:
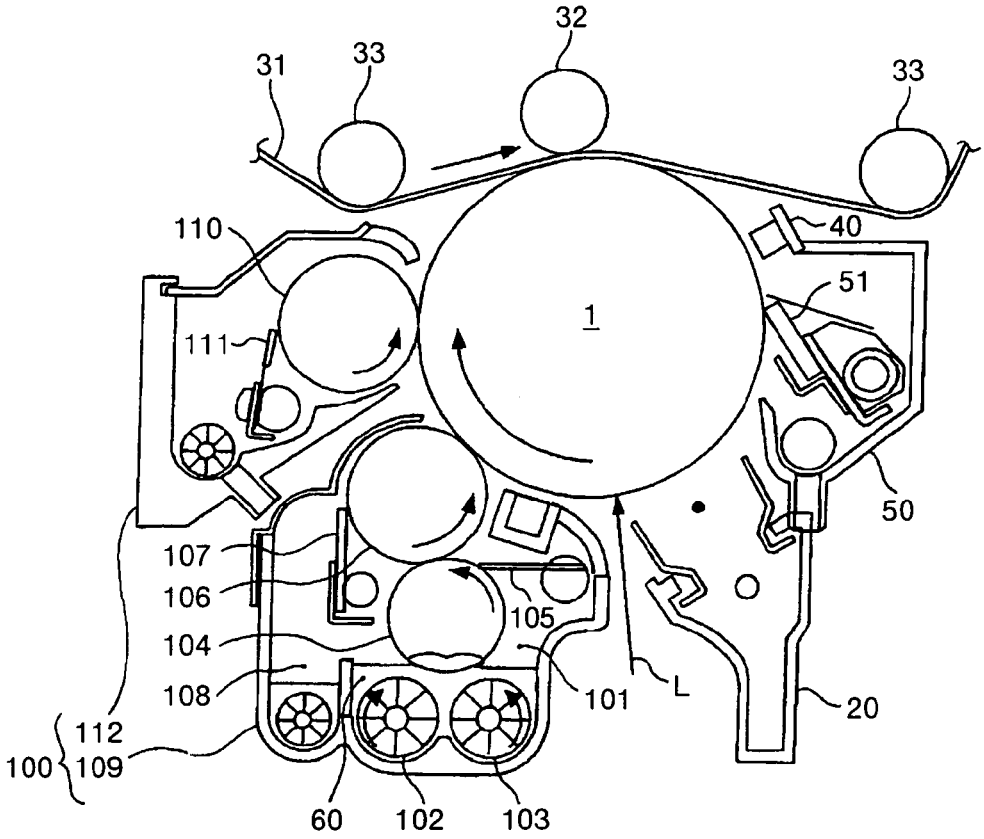
FIG. 1 is an explanatory diagram which shows the main part of image formation apparatus according to a first embodiment of the present invention.

FIG. 1 is a schematic configuration diagram of the main part of the printer according to this embodiment. In this figure, this printer has a charger 20, exposure apparatus (not shown) which irradiates exposure L to a photosensitive drum 1, liquid development apparatus 100, transfer apparatus comprising an intermediate transfer belt 31, a transfer roller 32 and the like, a charge removing lamp 40 and drum cleaning apparatus 50.

The photosensitive drum 1 is rotated in the direction of an arrow in the figure by a driving unit (not shown) at the time of printing, with the surface thereof being formed of amorphous silicon (a-Si).

The charger 20 uniformly charges the surface of the rotating photosensitive drum 1 by corona discharge. In this embodiment, it is charged up to about 600 V. As the charger 20, in addition to the one which realizes charging by corona discharge, one which applies a predetermined charging bias to a charging member such as a charging roller which is brought into contact with the photosensitive drum 1.

The exposure apparatus comprises a scanning optical system, which exposes an image data optical image L by an LED beam or a laser beam on the surface of the photosensitive drum 1 which is uniformly charged by the charger 20, based on the image information, to thereby support an electrostatic latent image.

The liquid development apparatus (hereinafter referred to simply as development apparatus) 100 develops this electrostatic latent image by adhering the charging toner on this electrostatic latent image. Thereby, a toner image is formed on the photosensitive drum 1.

The transfer apparatus comprises the intermediate transfer belt 31, and a transfer roller 32 tensioning over this and a plurality of tensioning rollers 33 shown in FIG. 1, as well as a power source (not shown) which applies a transfer bias of a polarity opposite to the charging polarity of the toner, and endlessly moves the intermediate transfer belt 31 in the direction of a narrow in the figure at the time of printing. Further, this intermediate transfer belt 31 is pressed against the photosensitive drum 1 by the transfer roller 32, to form a transfer nip. In this transfer nip, there is formed a transfer electric field due to a potential difference between the transfer roller 32 to which the transfer bias is applied and the surface of the photosensitive drum 1. The toner image which enters into the transfer nip, with the rotation of the photosensitive drum 1, is subjected to the action of this transfer electric field and the nip pressure, and primarily transferred onto the intermediate transfer belt 31. As the transfer apparatus, one which transfers a toner image by corona discharge, adhesion or heat may be used, other than the one using such a transfer roller.

The primarily transferred toner image in this manner is secondarily transferred onto transfer paper in an area not shown, and then fixed by fixing apparatus which uses a fixing method such as heating and pressurizing fixation, solvent fixation or UV fixation. The transfer paper on which the toner image is fixed is ejected to the outside via the fixing apparatus and a paper ejection route.

The charge removing 40 removes the residual electricity on the surface of the photosensitive drum 1 which has passed through the transfer nip.

The drum cleaning apparatus 50 scratches and removes the liquid developer remaining on the surface of the photosensitive drum 1 removed by the charge removing lamp 40 by a cleaning blade 51. By this removal, the surface of the photosensitive drum 1 is initialized, and will be able to realize the next imaging.

The construction of the development apparatus 100 will now be explained.

The development apparatus 100 consists of a developing section 109 and a sweeping section 112. This developing section 109 comprises a tank section 101, a pair of stirring screws 102 and 103, an anilox roller (application roller) 104, a doctor blade 105, a developing roller 106, a cleaning blade 107, and a return section 108. The sweeping section 112 comprises a sweep roller 110, a cleaning blade 111, a carrier recovery system and the like.

In the tank section 101, a liquid developer 60 containing a toner and a liquid carrier is stored. This liquid developer 60 is not the one having low viscosity and low density which is widely used in general liquid development apparatus, but one having high viscosity and high density is used. This low-viscosity and low-density liquid developer is for example a liquid developer having a viscosity of about 1 mPa·s containing a toner having a density of about 1 wt % in an insulation liquid carrier, which is called as Isopar (product name, manufactured by EXXON Corp.) available in the market. The high-viscosity and high-density liquid developer is for example a liquid developer having a viscosity of about 50 to 10000 mPa·s containing a toner having a density of about 5 to 40 wt% in an insulation liquid carrier such as silicon oil, normal paraffin, IsoparM (product name, manufactured by EXXON Corp.), vegetable oil or mineral oil. The volatility or non-volatility of such a high-viscosity and high-density liquid developer 60 used in the development apparatus 100 is adjusted corresponding to the developing performance of the development apparatus 100 and imaging performance of the printer. The particle diameter of the toner in the liquid developer 60 is also adjusted in the range of from submicron to about 10 $\mu$m, corresponding to the developing performance of the development apparatus 100 and imaging performance of the printer.

The pair of stirring screws 102 and 103 are arranged parallel with each other so as to be soaked in the liquid developer 60 in the tank section 101, and as shown by an arrow in the figure, are driven to rotate in the opposite direction to each other by a driving unit (not shown). When the development apparatus 100 starts the developing operation, these screws 102 and 103 rotate in the opposite direction to each other, to stir the liquid developer 60 in the tank section 101. By this stirring, the toner density and the viscosity of the liquid developer 60 are made uniform. Also by the opposite rotation of the screws 102 and 103, the liquid level of the liquid developer 60 is swollen between these screws as shown in the figure, and the liquid adheres to the anilox roller 104 arranged thereabove.

The anilox roller 104 as an application roller is rotated in the direction of an arrow in the figure by a driving unit (not shown), to thereby draw up the liquid developer 60 adhered thereto. There is formed a plurality of recesses (not shown) on the circumference of this anilox roller 104. A part of the liquid developer 60 drawn up by the anilox roller 104 is stored in these recesses.

The doctor blade 105 as a regulatory blade is formed by a metal such as stainless steel, and is abutted against the rotating anilox roller 104 to thereby scrape off the liquid developer 60 on the anilox roller 104. By this scraping, the amount of the liquid developer 60 on the anilox roller 104 is accurately weighed corresponding to the capacity of the plurality of recesses.

As shown in FIG. 1, the developing roller 106 rotates so as to move the surface thereof in the direction opposite to that of the anilox roller 104 at the contact section, while touching the surface of the anilox roller 104 which has passed through the abutment section with the doctor blade 105.

At the application nip which is the contact position of the developing roller 106 and the anilox roller 104, the both rollers come into contact with each other while moving the surface thereof in the counter direction to each other, and the liquid developer 60 on the anilox roller 104 is accurately weighed regardless of the viscosity thereof, thereby a thin layer of the developer having a uniform thickness can be formed on the developing roller 106.

While feed of the liquid developer with respect to the developing roller 106 is started on the outlet side of the application nip, the liquid developer shifted to the developing roller 106 moves in the direction opposite to the feed direction. With such a construction, if the maximum pressure in the application nip is not smaller than a predetermined value, the thickness of the thin layer of the developer on the developing roller 106 does not depend on the maximum pressure. Therefore, it becomes possible to suppress the nonuniformity in the thickness of the thin layer of the developer resulting from nonuniformity in the pressure of the application nip.

As a result, a thin layer of the developer having a uniform thickness and consisting of the liquid developer 60 is formed on the surface of the developing roller 106.

The developing roller 106 is provided with a conductive elastic layer comprising a conductive urethane rubber or the like on the circumference thereof, and comes in contact with the photosensitive drum 1, while rotating at the same speed with the photosensitive drum 1, to thereby form a developing nip. In this developing nip, a developing electric field is formed due to a potential difference between the photosensitive drum 1 and the developing roller 106 to which a developing bias of the same polarity as the charging polarity of the toner is applied from a power source (not shown). Specifically, at the developing nip, the developing roller 106, the ground section of the photosensitive drum 1 and the electrostatic latent image are respectively charged with the potential of the same polarity as that of the toner, and the value thereof becomes gradually lower in the order of the ground section, the developing roller 106 and the electrostatic latent image. Therefore, between the ground section and the developing roller 106, there is formed an electric field which electrostatically moves the toner towards the developing roller 106 having a lower potential. Also between the developing roller 106 and the electrostatic latent image, there is formed an electric field which electrostatically moves the toner towards the electrostatic latent image having a lower potential. At the developing nip where such a developing electric field is formed, the toner in the thin layer of the developer electrophoretically moves and gathers towards the surface of the developing roller 106 between the developing roller 106 and the ground section. The toner also electrophoretically moves and adheres towards the electrostatic latent image between the developing roller 106 and the electrostatic latent image. By this adhesion, the electrostatic latent image is developed to thereby form a toner image.

Figure 2A:
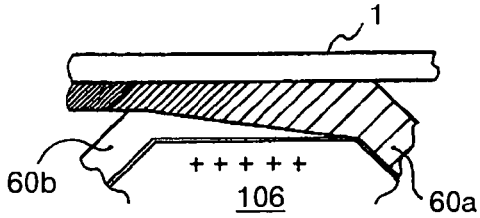
FIGS. 2A and 2B are schematic diagrams which show the condition of a developer in a developing nip.
Figure 2B:
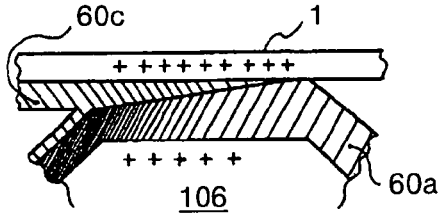

FIG. 2A and FIG. 2B are schematic diagrams which show the condition of the developer 60 in the developing nip. To this developing roller 106, there is applied a developing bias voltage (400V) which is lower than the surface potential (600V) of the photosensitive body, and a developing electric field is generated in the image section between the developing roller 106 and a portion which is exposed by the exposure apparatus and the voltage is reduced to 50V or below, and in the background section between the developing roller 106 and the surface potential of the charged photosensitive body.

In the image section of the photosensitive drum 1, as shown in FIG. 2A, the toner 60*a* in the developer moves towards the photosensitive drum 1 by the above electric field, to manifest an image of the latent image. On the other hand, in the background section, as shown in FIG. 2B, the toner 60*a* in the developer is attracted towards the surface of the developing roller 106 by the electric field formed by the developing bias potential and the surface potential of the photosensitive body (hereinafter referred to as a background electric field), so that the toner 60*a* does not remain in the background section.

The cleaning blade 107 is constituted by a metal or rubber member, and scratches and removes the residual developer from the surface of the developing roller 106, by abutting against this surface after having passed through the developing nip. As the cleaning member which cleans the developing roller 106, not only this cleaning blade but also a roller may be used. By this removal, the surface of the developing roller 106 is initialized. The removed residual developer returns to the tank section 101 via the return section 108. The developing roller may be provided in plural numbers.

The developing section 109 is thus constructed so as to develop an electrostatic latent image on the photosensitive drum 1.

In the developing nip, it is necessary to ensure a developing time (nip transit time of the developer thin layer) that can sufficiently move the toner electrophoretically. This developing time depends on the width of the developing nip, and the process linear velocity, being the peripheral speed of the photosensitive drum 1 and the developing roller 106. In the printer according to this embodiment, by setting the width of the developing nip to be higher than a value obtained by multiplying the process linear velocity by the developing time constant, such developing time is ensured. This developing time constant is a time required for the developed amount to saturate, and is a value obtained by dividing the process linear velocity by a minimum width of the developing nip required for the saturation of the developed amount. For example, when the process linear velocity is 300 mm/sec, and the developing time constant is 10 msec, the width of the developing nip becomes 3 mm. The width of a removal nip described below is similarly set.

As explained above, since the toner in the developer thin layer electrophoretically moves and gathers towards the surface of the developing roller 106 between the developing roller 106 and the ground section at the developing nip, the toner does not adhere to the ground section theoretically. However, the toner which has been less charged than normal may move electrophoretically, got behind other toners, and adhere to the ground section to thereby cause a phenomenon called "fogging" (also referred to as greasing).

The sweeping section 112 is to remove a fog toner which has caused such fogging from the photosensitive drum 1. Specifically, the sweep roller 110 in the sweeping section 112 is provided with a conductive elastic layer comprising a conductive urethane rubber or the like on the circumference thereof, and comes in contact with the photosensitive drum 1, while rotating at the same speed with the photosensitive drum 1, to thereby form a removal nip. In this removal nip, a sweeping electric field is formed due to a potential difference between the photosensitive drum 1 and the sweep roller 110 to which a removal bias of the same polarity as the charging polarity of the toner is applied from a power source (not shown).

Figure 3A:
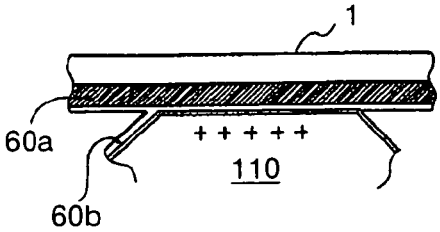
FIGS. 3A and 3B are schematic diagrams which show the condition of a developer in a developing nip which is formed by a photosensitive drum and a sweep roller.
Figure 3B:
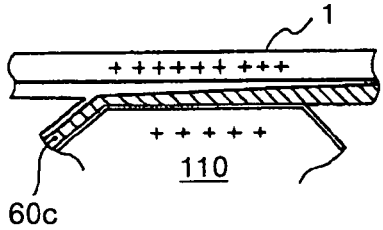

FIG. 3A and FIG. 3B are schematic diagrams which show the condition of the developer in the removal nip which is formed by the photosensitive drum 1 and the sweep roller 110.

To the sweep roller 110, there is applied a bias voltage (250V) which is close to the toner layer surface potential on the photosensitive drum 1 (100V to 200V), so that the toner 60*a* does not return to the sweep roller 110 from the toner layer after the development. In the background section, as shown in FIG. 3B, the floating fog toner 60*c* is moved to the sweep roller 110, by an electric field generated due to a potential difference between the background section on the photosensitive drum 1 and the bias voltage. Thereby, fogging in the background section can be completely prevented.

As a result, the fog toner, which cannot gather on the surface of the developing roller 106 at the developing nip, electrophoretically moves towards the sweep roller 110 between the ground section and the sweep roller 110, and is removed from the photosensitive drum 1.

By installing the sweep roller 110, about 70% of the carrier liquid adhered on the background section on the photosensitive drum 1 at the time of development can be removed.

The cleaning blade 111 is constituted by a metal or rubber member, and scratches and removes the residual developer from the surface of the sweep roller 110, by abutting against this surface of sweep roller 110 after having passed through the removal nip. By this removal, the surface of the sweep roller 110 is initialized.

Each of the developing roller 106 and the sweep roller 110 is desirably constructed such that the surface thereof is applied with a conductive coating, or coated with a conductive tube, to thereby exert smoothness of 3 $\mu$m or less as measured by Rz. This is because it is necessary to exert this level of smoothness in order to support the developer thin layer having a uniform thickness of from 3 to 10 $\mu$m on the developing roller 106 and the sweep roller 110.

For the material of the conductive elastic layer of the developing roller 106 and the sweep roller 110, it is desired to use one having a hardness of 50 degrees or less as measured by JIS-A hardness. This is because in order to ensure the developing nip and the removal nip having a desired width, while forming the surface of the photosensitive drum 1 by a-Si having high hardness, it is necessary to form this conductive elastic layer by a material having a hardness of 50 degrees or less to freely deform it. As it becomes softer, the more the adjustment width of the developing nip expands, but if it is too soft, a defect such as plastic deformation may occur, which is not desirable. For the material of this conductive elastic layer, it is not limited to the conductive urethane rubber (it is made conductive by mixing carbon or the like), but the material may be one which exerts conductivity and does not have the possibility of swelling or dissolving by the carrier liquid or the developer. If it has a construction such that the carrier liquid or the developer does not touch the inner layer thereof, the material of each elastic layer which is the inner layer thereof needs only have the elasticity, without any restriction of the conductivity and swelling and dissolving.

Characteristic construction of this printer will now be explained.

Figure 4A:
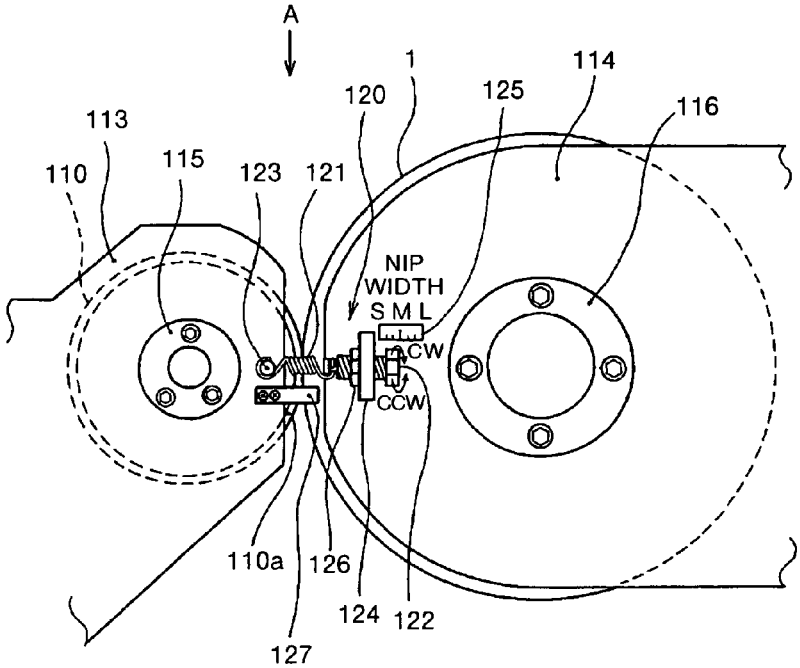
FIG. 4A is a schematic configuration diagram of a sweep roller pressurizing mechanism.
Figure 4B:
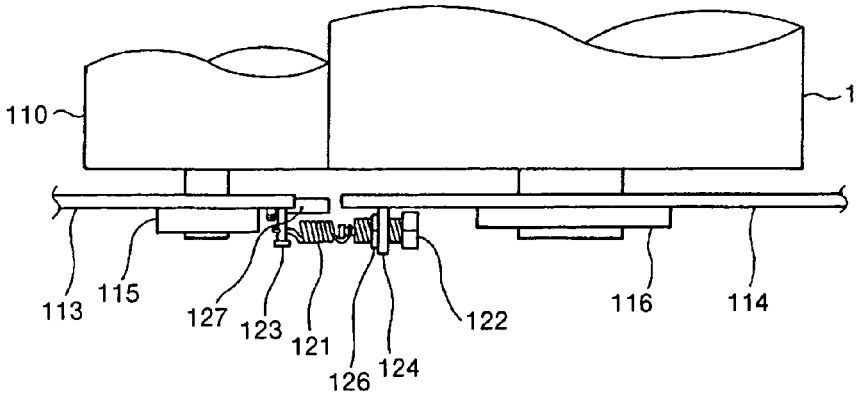
FIG. 4B is a top plan diagram as seen in the direction of an arrow A in FIG. 4A.

In this printer, in order to form the width of the developing nip and of the removal nip of a predetermined size, there is provided a pressurizing mechanism which pressurizes the developing roller 106 and the sweep roller 110 to the photosensitive drum 1. FIG. 4A is a schematic configuration diagram of a sweep roller pressurizing mechanism 120 which forms the removal nip width of the predetermined size between the sweep roller 110 and the photosensitive drum 1. FIG. 4B is a top plan diagram as seen in the direction of an arrow A in FIG. 4A.

In FIG. 4A, the sweep roller pressurizing mechanism 120 can adjust the size of the removal nip width by adjusting the length of a tension spring 121 to adjust the energizing force of the sweep roller 110 with respect to the photosensitive drum 1. The tension spring 121 engages with a groove at the tip of the adjustment screw 122 at one end thereof, and at the other end thereof, engages with a pin 123 provided in a fixed condition on a sweep roller unit side plate 113. The adjustment screw 122 is screwed into an adjustment screw holding member 124 provided in a photosensitive unit side plate 114, and by rotating it, the adjustment screw moves right and left in the figure.

The sweep roller 110 is rotatably held by the sweep roller unit side plate 113 via a bearing holder 115, and is also rotatably held by the photosensitive unit side plate 114 via a bearing holder 116. Therefore, when the distance between the sweep roller unit side plate 113 and the photosensitive unit side plate 114 changes, the center distance between the sweep roller 110 and the photosensitive drum 1 also changes. Since an elastic layer 110*a* is formed on the surface of the sweep roller 110, when the center distance between the sweep roller 110 and the photosensitive drum 1 changes, the elastic layer 110*a* is elastically deformed, to thereby change the size of the removal nip width.

In FIG. 4A, it is assumed that a sweep roller pressurizing mechanism having the similar construction is also provided between the sweep roller unit side plate on the back side and the photosensitive unit side plate on the back side (both not shown).

In FIG. 4A, when the adjustment screw 122 is rotated in the clockwise direction CW, the screw moves towards the left in the figure, to make the length of the tension spring 121 short, thereby the tensile force becomes weak. Hence, the sweep roller 110 moves in the direction of being away from the photosensitive drum 1 (to the left in the figure), by a restoring force of the elastic layer 110*a*. As a result, the width of the developing nip between the sweep roller 110 and the photosensitive drum 1 becomes small. On the other hand, when the adjustment screw 122 is rotated in the counterclockwise direction CCW, the screw moves towards the right in the figure, to make the length of the tension spring 122 long, thereby the tensile force becomes strong. Hence, the elastic layer 110*a* is elastically deformed further, and the sweep roller 110 moves in the direction of approaching the photosensitive drum 1 (to the right in the figure). As a result, the width of the developing nip between the sweep roller 110 and the photosensitive drum 1 becomes large. At this time, adjustment becomes easier if positioning of the adjustment screw 122 is performed while watching the divisions of a scale 125 attached to the photosensitive unit side plate 114. When the width of the developing nip is set to a predetermined size, a fixing nut 126 is fastened by tools such as a spanner so that the adjustment screw 122 will not loosen.

A spacer 127 is screwed on the sweep roller unit side plate 113, and the tip thereof abuts against the photosensitive unit side plate 114 to serve as a stopper, and in this manner, the maximum value of the width of the developing nip can be determined in advance.

A predetermined width of the removal nip corresponding to the developing conditions can be easily obtained, by preparing a plurality of spacers 127 having different lengths, replacing it adequately according to the process linear velocity and the developing time constant, and rotating the adjustment screw 122 until the tip thereof abuts against the photosensitive unit side plate 114 to thereby pull the tension spring 121.

In this manner, a predetermined width of the removal nip can be easily formed with a simple construction, and the excessive liquid developer such as excessive toner and excessive carrier liquid in the ground section on the photosensitive drum 1 having passed the developing nip can be removed by the sweep roller 110, to thereby prevent image fogging and an increase in the running cost.

An optimum width of the removal nip can be set in accordance with the process linear velocity and developing time constant, by rotating the adjustment screw 122 to adjust the size of the width of the developing nip. Hence, the excessive liquid developer can be efficiently scratched and removed from the surface of the photosensitive drum 1 without disturbing the toner image on the surface thereof. When there is a pressure difference in a pressuring force at the axial opposite ends of the sweep roller 110, the pressuring force at the axial opposite ends can be finely adjusted by adjusting the position of the adjustment screw 122, and hence a width of the removal nip of a certain size can be formed over the whole area in the axial direction of the sweep roller 110.

Even if foreign matter adheres on the surface of the photosensitive drum 1, and this foreign matter is put in the removal nip between the sweep roller 110 and the photosensitive drum 1, since the elastic layer 110*a* of the sweep roller 110 elastically deforms, the photosensitive drum land the elastic layer 110*a* are not damaged. Even if the foreign matter is large and it is not absorbed only by the elastic deformation of the elastic layer 110*a*, the tension spring 121 stretches to evacuate the sweep roller 110 from the photosensitive drum 1. Hence, damages of the photosensitive drum 1 and the elastic layer 110*a* can be prevented.

Figure 5A:
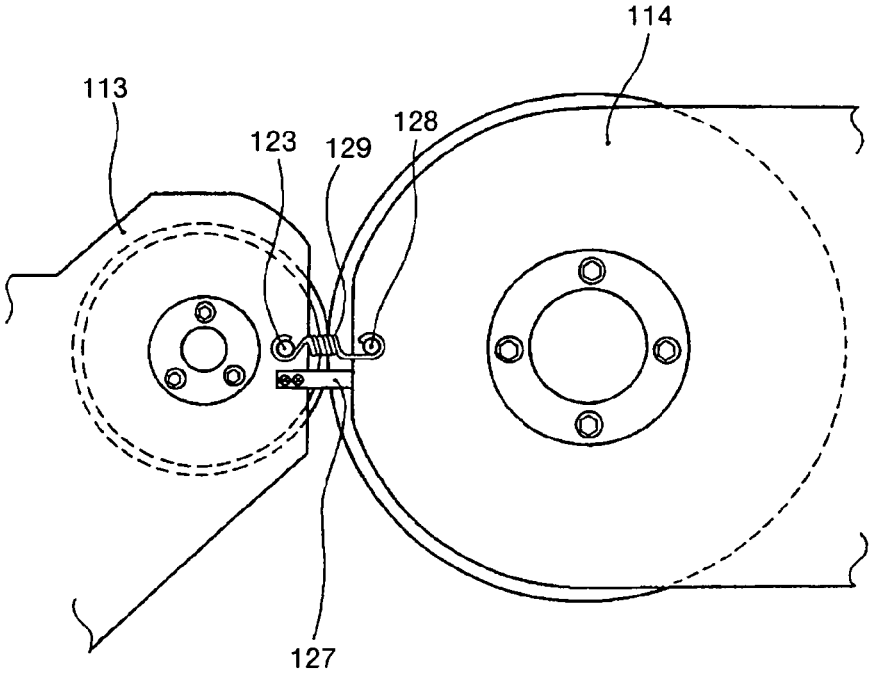
FIG. 5A is a simplified configuration diagram of the sweep roller pressurizing mechanism by omitting an adjustment screw and the like, and 5B is a simplified configuration diagram thereof by further omitting a spacer.
Figure 5B:
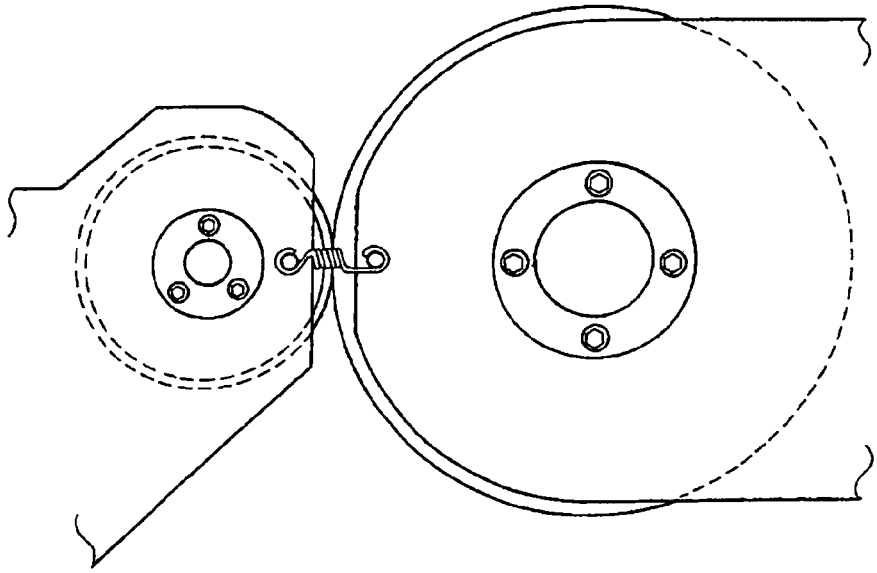

As shown in FIG. 5A, when the length of the spring is not adjusted, such a construction may be used that a pin 128 is provided on the photosensitive unit side plate 114, instead of the adjustment screw 122, and the opposite ends of the spring 129 are engaged with this pin 128 and the pin 123 on the sweep roller unit side plate 113. Alternatively, as shown in FIG. 5B, the spacer 127 may not be provided.

In the first embodiment, the sweep roller pressurizing mechanism 120 between the sweep roller 110 and the photosensitive drum 1 has been explained. However, a developing roller pressurizing mechanism having a similar mechanism as a pressurizing unit may be provided in order to form a developing nip width between the developing roller 106 and the photosensitive drum 1. Thereby, the width of the developing nip at the developing nip can be formed in a predetermined size with a simple construction, and a high quality image can be formed by obtaining high image density contrast and preventing image fogging. In particular, the high-viscosity and high-density liquid developer 60 used for the printer in this embodiment has low mobility of the toner as compared with a low viscosity and low-density liquid developer, and it may be desired to form the width of the developing nip wider. In this embodiment in which development is performed by using such a high-viscosity and high-density liquid developer, high quality image can be formed by forming the width of the developing nip to a size suitable for development, and hence its availability is very high.

In a normal electrophotographic development apparatus, the surface traveling speed of the developing roller 106 is set higher than that of the photosensitive body, in order to feed sufficient toner to an area where the photosensitive body and the development apparatus faces each other. Therefore, since the toner has a higher traveling speed with respect to the photosensitive body surface, misregistration with the latent image occurs. As a result, the image may have such a phenomenon that the point of the image is blurred, or an image developed by the toner is not clear. This phenomenon can be seen also in the liquid development. In the printer according to this embodiment, the surface of the developing roller 106 and the surface of the photosensitive drum 1 moves substantially at the same speed in the same direction, so that the toner does not have a velocity vector in the tangential direction of the photosensitive drum 1, and hence the above phenomenon does not occur.

MODIFICATION EXAMPLE 1

In the first embodiment, there has been explained the construction in which the spacer 127 is used to set the maximum value of the width of the removal nip in advance so that the space between the sweep roller unit side plate 113 and the photosensitive unit side plate 114 does not become narrower than a predetermined size. However, the construction may be such that a roller member for the spacer is provided in the sweep roller 110.

Figure 6A:
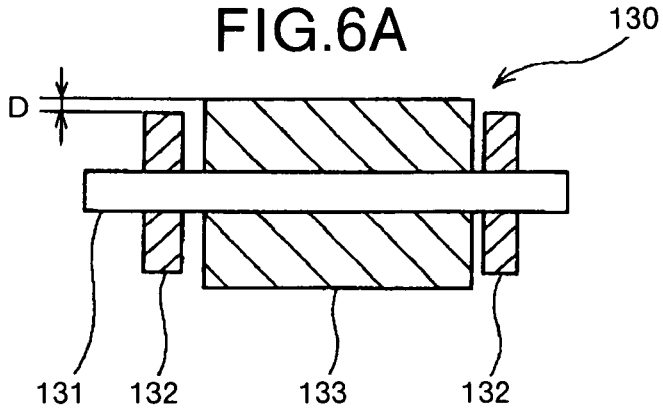
FIG. 6A is a sectional diagram of a sweep roller according to a first modification example of the first embodiment, and 6B is an explanatory diagram which shows the condition that a sweep roller is energized with respect to a photosensitive drum.
Figure 6B:
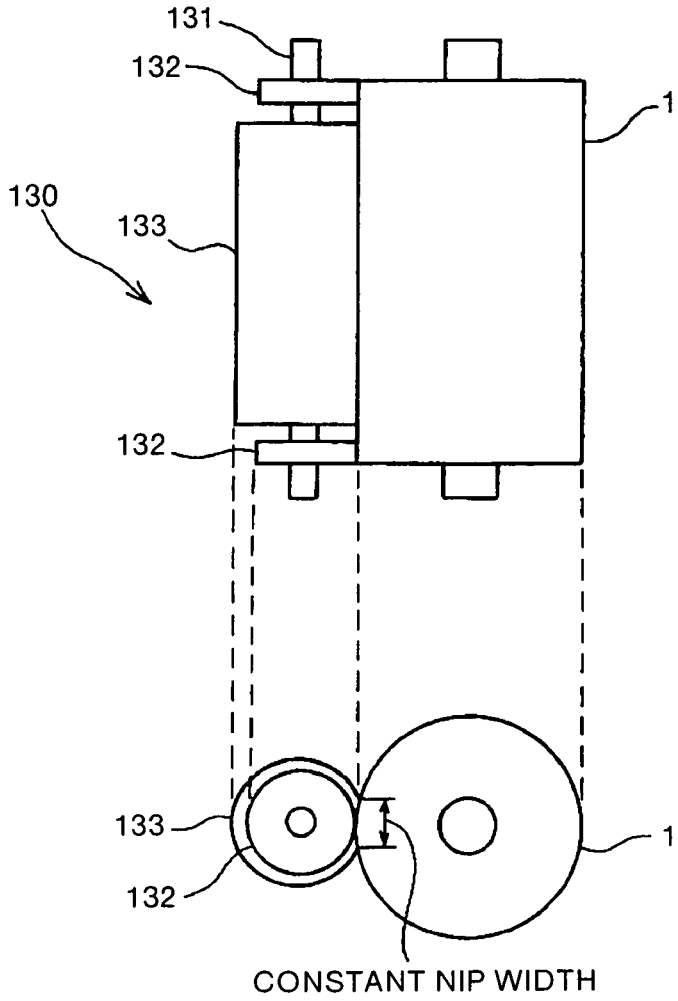

FIG. 6A is a sectional diagram of the sweep roller 130 in this modification example. FIG. 6B is an explanatory diagram which shows the condition that the sweep roller 130 is energized with respect to the photosensitive drum 1.

In FIG. 6A, the sweep roller 130 comprises a cored bar 131 made of a metal, a pair of spacer rollers 132 having the same outer diameter with each other, and a rubber elastic layer 133 having a slightly larger outer diameter than that of the spacer rollers. The half of the difference in the outer diameter between the pair of spacer rollers 132 and the rubber elastic layer 133 becomes the encroaching quantity.

When this sweep roller 130 is energized so as to abut against the photosensitive drum 1, as shown in FIG. 6B, the pair of spacer rollers 132 abut against the photosensitive drum 1, and the rubber elastic layer 133 elastically deforms by the encroaching quantity D, to thereby form a removal nip having a predetermined nip width. The size of the energizing force is set to be not smaller than a value at which the spacer rollers 132 abut against the photosensitive drum 1, to thereby restrict the movement of the sweep roller 130. If the sweep roller 130 is energized such that the pair of the spacer rollers 132 abuts against the photosensitive drum 1, the removal nip width is maintained in a certain size, thereby a stable removal nip can be formed.

It is a matter of course that the construction of the sweep roller 130 according to this modification example 1 can be applied to the developing roller 106.

[Second Embodiment]

In the first embodiment, there has been explained the construction in which the sweep roller 110 is pulled by the tension spring 121, to energize the sweep roller 110 with respect to the photosensitive drum 1, to thereby form the removal nip. However, the construction may be such that the axial distance between the sweep roller 110 and the photosensitive drum 1 is adjusted, to thereby adjust the width of the removal nip.

Figure 7A:
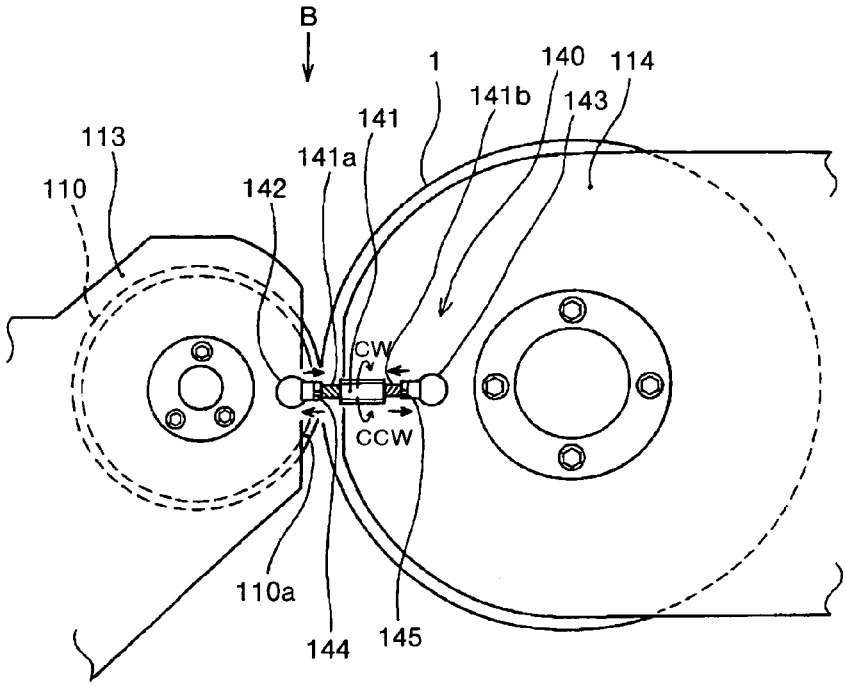
FIG. 7A is a schematic configuration diagram of a removal nip width adjusting mechanism which adjusts the width of a removal nip between a sweep roller and a photosensitive drum, and 7B is a top plan diagram as seen in the direction of an arrow B in FIG. 7A.
Figure 7B:
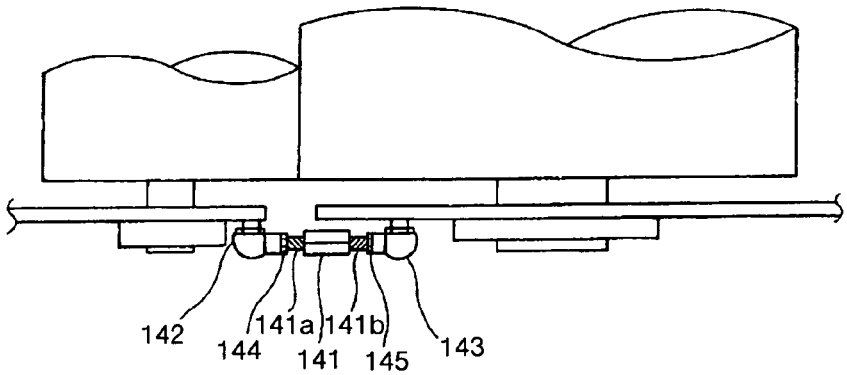

FIG. 7A is a schematic configuration diagram of a removal nip width adjusting mechanism 140 which adjusts the width of a removal nip between a sweep roller 110 and a photosensitive drum 1, and FIG. 7B is a top plan diagram as seen in the direction of an arrow B in FIG. 7A.

In FIG. 7A, the removal nip width adjusting mechanism 140 has a tie rod 141. This tie rod 141 has a right-hand thread 141*a* at one end (the left side in the figure), and a left-hand thread 141*b* at the other end (the right side in the figure), which is generally referred to as an inverse screw. The right-hand thread 141*a* of the tie rod 141 is screwed into a rod end 142, and the left-hand thread 141*b* thereof is screwed into a rod end 143 for left-hand thread. As these rod ends 142 and 143, there can be used, for example, a rod end manufactured by THK.CO., LTD, known as a product name "Link Ball". The rod end 142 is secured by a screw on the sweep roller unit side plate 113. On the other hand, the rod end 143 for left-hand thread is secured by a screw on the photosensitive unit side plate 114.

In FIG. 7A, it is assumed that a removal nip width adjusting mechanism having the similar construction is also provided between the sweep roller unit side plate on the back side and the photosensitive unit side plate on the back side (both not shown).

The adjustment of the removal nip width by the removal nip width adjusting mechanism 140 is performed by rotating the tie rod 141. The cross section of the body of the tie rod 141 section where threading is not applied is a hexagonal shape, so that it can be easily rotated by tools such as a spanner. When the tie rod 141 is rotated in the clockwise direction CW, the right-hand thread 141*a* is screwed into the rod end 142 deeper, and the left-hand thread 141*b* is screwed into the rod end 143 for left-hand thread deeper. As a result, the distance between the rod end 142 and the rod end 143 for left-hand thread becomes closer to each other, and at the same time, the axial distance between the sweep roller 110 and the photosensitive drum 1 becomes short. Then, the deformed amount of the elastic layer 110*a* of the sweep roller 110 increases, to thereby increase the width of the removal nip.

On the other hand, if the tie rod 141 is rotated in the counterclockwise direction CCW, the engagement by thread between the right-hand thread 141*a* and the rod end 142 becomes shallow, and the engagement by thread between the left-hand thread 141*b* and the rod end 143 for left-hand thread also becomes shallow. As a result, the distance between the rod end 142 and the rod end 143 for the left-hand thread increases, and at the same time, the axial distance between the sweep roller 110 and the photosensitive drum 1 becomes long. Then, the deformed amount of the elastic layer 110*a* of the sweep roller 110 decreases, to thereby decrease the width of the removal nip. After the length of the axial distance is set, a fixing nut 144 and a fixing nut 145 for left-hand thread are fastened so that the tie rod 141 does not rotate.

In this manner, by adjusting the size of the removal nip width by the removal nip width adjusting mechanism 140 constituted by the tie rod 141 and the like, the width of the removal nip can be maintained in a certain size, and hence a stable removal nip can be formed.

When the adjusting mechanism of the removal nip width is not required, the construction may be such that, for example, the sweep roller unit side plate is also used in common as the photosensitive unit side plate, a bearing for each roller is set on this common side plate, to make the distance between these bearings constant, to thereby form a uniform width of the removal nip.

It is a matter of course that the construction of the removal nip width adjusting mechanism according to this second embodiment can be applied to the developing roller 106.

If it is necessary to increase the image formation speed than the normal speed thereof, to make the image density to a desired density, or to change the image density according to the smoothness of the surface of the transfer paper, the developing time is set to a desired time, thereby it becomes possible to obtain an excellent image. Next, there is explained an embodiment in which the width of the developing nip can be changed in order to set the developing time to a desired time.

[Third Embodiment]

Figure 8A:
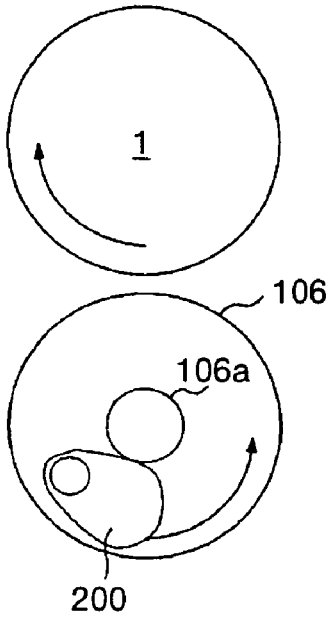
FIGS. 8A, 8B and 8C are explanatory diagrams which show a third embodiment of the present invention.
Figure 8B:
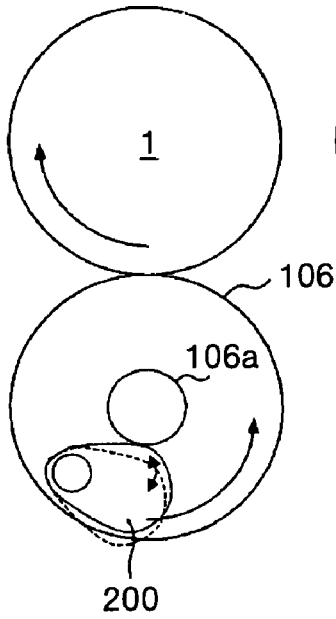
Figure 8C:
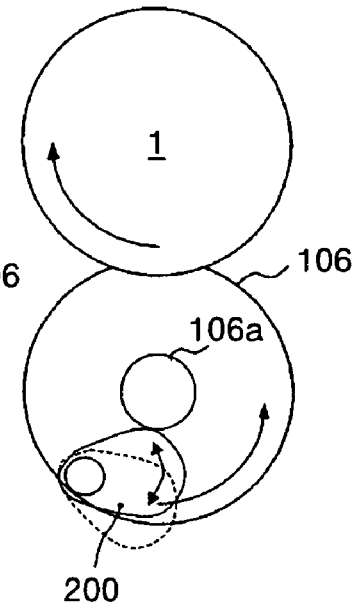

FIGS. 8A, 8B and 8C are explanatory diagrams which show the third embodiment. In this embodiment, an eccentric cam 200 rotatably provided at a position abutting against an axis of a developing roller is used as an encroaching quantity change unit. The position of the axis of the developing roller is shifted by rotating the eccentric cam to change the direction, to thereby change the encroaching quantity of the photosensitive drum 1 with respect to the developing roller 106.

FIG. 8B shows a normal condition in which the developing roller 106 abuts against the photosensitive drum 1, and the developing nip is also formed slightly. If the eccentric cam is slightly rotated in the counterclockwise direction from this position in FIG. 8B, and stopped, as shown in FIG. 8C, the axis of the developing roller approaches the axial direction of the photosensitive drum, and the surface of the developing roller is pressed against the surface of the photosensitive drum, to thereby increase the encroaching quantity into the surface of the photosensitive drum, and the width of the developing nip also increases. On the contrary, if the eccentric cam is slightly rotated in the clockwise direction from the position in FIG. 8B, and stopped, as shown in FIG. 8A, the axis of the developing roller is away from the axial direction of the photosensitive drum, and the surface of the developing roller is separated from the surface of the photosensitive drum.

However, when the width of the developing nip is the largest, the maximum width of the developing nip is set to be a required amount to change the image formation speed, to set the image density to a desired density, or to change the image density according to the smoothness on the surface of the transfer paper. This is because if the highest density that can be desired as the image density can be obtained with a narrow width of the developing nip, even if the width of the developing nip can be expanded more, it is meaningless for increasing the image density. The same thing applies to the width of the developing nip for obtaining the highest image density that can be desired corresponding to a change of the image formation speed or the smoothness of the transfer paper.

When the image formation speed is increased, the image density is increased, or a transfer image is formed with respect to transfer paper having large unevenness on the surface and poor smoothness, the eccentric cam is rotated in the counterclockwise direction until a desired width of the developing nip is obtained, and the rotation is stopped when the desired nip width is obtained. Thereby, the width of the developing nip can be increased to a desired size, and can be stably maintained in that width. By increasing the width of the developing nip compared to a normal width of the developing nip, the adhered amount of the toner on the image section can be increased. Hence, even if the image formation speed is increased, a desired image density can be obtained without causing a decrease in the image density. When it is desired to increase the image density, the image density can be increases. When a transfer image onto transfer paper having poor smoothness, unevenness on the transfer paper is filled up, and the image density can be increased to a degree that blanking does not occur.

For example, only at the time of development operation, the developing roller 106 is made to abut against the surface of the photosensitive drum, and at the time of non-development, as shown in FIG. 8A, the developing roller 106 is separated from the photosensitive drum. Thereby, a stress applied to each member when development is not performed can be reduced to thereby increase the durability.

It is a matter of course that the construction for changing the width of the developing nip according to the third embodiment can be applied to the adjustment of the width of the developing nip, and the adjustment of the width of the removal nip between the sweep roller 110 and the photosensitive drum 1.

MODIFICATION EXAMPLE 1

Figure 9:
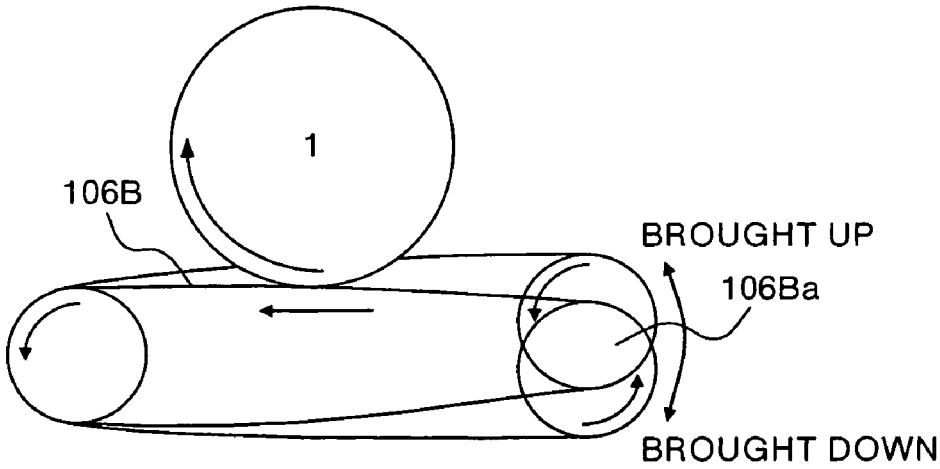
FIG. 9 is an explanatory diagram which shows a first modification example according to the third embodiment.

FIG. 9 is an explanatory diagram which shows a modification example 1 according to the third embodiment, wherein an image support is formed into a developing belt 106B in a belt form. One of the two belt support rollers 106Ba which support the developing belt is provided with an eccentric cam similar to that in the third embodiment, though not shown. By the rotation of the eccentric cam, the position of the belt support roller 106Ba with respect to the axis of the photosensitive drum is shifted. When the belt support roller is brought up to approach the axis of the photosensitive drum, by the rotation of the eccentric cam, the amount to be wound of the developing belt with respect to the surface of the photosensitive drum increases, and the width of the developing nip increases. On the contrary, when the belt support roller is brought down to separate from the photosensitive drum axis, the amount to be wound of the developing belt with respect to the surface of the photosensitive drum decreases, and the width of the developing nip decreases.

As in this modification example 1, the amount to be wound of the developing belt with respect to the surface of the photosensitive drum 1 is changed to change the width of the developing nip, by using a developing belt as the developer support. Further, the mechanism to displace the belt support roller is not limited to the construction which uses the eccentric cam described in the third embodiment.

MODIFICATION EXAMPLE 2

Figure 10:
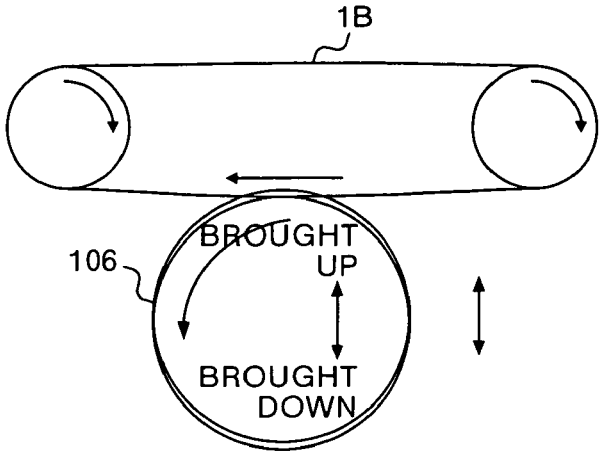
FIG. 10 is an explanatory diagram which shows a second modification example according to the third embodiment.

FIG. 10 is an explanatory diagram which shows a modification example 2 according to the third embodiment, wherein a latent image support is formed into a photosensitive body belt 1B in a belt form. Though not shown, an eccentric cam similar to that shown in the third embodiment is provided on the axis of the developing roller. By the rotation of the eccentric cam, the position of the developing roller 106 with respect to the photosensitive body belt is shifted, and the amount to be wound of the photosensitive body belt with respect to the developing roller changes. When the developing roller 106 is brought up by the rotation of the eccentric cam, the amount to be wound of the photosensitive body belt with respect to the developing roller 106 increases, and the width of the developing nip increases. On the contrary, when the developing roller 106 is brought down, the amount to be wound of the photosensitive body belt with respect to the developing roller 106 decreases, and the width of the developing nip decreases.

As in this modification example 2, since the belt-like photosensitive body belt is used as the latent image support, the amount to be wound of the photosensitive body belt with respect to the developing roller 106 can be changed to change the width of the developing nip. The mechanism which displaces the developing roller 106 is not limited to the construction which uses the eccentric cam described in the third embodiment.

As in the modification example 2, if the belt-like photosensitive body belt is used as the latent image support, the developing roller 106 may be a non-elastic roller, and hence, for example a metal roller may be used.

When the latent image support is the photosensitive drum 1, if an elastic layer is provided, the width of the developing nip and the width of the removal nip can be changed, without providing an elastic layer on the developing roller 106 and the sweep roller 110, as described above.

[Fourth Embodiment]

Figure 11:
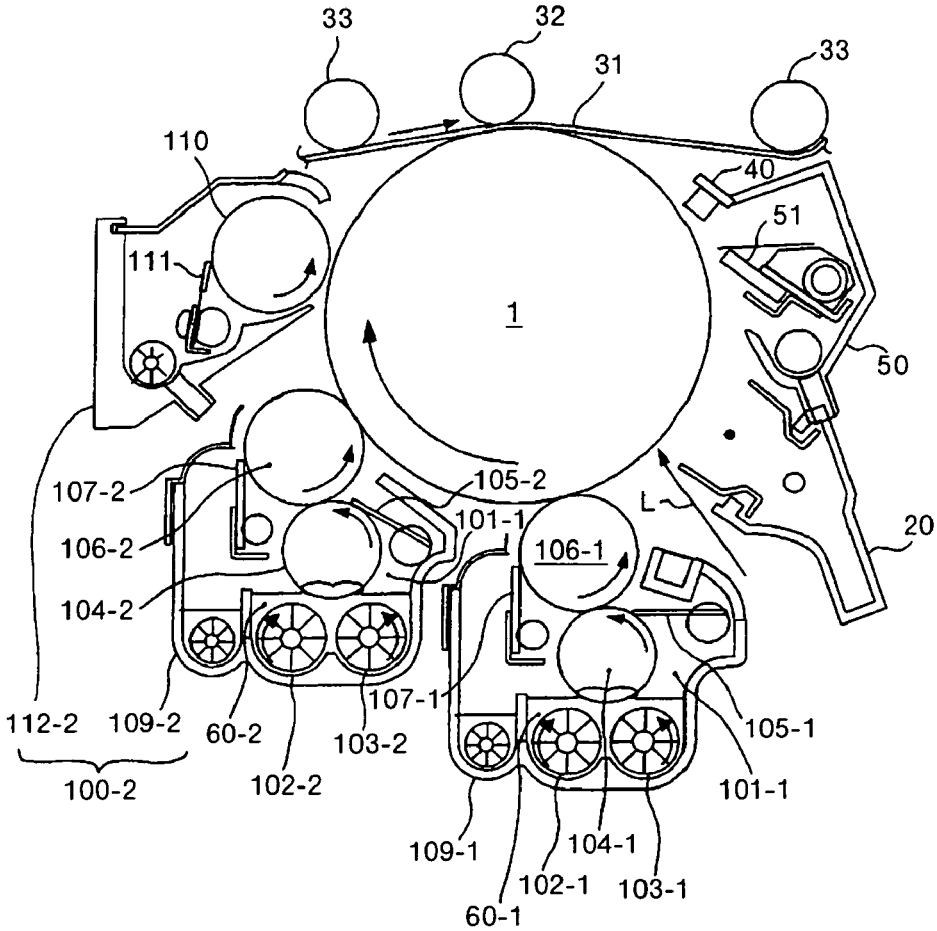
FIG. 11 is a schematic configuration diagram of a printer according to a fourth embodiment.

A fourth embodiment in which a plurality of developing rollers 106 is provided will now be explained. FIG. 11 is a schematic configuration diagram of a printer according to the fourth embodiment. In this printer, there are arranged two developing sections 109-1 and 109-2 side by side in the moving direction on the surface of the photosensitive drum, and each of the developing sections has a developing roller 106-1, 106-2, respectively. With respect to these two developing rollers 106-1, 106-2, the voltage application mechanism may be one. However, since the potential of the photosensitive body attenuates even in the dark, the potential of the photosensitive body changes for the first developing roller and the second developing roller. In this embodiment, it is constructed such that different voltage can be applied respectively to each roller, thereby suitable developing bias can be set. As a result, the developed amount in the image section and the amount of fog adhesion in the background section can be adjusted.

The developing rollers 106-1 and 106-2 in this embodiment are provided respectively with an approaching and separating unit as a developer support approaching and separating unit with respect to the photosensitive drum 1, thereby enabling a change of the width of the developing nip. Therefore, though not shown, an eccentric cam similar to that in the third embodiment is respectively provided in the developing rollers 106-1 and 106-2, on the axis of the developing roller.

In the above construction, for example, when the linear velocity of the photosensitive body is relatively slow, only one developing roller is brought into contact with the photosensitive drum 1, and the other one is separated therefrom. When the linear velocity thereof is relatively fast, both of the developing rollers 106-1 and 106-2 are brought into contact with the photosensitive drum 1. When the width of the developing nip of each roller is the same, the whole development time is proportional to the number of developing rollers which are brought into contact with the photosensitive drum 1. Therefore, the fewer is the number of developing rollers which are brought into contact with the photosensitive drum 1, the shorter is the development time, and the more the number of developing rollers, the longer the development time. In this embodiment, by changing the number of developing rollers abutting against the photosensitive drum 1, the width of the developing nip can be easily set to a predetermined width.

The width of the developing nip can be also changed corresponding to a change in the density of the image to be formed or the surface smoothness of the transfer paper to be used.

It is a matter of course that if the number of developing rollers is three or more, a delicate change of the width of the developing nip becomes possible. As in the third embodiment, it is also possible to form the nip width of each of the developing rollers 106-1 and 106-2 changeable with respect to the photosensitive drum 1, thereby further delicate change of the width of the developing nip becomes possible.

According to the third and fourth embodiments, the width of the developing nip can be changed corresponding to the image formation speed, the kind of transfer papers and a requirement for the image density. As a result, image fogging or blanking can be prevented and high quality image can be formed, while obtaining a desired image density.

[Fifth Embodiment]

The developing section 109 and the sweeping section 112 of the development apparatus 100 can be formed so as to be able to approach or separate from the photosensitive drum 1.

Figure 12:
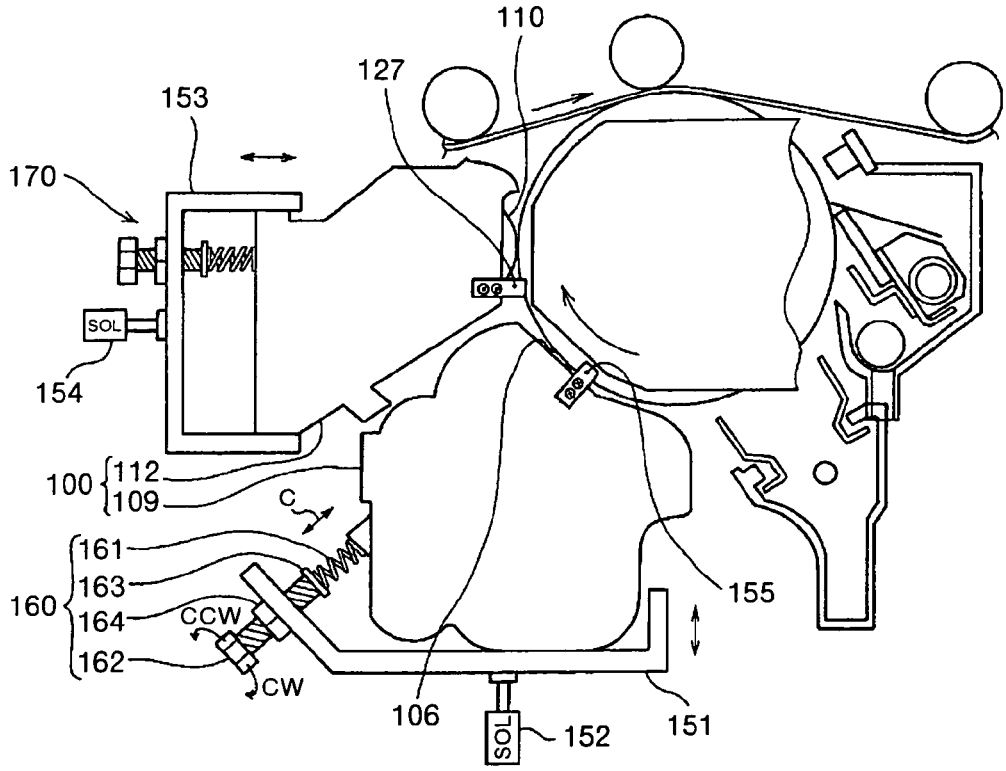
FIG. 12 is a schematic configuration diagram of a developing section and a sweeping section respectively provided with an approaching and separating mechanism.

FIG. 12 is a schematic configuration diagram of the developing section 109 and the sweeping section 112 respectively provided with an approaching and separating mechanism.

In FIG. 12, the developing section 109 is held slidably in the direction of an arrow C with respect to a movable base 151 for development. The movable base 151 for development is shifted vertically in the figure by an electromagnetic solenoid 152, thereby the developing roller 106 approaches and separates from the photosensitive drum 1. The sweeping section 109 is held slidably by a movable base 153 for sweeping. The movable base 153 for sweeping is shifted laterally in the figure by an electromagnetic solenoid 154, thereby the sweep roller 110 approaches and separates from the photosensitive drum 1. In this manner, by constructing the developing roller 106 and the sweep roller 110 so as to be able to approach and separate from the photosensitive drum 1, for example only at the time of development, the developing roller 106 is made to abut against the photosensitive drum 1, and at the time of non-development, the developing roller 106 is separated from the photosensitive drum 1, thereby a stress applied to each member when development is not performed can be reduced to thereby increase the durability. Instead of the electromagnetic solenoid 152, a cam mechanism may be used to shift the movable base 151 for development.

The movable base 152 for development is provided with a developing roller energizing mechanism 160 which energizes the developing roller 106 towards the photosensitive drum 1. This developing roller energizing mechanism 160 comprises a compression spring 161, an adjustment screw 162 which adjusts the energizing force by adjusting the length of this compression spring, a washer 163, and a fixing nut 164.

The adjustment screw 162 is engages by thread with a female screw section provided in the movable base 151 for development. In the condition shown in the figure, when the adjustment screw 162 is rotated in the clockwise direction CW, the compression spring 161 loosens, and the energizing force of the developing roller 106 with respect to the photosensitive drum 1 increases to thereby increase the width of the developing nip. The developing roller 106 is energized towards the photosensitive drum 1 until the spacer 155 abuts against the photosensitive unit side plate 114. On the contrary, when the adjustment screw 162 is rotated in the counterclockwise direction CCW, the compression length of the compression spring 161 increases, and the energizing force of the developing roller 106 with respect to the photosensitive drum 1 decreases, thereby the width of the developing nip becomes small.

The sweep roller movable base 153 is provided with a sweep roller energizing mechanism 170 which energizes the sweep roller 110 towards the photosensitive drum 1. The construction and the operation of this sweep roller energizing mechanism 170 are similar to that of the developing roller energizing mechanism 160, and hence detailed explanation thereof is omitted.

[Sixth Embodiment]

The rubber layer on the surface of the developing roller 106 and the sweep roller 110 will be explained.

In order to perform development and sweeping by applying a bias, at least the surface of the roller needs to have conductivity. If the entire roller including the rotation axis is conductive, bias can be applied from the rotation axis. If the surface only is conductive, bias is applied from the surface of the roller. In order to make the entire roller conductive, there can be mentioned a method using a material in which the material itself is conductive, which is mainly referred to as ion conduction, and a method using a material in which conductive particles such as carbon, titanium oxide or tin oxide are dispersed, which is referred to as electronic conduction. When the ion conductive material is used, the kind is limited, and it is difficult to decrease the hardness thereof. On the other hand, when the electronic conductive material is used, a relatively low-hardness material can be used. With the electronic conductive material, as the amount of the conductive particles to be dispersed therein increases, the material becomes low-resistance, which has a tendency to have high hardness.

Since the developing roller 106 and the sweep roller 110 have substantially the same construction, only the developing roller 106 will be explained, and explanation of the sweep roller 110 is omitted.

At the developing nip, an electric field is formed between the developing roller 106 and the photosensitive drum 1. The toner in the liquid developer moves from the developing roller 106 to the photosensitive drum 1, during the developing nip transit time when an optional portion where the latent image on the surface of the photosensitive drum 1 is formed enters into the developing nip and leaves the developing nip. When the photosensitive drum 1 and the developing roller 106 are used, it is necessary that either of these is flexible in order to form the developing nip. In each of the above embodiments, a developing roller having flexibility on the surface thereof is used. Therefore, when the surface has low hardness, it is bent with a weak force, to thereby form the developing nip. In order to produce a developing roller having a low-hardness surface, generally oil is contained in the material constituting the surface thereof. However, the developing roller containing oil to have flexibility has a problem in that the oil in the roller leaks, or the developing roller may shrink due to leakage of the oil, when a liquid developer is used. Alternatively, the developing roller may absorb the liquid developer or its component and swell.

Figure 13:
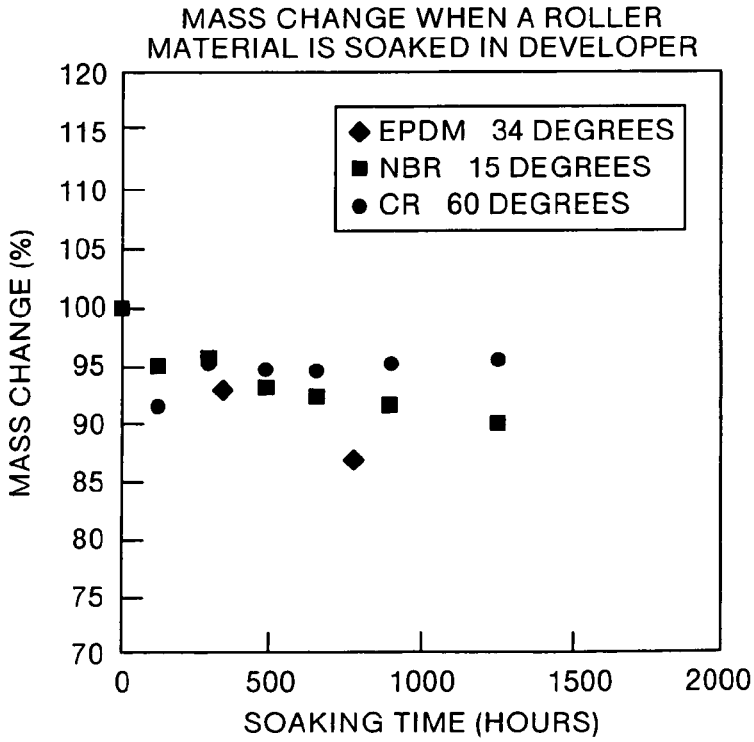
FIG. 13 is a graph which shows a mass change when a roller material such as EPDM is soaked in a developer.

Therefore, the present inventors have made various tests to achieve low hardness and low resistance. As a result, it has been found that a material which can be made low-resistance and low-hardness is a urethane resin. Studies have been made for hydrin rubber as the ion conductive material, and EPDM (ethylene propylene rubber), CR (chloroprene rubber), NBR (nitrilebutylene rubber), and a material obtained by dispersing carbon in silicone rubber or the like, as shown in Table 1 as the electronic conductive material. However, as shown in FIG. 13, these materials cannot be used because these swell due to the liquid developer or the component thereof, or the mass thereof changes due to exudation of oil, or the hardness thereof is too high to form the developing nip.

TABLE 1

| | Hardness of test piece (JIS-A) | Problems |
|---|---|---|
| EPDM | 34 degrees | Mass decreased after soaking in developer, and deformed |
| CR | 60 degrees | Mass decreased after soaking in developer, and nip could not be formed |
| NBR | 15 degrees | Mass decreased after soaking in developer, and oil exuded |
| Silicone rubber | 5 degrees | Swelled in developer |

Figure 14:
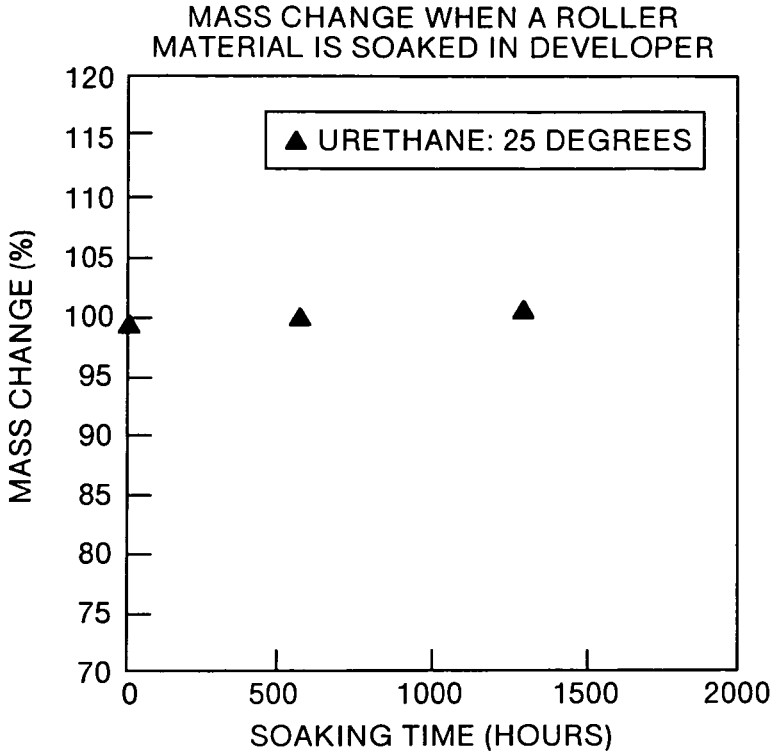
FIG. 14 is a graph which shows a mass change when a urethane resin is soaked in a developer.

With the urethane resin, as shown in FIG. 14, even a low-hardness one hardly causes a mass decrease, and did not swell.

The surface of the developing roller requires smoothness, this is because unevenness on the roller surface appears on the image. The developing roller 106 and the photosensitive drum 1 perform development while moving substantially at the same speed. At the time of development, only a developer in a portion facing the image section, of the developer layer formed on the developing roller 106, is selectively transferred onto the photosensitive drum 1 (the developer in the background section is left on the developing roller). The thickness of the developer layer on the developing roller 106 determines the density on the photosensitive body, and finally the image density on the transfer paper, except that when the image density is adjusted by the width of the developing nip, or development can be done always with 100% density with the developer on the developing roller.

Figure 15:
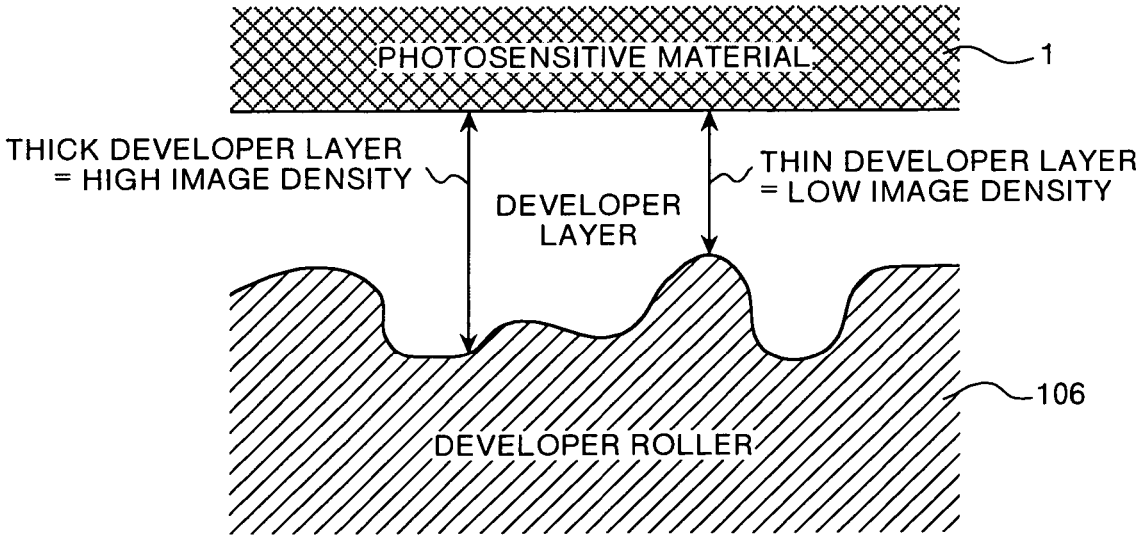
FIG. 15 is a schematic diagram which shows a developing nip between the surface of a developing roller surface and a photosensitive drum.

As shown in FIG. 15, when there is unevenness on the surface of the developing roller, the developer existing between the photosensitive drum 1 having a smooth surface and the developing roller 106 at the time of development becomes thin in the protrusions on the surface of the developing roller and becomes thick in the recesses.

In order to make the surface of the developing roller smooth sufficient for image formation (not higher than Rz 3 $\mu$m), it is necessary to polish the surface. This is because even when cast molding is performed, if there is a joint in the mold, it affects the image. At this time, as the roller has lower hardness, polishing becomes more difficult since the roller is blurred, and polishing scar such as a pitch of a cutter is likely to appear on the surface. Table 2 shows the relationship between hardness and surface roughness in hydrin rubber and urethane rubber.

TABLE 2

| | Hardness of test piece (JIS-A) | Surface roughness of roller (Rz[$\mu$m]) |
|---|---|---|
| Hydrin rubber | 30 degrees | 12 |
| Urethane rubber | 25 degrees | 5 |

As the surface nature that can remove (clean out of) the developer remaining after development, there is one referred to as "tacking property", different from the surface roughness expressed by unevenness as described above. It can be referred to also as "stickiness", which is viscous and sticky property such as one caused on the surface of varnish which has not completely dried, or on the surface of ink. Generally, the surface of rubber has strong tacking property, and polished or cast molded resin has weak tacking property. If the tacking property on the surface is strong, and when a cleaning blade or the like is abutted against the developing roller, a metal or resin blade may be locked up in the roller, or a rubber blade may get involved in the rotation of the roller. Particularly when a low-hardness rubber roller has generally strong tacking property.

Figure 16:
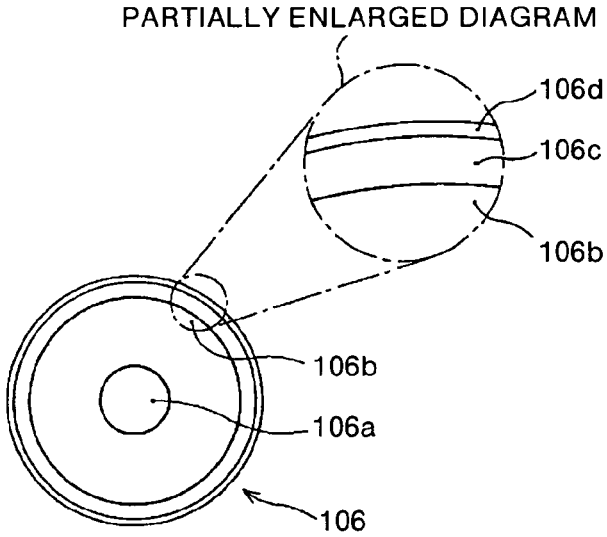
FIG. 16 is a side diagram of a developing roller according to the fourth embodiment of the present invention.

When a roller is used, which has a property such as low hardness, rough surface roughness, being swelled by a developer or the component thereof, shrinking due to the developer or the component thereof, or strong tacking property on the surface, the resin tube is coated or a resin layer is applied on the surface layer, thereby swelling or shrinking property of the roller, oil exudation from the roller and the tacking property can be improved. FIG. 16 is a side diagram of the developer roller 106 according to the sixth embodiment. This developer roller 106 comprises an axis of rotation 106*a* and a cored bar 106*b*, and an inner layer 106*c* is formed on the outer peripheral face of the cored bar 106*b*, and a surface layer 106 is formed for covering this inner layer.

A coated face of a tube or a resin consisting of a resin film as the surface layer 106*d* has generally small surface roughness (the surface is not rough) and low tacking property, and even if carbon is dispersed therein, the thickness thereof can be made thin. Hence, it has little influence on the hardness. Therefore, by coating the rubber surface of the inner layer 106*c* with a resin tube, or forming a resin coated face, a contact between the rubber in the inner layer 106*c* and the developer or the component thereof can be avoided, to thereby prevent swelling and shrinkage, and further exudation of oil in the rubber into the developer can be prevented.

For the surface layer 106*d*, PFA is found to be most suitable in diagram of hardness, plastic deformation, surface roughness, mechanical strength and mould releasing property, as a result of studies of PFA (tetrafluoroethylene-perfluoroalkylvinyl ether copolymer), polyimide, nylon, polycarbonate, PTFE (polytetrafluoroethylene), PVdF (polyvinylidene fluoride). Polyimide has high hardness, and is likely to be elastically deformed. Nylon and other materials have such a problem that these are easily damaged by a metal cleaning blade.

The resin film can be made conductive by dispersing conductive particles such as carbon therein. Also by changing the dispersion ratio of conductive particles, the conductivity (resistance) can be adjusted.

As a preferable combination of the inner layer 106*c* and the surface layer 106*d*, there can be mentioned a combination of silicone rubber for the inner layer 106*c* and PFA for the surface layer 106*d*. Since silicone rubber can be molded in the PFA tube, steps such as polishing after roller formation, tube coating and adhesion can be omitted. The PFA tube has a surface roughness suppressed to 2 to 3 $\mu$m, and a roller can be made from this PFA tube without swelling due to the developer or the component thereof. In this instance, however, it is difficult to make the silicone rubber conductive, and hence a bias for forming electric field is applied from the surface of the silicone rubber.

As a preferable combination of the inner layer 106*c* and the surface layer 106*d*, there can be also mentioned a combination of urethane resin for the inner layer 106*c* and PFA for the surface layer 106*d*.

As the surface layer 106*d*, urethane resin may be coated. Urethane resin hardly swells or causes mass decrease due to the developer or the component thereof, as described above, has excellent mechanical strength, and is unlikely to be damaged. It can be made conductive by dispersing conductive particles such as carbon. By coating urethane resin, the polished surface of the inner layer 106*c* can be made smoother (the surface roughness can be improved). The coating thickness can be adjusted. Even a relatively high-hardness urethane resin can follow the flexibility of the inner layer by coating it in a thin layer, and further the tacking property can be made weak. As a result, the inner layer 106*c* can be formed of urethane resin, and the surface layer 106*d* can be formed of a urethane coat layer in which urethane resin is coated on the surface of the urethane resin.

When the surface layer 106*d* comprising a conductive material is coated on the inner layer 106*c* comprising a conductive material, a bias can be applied from the axis of rotation 106*a*. At this time, it is desired to bond the inner layer 106*c* and the surface layer 106*d*. If these layers are not bonded, the developer or the component thereof infiltrates into the space between the inner layer 106*c* and the surface layer 106*d* due to the capillary phenomenon. Then, when the developing roller 106 rotates, the surface layer 106*d* slips with respect to the inner layer 106*c*, causing such problems that the surface layer 106*d* may not rotate, or a force is applied to a part of the surface layer 106*d*, thereby this part may be shifted from the inner layer 106*c*.

When an insulation adhesive is used for bonding the inner layer 106*c* and the surface layer 106*d*, there is a problem in applying a bias from the axis of rotation 106*a* of the developing roller 106. When a conductive adhesive is used for bonding, the conductivity of the inner layer 106*c* can be used. The conductive adhesives include one in which conductive fine particles are dispersed in a urethane adhesive, which shows excellent adhesiveness without swelling due to the developer.

MODIFICATION EXAMPLE 1

In the first embodiment, an example for forming an image by inverse development has been explained, but an image can be formed also by regular development. When the regular development is used, the relationship between each of the potentials in the printer is set as in the following expression:

[Expression 1]

potential of the photosensitive body>potential of toner layer in image section>VB2>VB1>potential in background section wherein, VB1 denotes a potential between the surface of the photosensitive drum and the developing roller 106, VB2 denotes a potential between the surface of the photosensitive drum and the sweep roller 110.

As a specific example of potential, in an instance of negatively charged toner, the potential of the photosensitive body is set to +600V, the potential of a toner layer in the image section is set to +500V, VB2 is set to +300V, VB1 is set to +100V, and the potential in the background section is set to +500V.

[Seventh Embodiment]

An example applied the present invention in a seventh embodiment to an electrophotographic copying machine (hereinafter referred to as copying machine), being liquid development image formation apparatus, will be explained.

Figure 17:
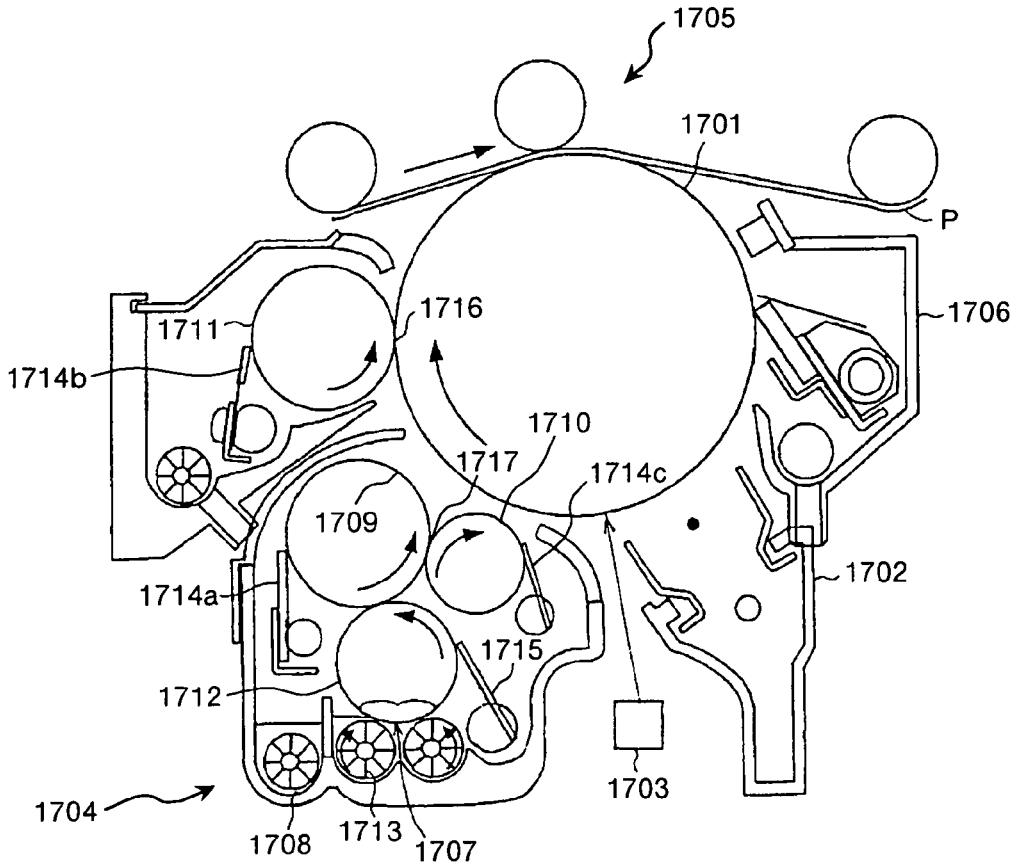
FIG. 17 is a schematic configuration diagram of the main part of a copying machine according to a seventh and eighth embodiments of the present invention.

FIG. 17 is a schematic configuration diagram which shows the main part of the copying machine according to this embodiment. The copying machine according to this embodiment is provided with charging apparatus 1702, exposure apparatus 1703, development apparatus 1704, transfer apparatus 1705 and cleaning apparatus 1706, arranged around a photosensitive drum 1701 as a latent image support. As the material for the photosensitive drum 1701, a-Si, OPC or the like can be used. As the charging apparatus, a form of roller or charger may be used. As the exposure apparatus, an LED or laser scanning optical system may be used.

The instance for forming an image by inverse development using a copying machine having the construction will be explained. The photosensitive drum 1701 is rotated in the direction of an arrow at a certain speed, at the time of copying, by a driving unit such as a motor (not shown). After the photosensitive drum 1701 is uniformly charged up to about 600V in the dark by a charging roller, an original optical image is irradiated and formed by the exposure apparatus 1703, thereby an electrostatic latent image is supported on the outer peripheral face of the photosensitive drum 1701. Thereafter, the electrostatic latent image is developed while it is passing through the development apparatus section. The toner image developed on the electrostatic latent image is transferred onto a transfer paper P by the transfer apparatus 1705. After the transfer paper P has been separated, the residual toner on the photosensitive drum 1701 is removed by the cleaning apparatus 1706. Then the residual potential on the surface of the photosensitive drum 1701 is removed by a charge removing lamp (not shown), for the preparation of the next copying. The transfer paper P on which the toner image has been transferred passes through a fixing apparatus (not shown) and ejected outside the machine. The transfer apparatus can use various methods, such as a method using an electrostatic roller, a method by corona discharge, an adhesive transfer method, or a heat transfer method. As the fixing apparatus, there can be used for example a heat transfer method, solvent fixation, UV fixation or pressure fixation.

The liquid developer 1707 used in the copying machine in this embodiment is not a low-viscosity (about 1 cSt) and low-density (about 1%) liquid developer using Isopar (trademark of Exxon), which is available in the market and generally used conventionally, as a carrier, but a high-viscosity and high-density liquid developer. As the range of the viscosity and density of the developer, for example, a liquid developer having a viscosity of from 50 cSt to 5000 cSt, and density of from 5% to 40% is used. As the carrier liquid 1819, one having high conductivity such as silicone oil, normal paraffin, IsoparM (trademark of Exxon), vegetable oil, or mineral oil is used. The volatility or nonvolatility can be selected according to the purpose. The particle diameter of the toner can be selected from submicron to 6 $\mu$m, according to the purpose.

The development apparatus, which is the characteristic part in the seventh embodiment, will now be explained. The development apparatus 1704 is mainly composed of a developer storing tank 1708 which stores the developer therein, a developing roller 1709 as a developer support, a before-development set roller 1710 as a before-development toner compression member, a sweep roller 1711, an anilox roller 1712 as an application unit, a gear pump (not shown), and a stirring roller 1713, as shown in the figure. The developing roller 1709, the before-development set roller 1710, the sweep roller 1711 are respectively provided with a cleaning member 1714*a*, 1714*c* and 1714*b* comprising a metal blade or a rubber blade. Each of the cleaning members 1714*a*, 1714*c* and 1714*b* is not limited to a blade, and may be a roller type. The anilox roller 1712 is provided with a doctor blade 1715. The cleaning member 1714*c* of the before-development set roller 1710 may be provided or not provided.

Either of the developing roller 1709 and the before-development set roller 1710, or both of these rollers, and the sweep roller 1711 are provided with an elastic layer having conductivity on the outer periphery thereof. Urethane rubber can be used as the material of these elastic layers. For the rubber hardness of the layer of each elastic body, it is desired to be not higher than 50 degrees as measured by JIS-A hardness. The material of the layer of each elastic body is not limited to the urethane rubber, and may be any material which has conductivity, and does not swell or dissolve in the carrier liquid or the developer. If the surface of either of the developing roller 1709 and the before-development set roller 1710, or both of these rollers, and the surface of the sweep roller 1711 have conductivity, and the material does not swell or dissolve in the carrier liquid or the developer, and the carrier liquid or the developer cannot come in contact with the inner layer thereof, then, the material of the layer of each elastic body, being the inner layer, does not have any restriction in the conductivity and swelling and dissolving, and needs only have elasticity. At this time, the voltage applied on the developing roller 1709, the before-development set roller 1710 and the sweep roller 1711 must be applied from the surface, not from each axis of the developing roller 1709, the before-development set roller 1710 and the sweep roller 1711. When a before-development set roller 1710 having an insulation surface is used, a charging mechanism is provided which charges the surface of the before-development set roller 1710.

The construction may be such that the elastic layer is not provided in the developing roller 1708 and the sweep roller 1711, but is provided on the photosensitive body side. Also, the photosensitive body may be formed by an endless belt-like member. The developing roller 1709 and the sweep roller 1711 are constructed such that the surface thereof has a smoothness of at least Rz 10 $\mu$m, and preferably not higher than Rz 3 $\mu$m, by means of a coating or a tube.

In FIG. 17, the developing roller 1709 does not come in contact with the photosensitive drum 1701, but at the time of development operation, the development apparatus (unit) is moved so that the developing roller 1709 comes in contact with the photosensitive drum 1701. At the time of other than the development operation, separation of the developing roller 1709 from the photosensitive drum 1701 prevents permanent deformation, when the developing roller and the photosensitive body are elastic bodies.

When the developing roller 1709 and the sweep roller 1711 are abutted against the photosensitive drum 1701 with appropriate pressure, the elastic layer of each roller elastically deforms, to thereby form a developing nip (not shown) and a removal nip 1716. Particularly, by forming the developing nip, a certain developing time for the toner in the liquid developer 1707 to move towards the photosensitive drum 1701 due to a developing electric field in the developing area, and adhere thereon can be ensured. By adjusting the abutment pressure, the nip width, being the size in the moving direction on the surface in each nip section, can be adjusted. Each nip width is set to be at least a product of the linear velocity of each roller and the developing time constant. The developing time constant is a time required for the developed amount to saturate, and obtained by dividing the nip width by the process velocity. For example, if the nip width is 3 mm, and the process velocity is 300 mm/sec, the developing time constant becomes 10 msec.

As with the relationship of the photosensitive drum with respect to the developing roller, the same thing applies to the relationship of the before-development set roller 1710 with respect to the developing roller 1709. When the before-development set roller 1710 is abutted against the developing roller 1709 with an appropriate pressure, the elastic layer of both or one of the rollers elastically deforms, to thereby form a nip 1717. By forming the nip, a time for the toner in the developer to move towards the developing roller 1709 due to an electric field between the developing roller 1709 and the before-development set roller 1710 can be ensured. By adjusting the abutment pressure, the nip width, being the size in the moving direction on the surface in each nip section, can be adjusted. Each nip width is set to be at least a product of the linear velocity of each roller and the developing time constant. The developing time constant is a time required for the moving amount of the toner to saturate, and obtained by dividing the nip width by the process velocity. For example, if the nip width is 3 mm, and the process velocity is 300 mm/sec, the developing time constant becomes 10 msec.

Figure 18:
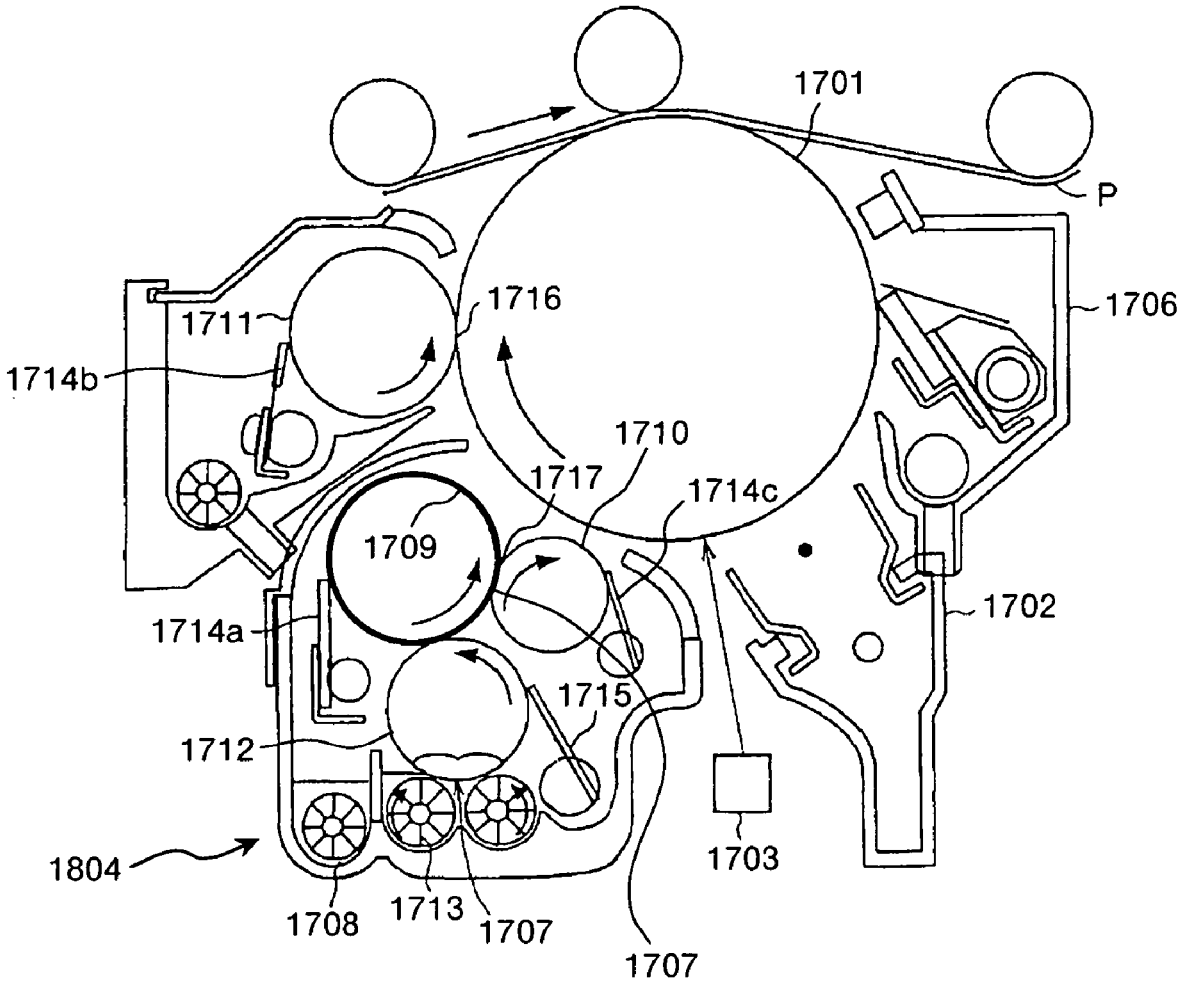
FIG. 18 is a schematic configuration diagram of the main part of another copying machine according to the seventh and eighth embodiments of the present invention.

The before-development set roller 1710 may face the developing roller 1709 with a certain gap. The gap is desirably such that the space is filled with the developer, but may have a space between the developer layer on the surface of the developing roller 1709 and the before-development set roller 1710. If the gap is filled with the liquid developer 1707, the toner moves towards the developing roller 1709 due to the potential difference between the both rollers. FIG. 18 shows a copying machine having development apparatus 1804 in which the before-development set roller 1710 faces the developing roller 1709 with a gap.

When there is a space between the developer layer on the surface of the developing roller and the before-development set roller, the before-development set roller 1710 is applied with a voltage higher than the voltage for having the above potential difference, so that electricity is discharged from the before-development set roller 1710 to the developer on the developing roller. Thereby, the toner is compressed, and a carrier layer is formed on the surface layer. At this time, the voltage for the discharge may have either polarity.

At the time of development operation, a thin layer of the developer is formed on the developing roller 1709 by the anilox roller 1712. Since the anilox roller 1712 and the developing roller 1709 are maintained to have substantially the same potential, movement of the toner does not occur in the developer between the both rollers, and the developer on the anilox roller 1712 is applied onto the developing roller 1709 substantially with the same density. At this time, the thickness of the liquid developer 1707 applied onto the developing roller 1709 is set such that the pigment content in the toner supported on the surface per 1 $cm^2$ becomes at least 3 $\mu$g, and not higher than 60 $\mu$g. Therefore, the thin layer of the liquid developer 1707 is applied in the thickness of from 3 to 10 $\mu$m. This is because if the application thickness of the liquid developer 1707 is such that the pigment content in the toner supported on the surface of the developing roller 1709 per 1 $cm^2$ becomes smaller than 3 $\mu$g, pigment in a sufficient amount does not move to the image section 1820 of the latent image formed on the photosensitive drum 1, and hence there is the possibility that the image density of the image section 1820 becomes weak. Further, if the application thickness of the liquid developer 1707 is such that the pigment content in the toner supported on the surface of the developing roller 1709 per 1 $cm^2$ becomes higher than 60 $\mu$g, the residual toner remaining on the ground section after development increases, and there is the possibility that removal of the fog toner is insufficient even with the before-development set roller 1710 or with the sweep roller 1711.

The thin layer of the developer formed on the surface of the developing roller passes through a nip 1717 formed by the developing roller 1709 and the before-development set roller 1710. FIG. 19 is a schematic diagram which shows the condition of the liquid developer at the nip. The liquid developer 1707 on the developing roller 1709 is applied, as described above, without density distribution by the anilox roller 1712. Since voltage is applied separately to the before-development set roller 1710 and the developing roller 1709 to provide a potential difference between both rollers, when passing through the nip between the before-development set roller 1710 and the developing roller 1709, the toner 1818 moves towards the developing roller 1709, and hence the developer on the developing roller has a density gradient on the developing roller.

Figure 19A:
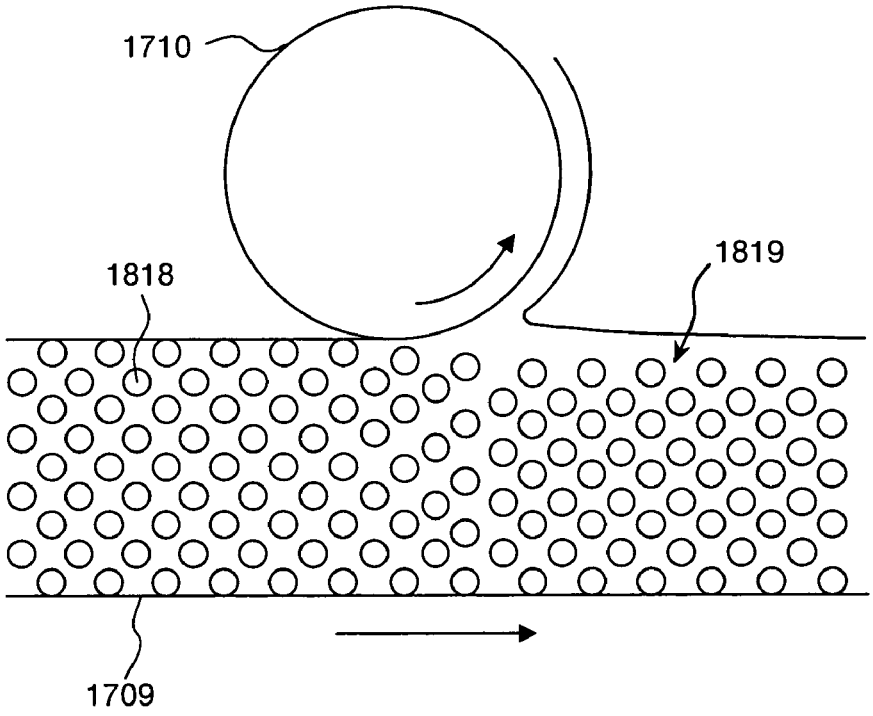
FIG. 19A and FIG. 19B are schematic diagrams which show the condition of a developer in a nip section between a developing roller and a before-development set roller.

At this time, as shown in FIG. 19A, for example, the toner 1818 has the positive polarity, and when the application voltage to the developing roller 1709 is +300V, by setting the application voltage to the before-development set roller 1710, to +400V to +500V, to thereby provide a slight potential difference, the toner 1818 is not sufficiently compressed, and moves substantially without adhering to the before-development set roller 1710. Only the carrier adheres to the before-development set roller 1710, and the before-development set roller 1710 is rotated to remove the adhered carrier by the cleaning member 1714*c*. Thereby, the carrier liquid 1819 contained in the liquid developer 1070 on the developing roller 1709 is reduced, to thereby reduce the amount of carrier adhering to the photosensitive drum 1701.

Figure 19B:
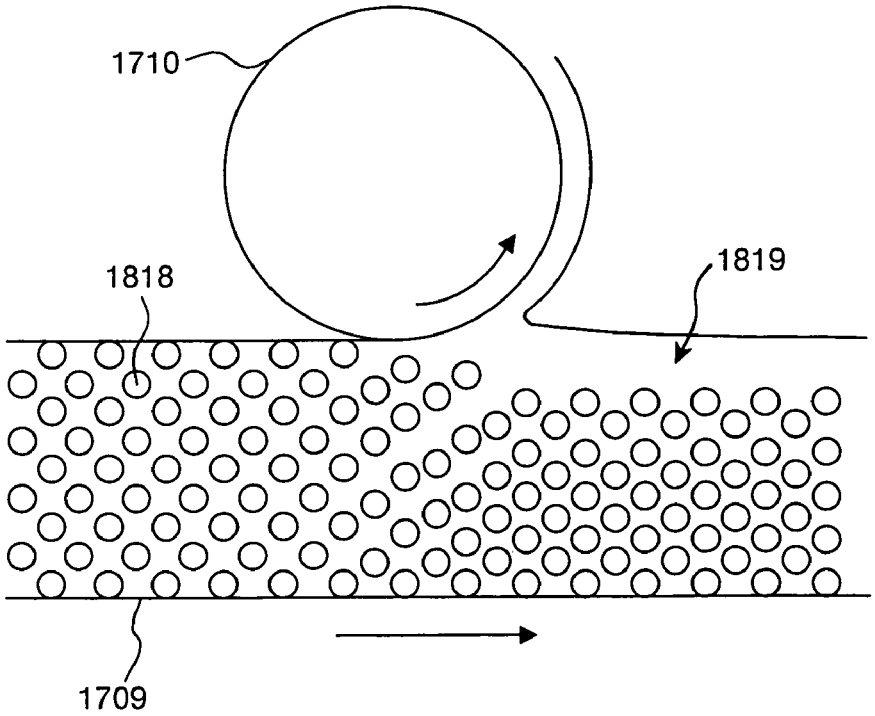

As shown in FIG. 19B, for example, the toner 1818 has the positive polarity, and when the application voltage to the developing roller 1709 is +300V, by setting the application voltage to the before-development set roller 1710 to +600V to +700V, to thereby provide a large potential difference, the toner 1818 is sufficiently compressed, and moves without adhering to the before-development set roller 1710. Only the carrier adheres to the before-development set roller 1710, and the before-development set roller 1710 is rotated to remove the adhered carrier by the cleaning member 1714*c*. Thereby, the carrier liquid 1819 contained in the liquid developer 1070 on the developing roller 1709 is reduced, to thereby reduce the amount of carrier adhering to the photosensitive drum 1701. Further, the toner 1818 on the developing roller 1709 is sufficiently compressed, to thereby assist the toner movement in the developing section, which faces the next photosensitive drum 1701.

At this time, if the carrier liquid 1819 adhered to the before-development set roller 1710 after coming into contact with the developing roller 1709 is removed, the carrier liquid 1819 adhering to the photosensitive drum 1701 decreases, and carrier shortage may occur in the subsequent process such as transfer. In such a instance, the cleaning member 1714*c* on the before-development set roller 1710 is not installed, and the carrier adhered to the before-development set roller 1710 is supplied to the nip section 1717 between the developing roller 1709 and the before-development set roller 1710. Therefore, the amount of carrier on the developing roller 1709 and on the photosensitive drum 1701 does not change, and hence does not affect the subsequent process such as transfer.

The thin layer of the liquid developer 1707 formed on the surface of the developing roller 1709 passes through the developing nip formed by the photosensitive drum 1701 and the developing roller 1709.

Generally, in an electrophotographic development apparatus, the surface traveling speed of the developing roller is set faster than that of the photosensitive body, in order to feed sufficient toner to the area where the photosensitive body and the development apparatus face each other. Therefore, the toner has a fast traveling speed with respect to the surface of the photosensitive body, to thereby cause a misregistration with the latent image. As a result, in the image, there appears a phenomenon such that the point is blurred, or the balance between the longitudinal line and the horizontal line is deteriorated. This phenomenon is seen also in the liquid development. With the copying machine according to this embodiment, the surface of the developing roller 1709 and the surface of the photosensitive drum 1701 moves substantially at the same speed, so that the velocity vector in the tangential direction of the photosensitive drum 1701 is not relatively given to the toner 1818, and hence the above phenomenon does not occur.

A development bias voltage (for example +300V), which is lower than the surface potential of the photosensitive body (for example +600V), is applied to the developing roller 1709, and a developing electric field is generated between the developing roller 1709 and the image section 1820 which has been exposed by the exposure apparatus 1703 and the potential thereof becomes +50V or less.

Figure 20:
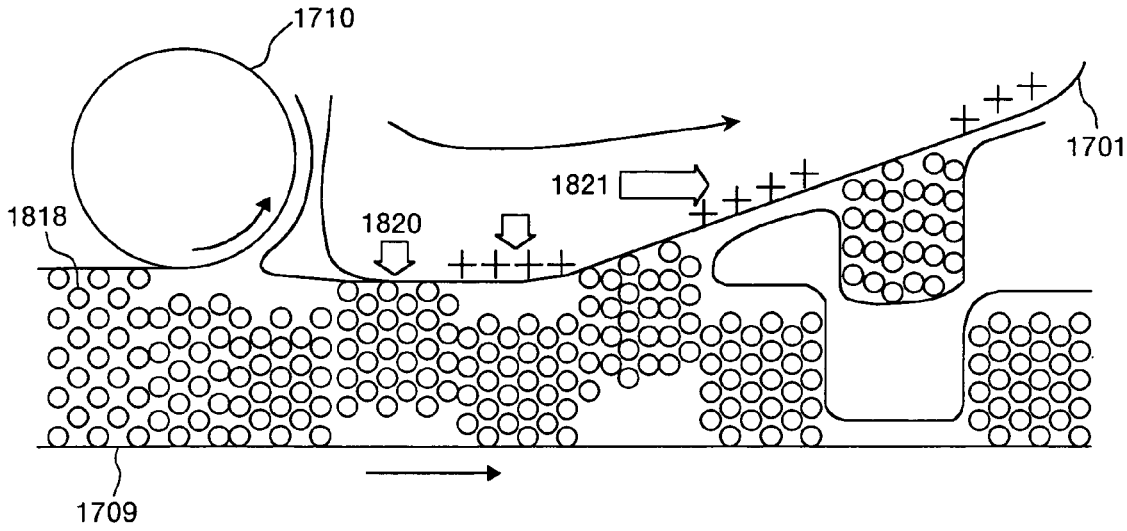
FIG. 20 is a schematic diagrams which shows a toner moving to a photosensitive drum, due to a developing bias potential and the potential of the photosensitive body.

When the toner 1818 is positively charged, in the image section 1820 of the photosensitive drum 1701, as shown in FIG. 20, the toner 1818 in the developer moves towards the photosensitive drum 1701 due to the electric field to thereby manifest the latent image. On the other hand, in the ground section (background section) 1821, the toner 1818 is made to move to the surface of the developing roller 1709 due to an electric field formed by the development bias potential and the potential of the photosensitive body, so that the toner does not adhere to the ground section.

Figure 21:
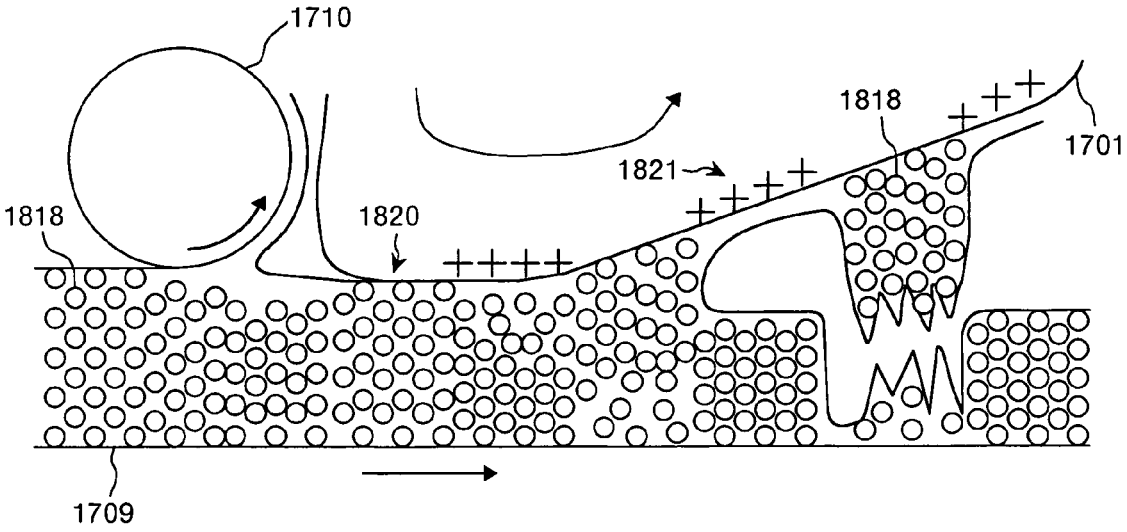
FIG. 21 is a schematic diagram which shows a toner moving to a photosensitive drum when the time and electric field for developing is short.

At this time, if the time for development or the electric field is not sufficient, the toner 1818 is not sufficiently compressed in the development section. As shown in FIG. 21, when the developing roller 1709 is separated from the photosensitive drum 1701, the toner layer is separated. If the toner layer is separated, the toner 1818 on the photosensitive drum 1701 is localized in a stripe shape (referred to as a rib), and uniform development cannot be carried out. If the time for development or the electric field is sufficient, the toner 1818 is sufficiently compressed, and divided into the carrier layer and the toner layer relatively clearly, and when the developing roller 1709 is separated from the photosensitive drum 1701, these are separated by the carrier layer. At this time, the toner 1818 does not move, and uniform development can be carried out.

The liquid developer 1707 on the developing roller 1709 is such that the toner 1818 is compressed towards the developing roller 1709 by the before-development set roller 1710, and the carrier layer is formed on the surface layer. In the image section 1820, an electric field is formed so that the toner 1818 moves towards the photosensitive drum 1701, and the toner 1818 moves in the carrier layer. In the background section 1821, an electric field is formed so that the toner 1818 moves towards the developing roller 1709, and the carrier layer first comes in contact with the photosensitive drum 1701. Hence, the toner 1818 is unlikely to adhere on the photosensitive drum 1701, as compared with when the developer layer having uniform density comes in contact with the photosensitive drum 1701.

The before-development set roller 1710 compresses the toner layer before development, and at the time of development, the toner 1818 moves as a layer, and hence there is the effect that development is promoted beforehand so that the formation of ribs can be prevented, as compared with when the before-development set roller 1710 is not used.

Since the fog toner is unlikely to adhere on the photosensitive body by means of the before-development set roller 1710, a fog removal electric field (a potential difference between the development bias applied to the developing roller and the charging potential of the photosensitive body) can be suppressed low. Therefore, it becomes possible to reduce the charging potential of the photosensitive drum 1701. As a result, there are various advantages such as improvement of durability of the photosensitive drum 1701, reduction of load on the charging roller (not shown) and reduction of exposure power.

A sweep roller 1711 may be provided for the instance when the toner 1818 adheres to the ground section of the photosensitive drum 1701, and for further reducing the carrier liquid 1719 adhered on the photosensitive drum 1701. In the development apparatus 1704 of the copying machine according to this embodiment shown in FIG. 17, the sweep roller 1711 is provided for sweeping (cleaning) the toner which causes fogging (hereinafter referred to as "fog toner"). This sweep roller 1711 is installed on the downstream side of the developing roller 1709 in the rotation direction of the photosensitive drum 1701, so as to put the developed toner layer between the photosensitive drum 1701 and the sweep roller 1711, and is pressed against the photosensitive drum 1701. The surface of the sweep roller 1711 moves substantially at the same speed as the surface of the photosensitive drum 1701. When the before-development set roller 1710 functions sufficiently, transfer of the carrier liquid 1819 to the photosensitive drum 1701 can be reduced sufficiently, without using this sweep roller 1711, and the fog toner is prevented from adhering onto the photosensitive drum 1701.

A bias voltage (+250V), which is close to the surface potential of the toner layer (+50 to +200V) in the image section on the photosensitive drum 1701, is applied to the sweep roller 1711, so that the toner 1818 does not return to the sweep roller 1711 from the toner layer in the image section 1820 after development. In the ground section 1821, the floating fog toner is shifted to the sweep roller 1711 due to an electric field caused by a difference between the potential of the ground section of the photosensitive drum 1701 and the potential by the bias voltage. The developer layer in the ground section 1821 in this stage is about half the thickness of the developing nip section of the developing roller 1709, and the density of the toner is reduced to about 50% or less of the density before development. Hence, removal of the fog toner can be easily performed. As a result, fogging in the ground section 1821 can be completely prevented.

By installing the sweep roller 1711, about 70% of the excessive carrier liquid 1819 adhered to the ground section 1821 on the photosensitive drum 1701 at the time of development can be removed.

In the image formation method explained in the related art, it is possible to perform development and removal of fog toner in the ground section at the same time by the developer support. However, it is necessary to ensure relatively long developing time (for example, about 40 msec), and the width of the developing nip formed between the latent image support and the developer support needs to be large. With this conventional image formation method, since the nip section is formed by abutting the developer support having an elastic layer against the latent image support, it is necessary to select an elastic layer having low hardness in order to increase the width of the developing nip, and hence the abutment pressure tends to increase.

On the other hand, with the development apparatus 1704 of the copying machine according to this embodiment, since the before-development set roller 1710 is provided, it becomes possible to compress the toner 1818 beforehand on the developing roller 1709 before development, thereby the time required for movement of the toner 1818 at the time of development can be reduced. The width of the developing nip can be also reduced as compared with the conventional one, and hence the abutment pressure can be also reduced (for example, 0.3 kgf/mm or less). As a result, the load onto the photosensitive drum 1, the developing roller 1709 and the sweep roller 1711 can be reduced, and the durability can be improved.

In the seventh embodiment, an example for forming an image by inverse development has been explained as one embodiment, but an image can be also formed by regular development.

As one example of a specific potential, in an instance of negatively charged toner, the potential of the photosensitive body is set to +600V, the application voltage to the developing roller 9 is set to +300V, the application voltage to the before-development set roller 10 is set to +100V, and the potential in the background section is set to +50V.

[Eighth Embodiment]

An example applied to an electrophotographic copying machine (hereinafter referred to as copying machine), being a liquid development image formation apparatus, of the present invention in the eighth embodiment will be explained.

As shown in FIG. 17, the developing roller 1709 abuts against the before-development set roller 1710 with an appropriate pressure. At this time, when the before-development set roller 1710 and the developing roller 1709 have low conductivity, movement of the toner 1818, that is, compression of the toner 1818 can be carried out more efficiently. When the roller conductivity is low, the area coated with the liquid developer 1707 is insulated by the liquid developer 1707, but in the area where the liquid developer 1707 is not applied, the potential difference between the before-development set roller 1710 and the developing roller 1709 cannot be maintained. If the potential difference is low, compression of the toner 1818 cannot be carried out efficiently. Therefore, it is necessary to insulate between the before-development set roller 1710 where the liquid developer 1707 is not applied and the developing roller 1709.

As a method for this, there is a method for putting an insulation member which does not harm those rollers between the before-development set roller 1710 and the developing roller 1709. Since the both rollers had better be pressed for forming the nip, the thinner the conductive member, the better.

There is also a method for insulating the portion where the liquid developer 1707 is not applied. With this method, the construction of the roller becomes complicated, and may be slightly expensive. However, this method is excellent functionally. Because, if an insulation member is put between the rollers, the liquid developer 1707 is scraped by the insulation member, and there is the possibility that the scraped liquid developer may go around to unnecessary portion.

The construction may be such that either of those rollers is made shorter than the application width of the developer. This construction is best in diagram of the cost, since it is not necessary to provide a special insulation member. However, the liquid developer 1707 may be accumulated at the end of the shortest roller, and processing for that may become necessary.

There is another method for providing a potential difference from the potential of the developing roller 1709, by charging as at least the surface of the before-development set roller 1710 is insulated. With this method, the surface potential of the before-development set roller changes in the portion where the liquid developer 1707 is not applied, but the toner 1818 can be compressed without affecting the portion where the liquid developer 1707 is applied. It is necessary that the electric charge moves via the conductive portion of the roller for the movement of the toner 1818. Hence, it is desired that the before-development set roller 1710 has a conductive inner layer, and an insulation layer as thin as possible is provided on the surface thereof. There can be mentioned one in which an insulation resin tube is coated on the surface of a conductive rubber roller, and one in which an insulation layer is coated on the surface of a metal roller.

For the before-development set roller 1710 having the insulation property on the surface thereof, a photosensitive body may be used. It is not necessary to form a latent image thereon, and the front face thereof is charged to a required potential at anytime, to thereby provide a potential difference between the developing roller 1709 and the photosensitive body. More uniform charging can be carried out, and the toner 1818 can be compressed efficiently.

Figure 22:
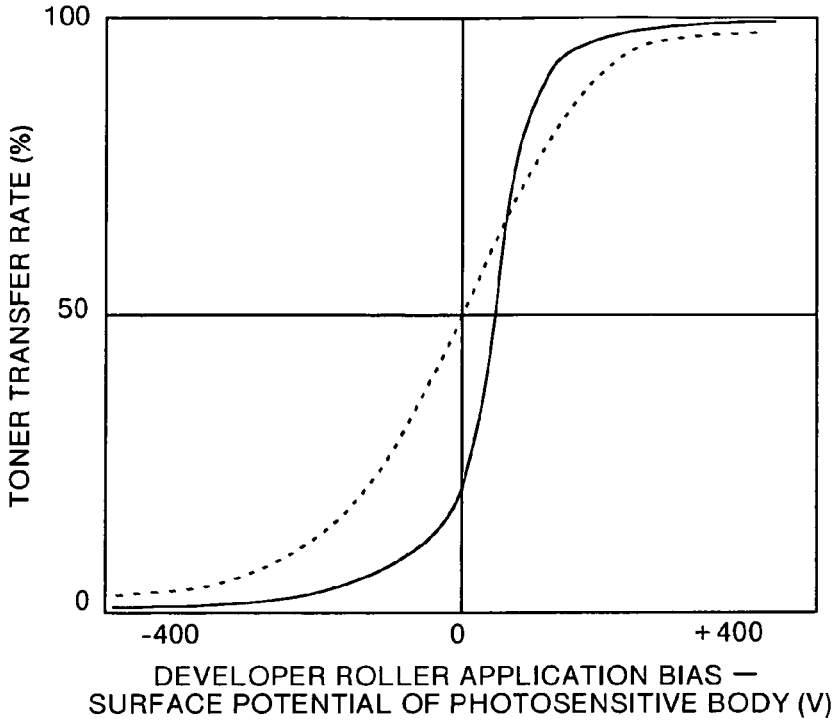
FIG. 22 is a graph which shows a toner transfer rate from a developing roller to a photosensitive body.

FIG. 22 shows a toner transfer rate from the developing roller 1709 to the photosensitive body, for the instance when before-development setting is performed and when before-development setting is not performed. In FIG. 22, the toner transfer rate (%) is plotted on the Y axis, and a potential difference between the bias applied to the developing roller and the photosensitive drum is plotted on the X axis. A solid line shows the situation when the before-development set roller 1710 carries out setting before development (toner compression), and a dotted line shows the situation when setting before development is not carried out. When setting before development is carried out, development can be performed with a smaller potential difference. The before-development set roller 1710 compresses the toner layer before development. Hence, at the time of development, the toner 1818 moves as a layer, thereby there is the effect that development is promoted beforehand so that the formation of ribs can be prevented, as compared with when the before-development set roller 1710 is not used.

Figure 23:
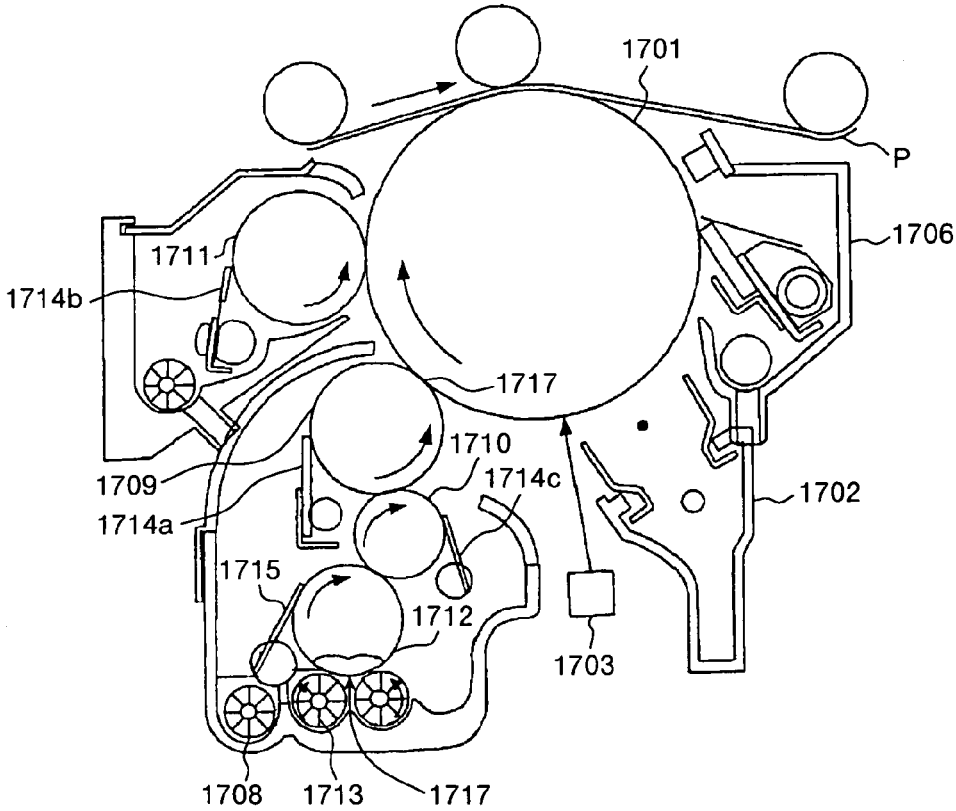
FIG. 23 is a schematic configuration diagram of the main part of another copying machine according to the seventh and eighth embodiments of the present invention.

FIG. 23 is a diagram which shows the configuration of another copying machine to which the eighth embodiment of the present invention can be applied. FIG. 23 shows an example brought into contact with the anilox roller 1712 to the before-development set roller 1710. In this instance, the rotation direction of the anilox roller 1712 is opposite to that of the example shown in FIG. 17, and the doctor blade 1715 is arranged at a position in a forward direction with respect to the rotation direction of the anilox roller 1712, that is, in FIG. 23, on the left side of the anilox roller 1712.

The liquid developer used in the seventh embodiment described above is a high-viscosity and high-density liquid developer in which a toner is dispersed in the carrier liquid at a toner solid fraction of from 5 to 30%. In the seventh embodiment, the application member may serve also as a toner compression member, or a toner compression member may be provided between the application member and the developer support. When a gap is not provided between the before-development set roller 1710 referred to in the seventh embodiment and the developing roller 1709, or these are abutted against each other with a nip, the developer is interposed between these members.

[Ninth Embodiment]

Figure 24:
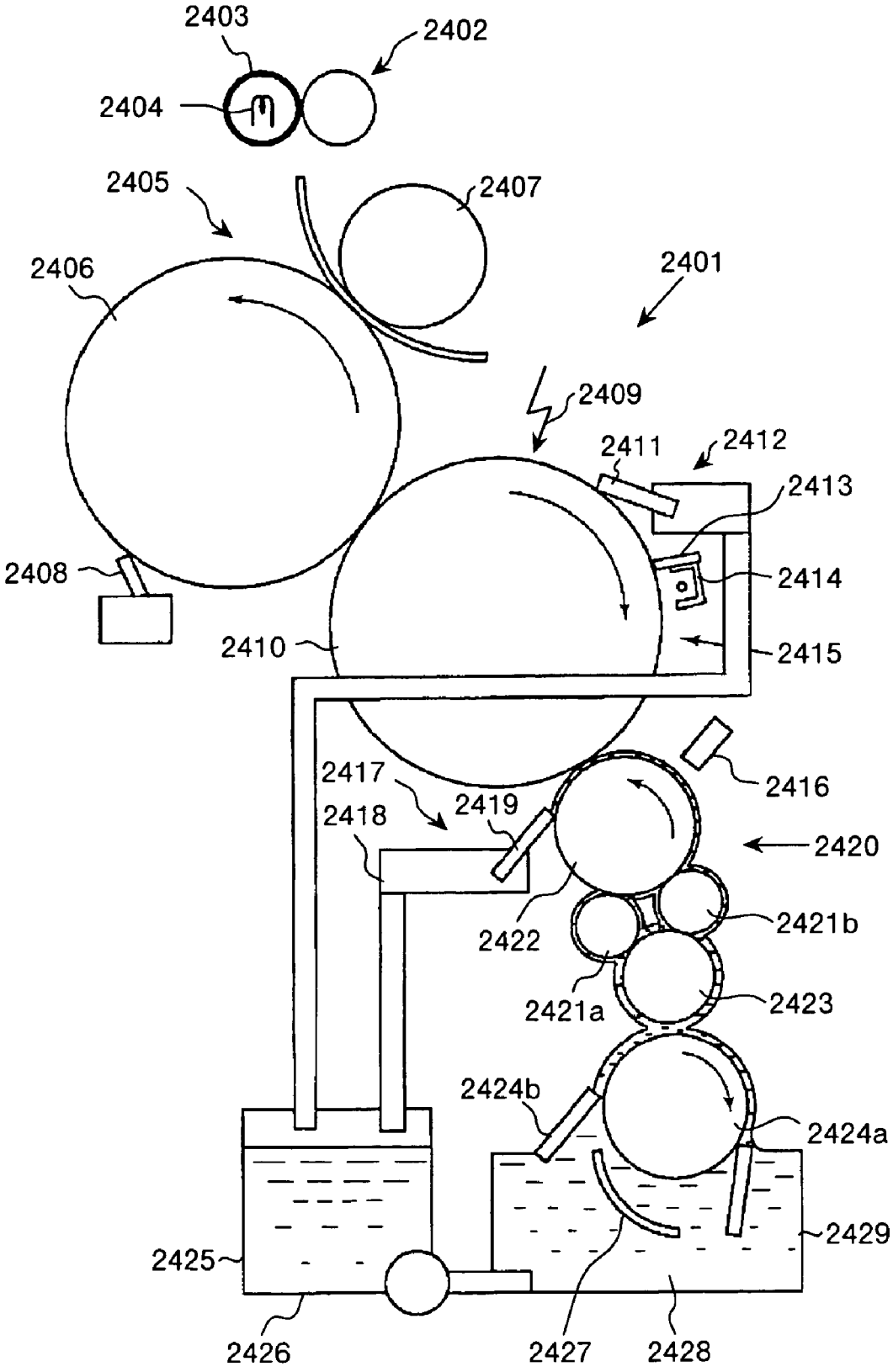
FIG. 24 is a schematic configuration diagram of image formation apparatus adopting a ninth embodiment of the present invention.

The image formation apparatus shown in the first embodiment of the present invention uses a so-called regular development, wherein an image support is charged with an electric charge of a polarity opposite to that of the toner, light is then shone thereon to expose a reversed image, and an electrostatic latent image to be visualized is formed in the portion where the light is not shone, that is, the portion which is not made conductive. An image formation apparatus 2401 in the ninth embodiment comprises, as shown in FIG. 24, a photosensitive drum 2410 which is an image support, charging apparatus 2414 which charges the photosensitive drum 2410, exposure apparatus 2415 which exposes an image on the photosensitive drum 2410, development apparatus 2420 as liquid development apparatus which manifests an electrostatic latent image by feeding a toner to a portion where the electrostatic latent image is formed on the photosensitive drum 2410, transfer apparatus 2405 which transfers a toner image formed on the photosensitive drum 2410 to a predetermined paper, cleaning apparatus 2412 which removes the toner remaining on the photosensitive drum 2410, charge removing apparatus 2409 which removes the charged photosensitive drum 2410 and fixing apparatus 2402 which fixes the toner image transferred to the paper. The charging apparatus 2414 is attached with a shading plate 2413 on the side where the charge removing apparatus 2409 is installed, in order to prevent an influence by the charge removing apparatus 2409.

In the above construction, the photosensitive drum 2410, the charging apparatus 2414, the exposure apparatus 2415, the charge removing apparatus 2409 and the fixing apparatus 2402 have the known constructions similar to those in the conventional image formation apparatus, and hence explanation for each of these apparatus is omitted. The main part in the ninth embodiment, that is, the development apparatus 2420, the transfer apparatus 2405 and the cleaning apparatus 2412 will be explained below.

Figure 25:
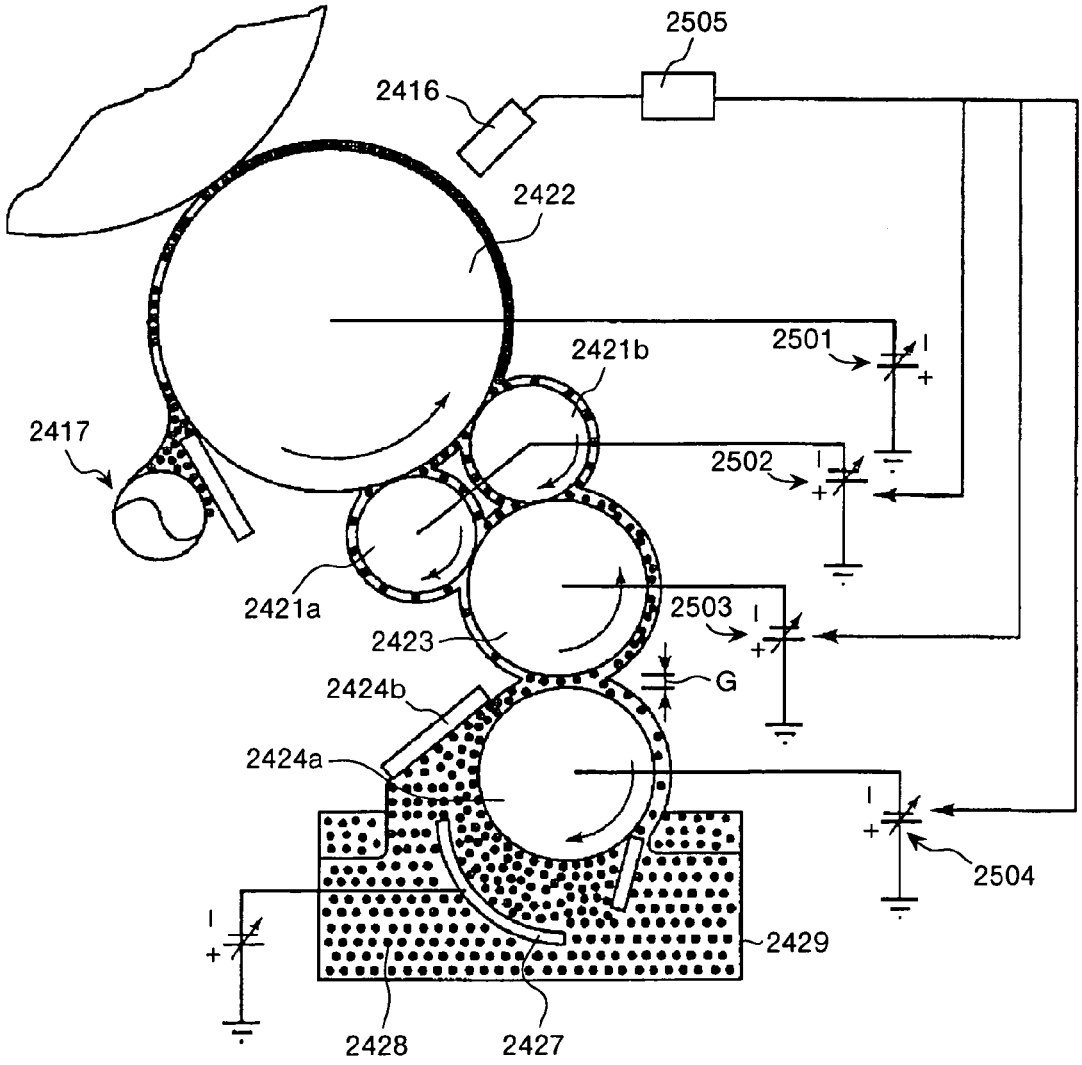
FIG. 25 is a schematic configuration diagram of liquid development apparatus used in the ninth embodiment.

The development apparatus 2420 comprises, as shown in FIG. 24 and FIG. 25, a developing roller 2422 which is a developer support, application rollers 2421*a* and 2421*b* which apply a liquid developer 2428 described later on the surface of the developing roller 2422, a tank 2429 as a developer tank which stores the liquid developer 2428, a feed roller 2424*a* which draws up the liquid developer 2428 stored in the tank 2429, a carrier roller 2423 which carries the liquid developer 2428 drawn up by the feed roller 2424*a* towards the application rollers 2421*a* and 2421*b*, a back plate 2427 as a conductive plate formed by a conductive member, a power unit 2504 as a voltage application unit which applies voltage to the feed roller 2424*a*, a power unit 2503 as a voltage application unit which applies voltage to the carrier roller 2423, a power unit 2502 as a voltage application unit which applies voltage to the application rollers 2421*a* and 2421*b*, developer density measuring apparatus 2416 which measures the developer density in the liquid developer 2428 on the developing roller 2422, a control unit 2505 which controls the power units 2503, 2504 and 2502 based on the results of the developer density measuring apparatus 2416, and developer recovery apparatus 2417 which recovers the liquid developer 2428 remaining on the developing roller 2422 after development.

The developing roller 2422 is arranged so as to abut against the photosensitive drum 2410, and rotates in the direction opposite to that of the photosensitive drum 2410, to thereby feed the liquid developer 2428 applied by the application rollers 2421*a* and 2421*b* to the latent image face on the photosensitive drum 2410. The developing roller 2422 has a cored bar formed by a rigid body such as stainless steel, an elastic layer formed around the cored bar, and a surface layer formed on the surface of the elastic layer. Therefore, by adjusting the pressing force of the developing roller 2422 to the photosensitive drum 2410, the liquid developer layer formed on the developing roller 2422 can be separated to the carrier layer and the toner layer, to thereby bring the developing roller 2422 into contact with the photosensitive drum 2410, while keeping this two-layer condition. The hardness of the developing roller 2422 is desirably from 5 to 60 degrees inclusive as measured by JIS-A. If the hardness is lower than JIS-A 5 degrees, the developing roller 2422 is too soft, and it becomes difficult for the developing roller 2422 to keep a constant shape. On the other hand, if the hardness is higher than JIS-A 60 degrees, the developing roller 2422 is too hard. Hence, in order to bring the developing roller 2422 into contact with the photosensitive drum 2410, while the liquid developer layer on the developing roller 2422 keeps the two-layer condition of the carrier layer and the toner layer, it is necessary to set the developing roller 2422 such that a gap is formed between the developing roller 2422 and the photosensitive drum 2410.

As a member which forms an elastic layer of the developing roller 2422, there can be mentioned a foamed body of polystyrene, polyethylene, polyurethane, polyvinyl chloride or NBR (nitrile butylenes rubber), and a low-hardness rubber member or foamed body such as silicone rubber or urethane rubber. Further, an elastic layer is formed around the cored bar, and another elastic layer may be formed on the surface thereof by a rubber member or a foamed body. The surface layer of the developing roller 2422 is formed by an elastic member which does not swell in a silicone oil which is a carrier liquid of the liquid developer 2428. The electrical resistance of the elastic member is preferably about $10^3$ Ωcm, so that an electrical developing bias can be applied to the developing roller 2422 by a power unit denoted by reference symbol 2501 in FIG. 25.

As a method of forming the elastic layer, there can be mentioned a method for forming a synthetic rubber combination having conductive particles such as carbon black dispersed in the elastic layer, and a method for forming a surface layer by a resistor of at least $10^8$ Ωcm, and for covering with a heat shrinkable tube thereon, and for applying heat thereto to thereby effect heat shrinkage. As a surface layer, one having a thickness of from 5 to 20 μm is used, but the thickness of the surface layer and the electrical resistance needs only to be a value at which an electrical leakage does not occur. The surface layer may have a conductive elastic layer therein by injecting an elastic material into a tube, being a resistor, or foaming the injected elastic material. As a tube constituting the surface layer, there can be used a resin tube such as polyimide, polycarbonate or nylon, and a metal tube such as nickel. As the heat shrinkable tube, there can be used a resin tube such as PFA (tetrafluoroethyleneperfluoroalkylvinylether copolymer resin), PTFE (tetrafluoroethylene resin). These tubes are desirably a so-called endless tube without a seam. The developing bias voltage should be set such that an electrostatic force (attractive force) acting between the toner and the developing roller 2422 is weaker than that acting between the toner and the part of the photosensitive drum 2410 where an electrostatic latent image is formed, and is stronger than that acting between the toner and the part of the photosensitive drum 2410 where the electrostatic latent image is not formed. In the ninth embodiment, a positively charged toner is used for the liquid developer, and the developing bias voltage is set to −150V.

Figure 26:
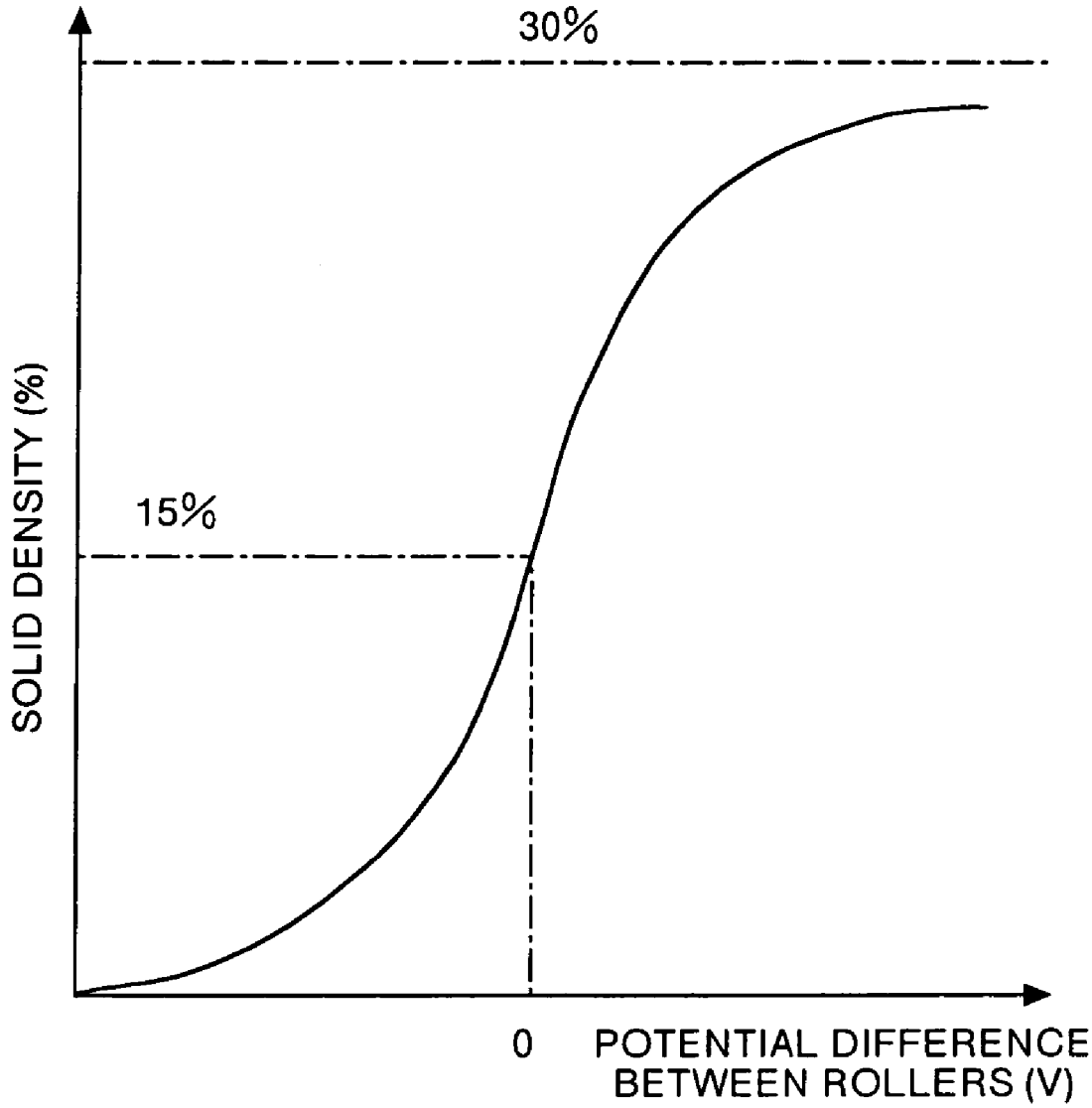
FIG. 26 is a graph which shows the relationship between the potential difference between rollers and the toner density in the ninth embodiment.

The feed roller 2424*a* is set so that a part thereof is soaked in the liquid developer 2428 in the tank 2429, and it draws up the liquid developer 2428 stored in the tank 2429 by rotating in the direction opposite to the rotation direction of the carrier roller 2423, and feeds the liquid developer 2428 to the carrier roller 2423. The power unit 2504 applies a predetermined bias voltage to the feed roller 2424*a* based on a signal from the control unit 2505. The back plate 2427 is provided in the tank 2429 so as to cover a part of the feed roller 2424*a*, such that it becomes equipotential with the feed roller 2424*a* or a potential difference occurs therebetween. Thereby, an electric field is generated between the feed roller 2424*a* and the back plate 2427. By the electrostatic force acting on the toner, as shown in FIG. 26, the carried amount of the toner particles in the liquid developer 2428 which is carried from the tank 2429 can be adjusted. In the vicinity of the feed roller 2424*a*, there is arranged a blade 2424*b* for restricting the liquid developer 2428 adhering on the feed roller 2424*a*.

Figure 27:
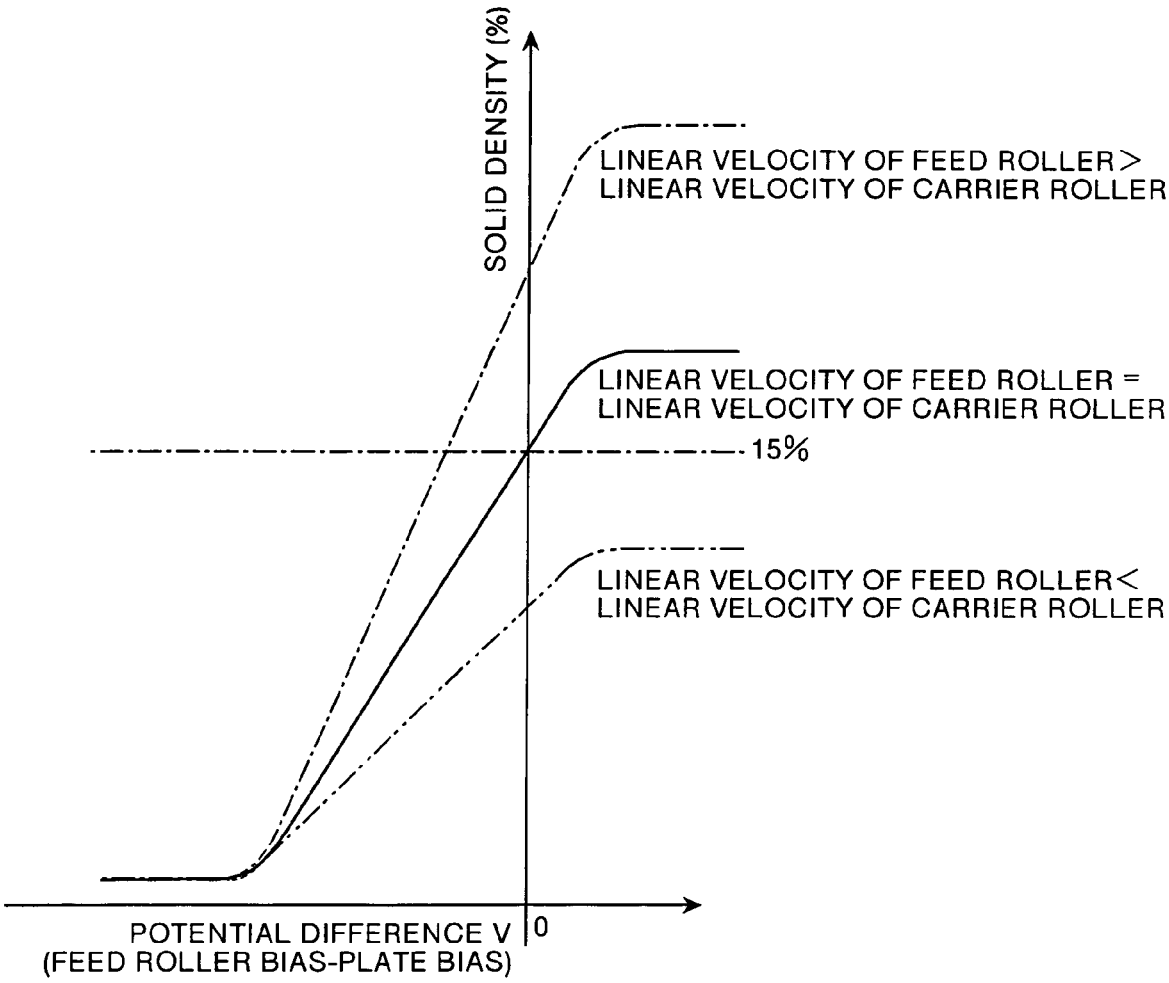
FIG. 27 is a graph which explains the relationship between the linear velocity of a feed roller and a carrier roller and the toner density in the ninth embodiment.

The carrier roller 2423 is arranged in the state such that it abuts against the feed roller 2424*a* or there is a gap G between them. By rotating the carrier roller 2423 in the direction opposite to the rotation direction of the application rollers 2421*a* and 2421*b*, the liquid developer 2428 fed by the feed roller 2424*a* is carried to the application rollers 2421*a* and 2421*b*. The gap G is set to be not higher than the thickness of the developer layer adhering on the feed roller 2424*a*. The power unit 2503 applies a predetermined bias voltage to the carrier roller 2423 based on a signal from the control unit 2505. Thereby, an electric field is generated between the carrier roller 2423 and the feed roller 2424*a*, and the carried amount of the liquid developer 2428 from the feed roller 2424*a* to the carrier roller 2423 is adjusted, as shown in FIG. 26, by the electrostatic force acting on the toner. Further, not only the electric field between the carrier roller 2423 and the feed roller 2424*a*, but also, as shown in FIG. 27, the density of the developer can be controlled by controlling the number of revolution of the feed roller 2424*a*.

The application rollers 2421*a* and 2421*b* are provided so as to abut against the carrier roller 2423 and the developing roller 2422, respectively, and by respectively rotating in the direction opposite to the rotation direction of the developing roller 2422, the application rollers 2421*a* and 2421*b* apply the liquid developer 2428 carried by the carrier roller 2423 on the surface of the developing roller 2422. The power unit 2502 applies a predetermined bias voltage to the application rollers 2421*a* and 2421*b* based on a signal from the control unit 2505. Thereby, an electric field is generated between the application rollers 2421*a* and 2421*b* and the carrier roller 2423, so that the carried amount of the liquid developer 2428 from the carrier roller 2423 to the application rollers 2421*a* and 2421*b* is adjusted, as shown in FIG. 26, by the electrostatic force acting on the toner. Also, an electric field is generated between the application rollers 2421*a* and 2421*b* and the developing roller 2422, so that the density of the liquid developer 2428 to the developing roller 2422 is adjusted.

The reason why the feed roller 2424*a*, the carrier roller 2423 and the application rollers 2421*a* and 2421*b* are used for feeding the liquid developer 2428 to the developing roller 2422 is that, in the ninth embodiment, since a high-viscosity liquid developer 2428 in which the toner is dispersed therein in high density, is used as described below, it is necessary to apply a small amount of liquid developer 2428 on the developing roller 2422 thinly and uniformly. By applying the liquid developer on the developer support via a plurality of rollers, the thickness of the liquid developer on each roller is restricted to be thin and uniform by the abutment portion with the adjoining roller. Hence, the high-density high-viscosity liquid developer can be applied on the developer support thinly and uniformly. The reason why two application rollers 2421*a* and 2421*b* are used is that application nonuniformity (ruffle) which occurs due to the influence of the viscosity of the liquid developer 2428 and the dispersibility of the toner is made dense, to thereby form a uniform liquid developer layer on the developing roller. The number of application rollers is not limited to two, and may be one or three or more. That is, it is desired to determine the number of application rollers, according to the required accuracy such as nonuniformity in the image quality.

When a potential difference is not generated between the carrier roller 2423, the application rollers 2421*a* and 2421*b* and the developing roller 2422, and each roller is brought into contact with each other with the same potential, there is no restriction in the electrical resistance of each roller. However, when an electric field is generated between the carrier roller 2423, the application rollers 2421*a* and 2421*b* and the developing roller 2422, to control the carried amount of the toner particles, that is, the density of the developer, the following method is essential.

The carrier roller 2423 and the application rollers 2421*a* and 2421*b* must have high electrical resistance, and it is desired that the electrical resistance is from $10^8$ to $10^{13}$ Ωcm inclusive. If the electrical resistance is lower than $10^8$ Ωcm, when a bias voltage is applied, electricity is abruptly discharged to the adjoining roller, and hence adjustment of the pumping amount and the carried amount of the liquid developer 2428 cannot be performed sufficiently. In particular, since the application rollers 2421*a* and 2421*b* come in contact with the developing roller 2422, it is necessary to sufficiently increase the electrical resistance with respect to that of the developing roller 2422. On the other hand, if the electrical resistance is higher than $10^{13}$ Ωcm, when a bias voltage is applied, charging is not sufficient, and hence adjustment of the pumping amount and the carried amount of the liquid developer 2428 cannot be performed sufficiently.

When the developing roller 2422 is formed by a soft roller, it is desired to use a hard roller having a hardness of JIS-A 60 degrees or more as the application rollers 2421*a* and 2421*b*, and to use a soft roller having a hardness of lower than JIS-A 60 degrees as the carrier roller 2423. In this manner, by arranging the hard roller and the soft roller alternately so as to abut against each other, the soft roller elastically deforms by the pressing force to the hard roller, to thereby form a nip at the abutment portion with the hard roller. By this nip, the liquid developer layer on each roller can be made uniform. In order to elastically deform the soft roller, the harder is the hard roller, the better, and it is desired that the hardness of the hard roller is at least JIS-A 90 degrees. If the pressing force of the soft roller to the hard roller is strong, high torque is required for rotating each roller. Hence, it is desired that the soft roller elastically deforms with a weak pressing force, and the hardness thereof is not higher than JIS-A 40 degrees.

The developer density measuring apparatus 2416 is to measure the optical reflectance of the liquid developer 2428 applied on the developing roller 2422, and calculate the density of developer based on this optical reflectance. The control unit 2505 adjusts the voltage of the power unit 2503, 2504 and 2502 based on the density of developer calculated by the developer density measuring apparatus 2416, thereby supplies an adequate amount of the liquid developer 2428 to the developing roller 2422. The control of the voltage of the power unit 2503, 2504 and 2502 is desirably made manually. According to the experiments of the present inventors, it has been confirmed that there is a relationship as shown in FIG. 3 between the bias voltage applied to each roller and the coated amount of the liquid developer, when a positively charged toner is used for the liquid developer, and the developing bias voltage applied to the developing roller 2422 is set to −150V. Here, V1 denotes a bias voltage applied to the application rollers 2421*a* and 2421*b*, V2 denotes a bias voltage applied to the carrier roller 2423, V3 denotes a bias voltage applied to the feed roller 2424*a*, and Vp denotes the voltage of the back plate 2427.

TABLE 3

| | Bias voltage | Developer density |
|---|---|---|
| Application Roller | V1 > developing bias (−150 V) | As V1 increases, developer density to developing roller approaches that on the application roller |
| | V1 < developing bias (−150 V) | As V1 decreases, developer density to developing roller decreases than that on the application roller |
| Carrier Roller | V2 > V1 | As V2 increases, developer density to developing roller approaches that on the application roller |
| | V2 < V1 | As V1 decreases, developer density to developing roller decreases than that on the application roller |
| Feed roller | V3 > V2 | As V2 increases, developer density to developing roller approaches that on the application roller |
| | V3 < V2 | As V1 decreases, developer density to developing roller decreases than that on the application roller |
| | V3 > Vp | Developer density to be carried increases as compared with V3 = Vp |
| | V3 < Vp | Developer density to be carried decreases as compared with V3 = Vp |

When the application rollers 2421*a* and 2421*b* come in contact with the developing roller 2422, and the carrier roller 2423 comes in contact with the application rollers 2421*a* and 2421*b*, it is preferable to maintain the equipotential in order to maintain the potential of the developing roller 2422, and it is necessary to optimize the electrical resistance of each roller in order to generate a potential difference between all rollers. Further, when the construction is such that the feed roller 2424*a*, the application rollers 2421*a* and 2421*b* and the developing roller 2422 come in contact with each other sequentially, and the bias setting of each roller is set to the developing bias, as shown in FIG. 27, it is possible to sufficiently control the density of the developer with the electric field between the feed roller 2424*a* and the carrier roller 2423, and the number of revolution of the feed roller.

The developer recovery apparatus 2417 comprises a developer recovery blade 514 provided so as to abut against the developing roller 2422, a developer adjusting section 524 which stores the recovered liquid developer 2428, a tank 2426 which stores a liquid developer 2425 having higher toner density than that of the liquid developer 2428 stored in the developer adjusting section 524, and a developer density measuring apparatus, a developer supplying apparatus, a carrier liquid supplying apparatus, and a redispersing apparatus (not shown). The developer adhered to the developing roller 2422 which has finished development and residual developer which has not been transferred to the photosensitive drum 2410 are recovered by each blade into the developer adjusting section 524, and these developers are supplied and redispersed.

The liquid developer 2428 adhered to the developing roller 2422 is recovered into the developer adjusting section 524, and dispersed for reuse. The density of the developer in the developer adjusting section 524 is adjusted by the developer density measuring apparatus (not shown). Further, as a method of increasing the image density according to the specification of the user, there can be employed a method for measuring the density of the developer on the developing roller 2422 by the developer density measuring apparatus 2416, and for controlling the density of the developer by a peripheral velocity of a plurality of rollers or an electric field between rollers.

The transfer apparatus 2405 comprises an intermediate transfer drum 2406 which is an intermediate transfer body, a secondary transfer roller 2407 which is a secondary transfer body provided so as to be able to approach and separate from the intermediate transfer drum 2406, and a blade 2408 which removes the toner remaining on the intermediate transfer drum 2406.

The intermediate transfer drum 2406 is arranged so as to abut against the photosensitive drum 2410, and rotates in the direction opposite to the rotation direction of the photosensitive drum 2410. The intermediate transfer drum 2406 is charged by an electric charge having a polarity opposite to that of the toner by a power unit (not shown), at the time of transfer. Thereby, that is, by the electrostatic force, the toner image on the photosensitive drum 2410 is primarily transferred to the intermediate transfer drum 2406.

The intermediate transfer drum 2406 has a cored bar formed by a rigid body such as stainless steel, an elastic layer formed around the cored bar, and a surface layer formed on the surface of the elastic layer. Therefore, a contact pressure at the time when the toner image formed on the photosensitive drum 2410 comes in contact with the intermediate transfer drum 2406 can be dispersed, and hence the toner image on the photosensitive drum 2410 can be prevented from being disturbed. It is desired that the hardness of the intermediate transfer drum 2406 is JIS-A 5 to 50 degrees, and preferably JIS-A 15 to 40 degrees. If the hardness is lower than JIS-A 5 degrees, the intermediate transfer drum 2406 is too soft to keep a constant shape. On the other hand, if the hardness is higher than JIS-A 50 degrees, the intermediate transfer drum 2406 is too hard, and when the toner image formed on the photosensitive drum 2410 is brought into contact with the intermediate transfer drum 2406, the toner image on the photosensitive drum 2410 may be crushed.

As the member which forms the elastic layer of the intermediate transfer drum 2406, there can be mentioned a foamed body of polystyrene, polyethylene, polyurethane, polyvinyl chloride or NBR (nitrile butylenes rubber), and a low-hardness rubber member such as silicone rubber or urethane rubber. However, if the rubber member is used for a long period of time in a state of being elastically deformed, in general, the rubber member may be permanently deformed and may not return to the original shape, that is, the cylindrical shape. Therefore, it is preferable to use a foamed body for the member which forms the elastic layer. An elastic layer is formed by a rubber member around the cored bar, and an elastic layer may be further formed by a foamed body on the surface thereof.

The surface layer of the intermediate transfer drum 2406 is formed by a member which does not swell in the silicone oil, which is the carrier liquid of the liquid developer 2428. As a method of forming the surface layer, there can be mentioned, for example, a method for coating a synthetic rubber combination on the surface of the elastic layer, and a method for covering the surface of the elastic layer with a tube. This tube is desirably a tube formed by a resin tube, for example, polyimide, PET (polyethylene terephthalate) or the like, having no seam, a so-called endless tube. When the elastic layer is formed by a rubber member which does not swell in the silicone oil, such as urethane rubber, it is not necessary to cover the side face of the intermediate transfer drum 2406 with the surface layer. However, when the elastic layer is formed by a foamed body which swells in the silicone oil, it is necessary to cover the side face of the intermediate transfer drum 2406 with the surface layer.

The electrical resistance of the intermediate transfer drum 2406 is desirably from $10^4$ to $10^{11}$ Ωcm, and if possible, from $10^6$ to $10^{11}$ Ωcm. If the electrical resistance is lower than $10^4$ Ωcm, when the intermediate transfer drum 2406 is charged, electricity is abruptly discharged from the intermediate transfer drum 2406 to the photosensitive drum 2410, to thereby damage the photosensitive drum 2410, and cause insufficient transfer. On the other hand, if the electrical resistance is higher than $10^{11}$ Ωcm, the intermediate transfer drum 2406 is not charged sufficiently, and the electrostatic force between the intermediate transfer drum 2406 and the toner image formed on the photosensitive drum 2410 is weakened, thereby the toner is not sufficiently moved. In order to make the intermediate transfer drum 2406 have the electrical resistance, it is necessary to reduce the electrical resistance by making the surface of the intermediate transfer drum 2406 conductive, or adding conductive particles to the member which forms the surface layer.

It is desirable that the surface of the intermediate transfer drum 2406 is a bright face having a releasing property. This is because by improving the releasing property from the toner, removal of the toner adhered on the intermediate transfer drum 2406 becomes easy. Therefore, as the member which forms the surface layer of the intermediate transfer drum 2406, it is desired to use a resin tube such as latex, coated rubber member, or polyimide applied with releasing coating such as fluorine coating, or a resin tube of PFA, PTFE, ETFE (tetrafluoroethylene-ethylene copolymer resin), FEP (tetrafluoroethylene-hexafluoropropylene copolymer resin), having a releasing effect on the surface thereof.

The secondary transfer roller 2407 feeds paper, being a recording medium, to the space between the intermediate transfer drum 2406 and the secondary transfer roller 2407, by rotating in the direction opposite to the rotation direction of the intermediate transfer drum 2406. At this time, the secondary transfer roller 2407 is pressed against the intermediate transfer drum 2406 via the paper. The secondary transfer roller 2407 is also charged by an electric charge having a polarity opposite to that of the toner by a power unit (not shown). Therefore, adhesion of the intermediate transfer body and the recording medium can be improved by the elastic layer of the intermediate transfer drum 2406 and the electrostatic force of the secondary transfer roller 2407. As a result, excellent transfer can be made regardless of unevenness on the surface of the recording medium.

Fluorine coating is applied on the surface of the secondary transfer roller 2407. This is because by improving the releasing property from the toner, removal of the toner adhered on the secondary transfer roller 2407 is made easy to thereby prevent the secondary transfer roller 2407 from being soiled.

The blade 2408 is set so as to be able to approach and separate from the intermediate transfer drum 2406 and abut against the intermediate transfer drum 2406 at the time of cleaning, and is charged by an electric charge having a polarity opposite to that of the toner by a power unit (not shown). The blade 2408 makes the toner remaining on the intermediate transfer drum 2406 after completion of the secondary transfer step adhere electrically on the surface thereof, to thereby remove the toner from the intermediate transfer drum 2406.

The cleaning apparatus 2412 comprises a blade 2411 and a power unit (not shown) connected to the blade 2411, and the blade 2411 is arranged so as to abut against the photosensitive drum 2410. The blade 2411 is charged by an electric charge having a polarity opposite to that of the toner by a power unit (not shown), makes the toner remaining on the photosensitive drum 2410 after charge removing adhere electrically on the surface thereof, to thereby remove the toner from the photosensitive drum 2410.

Materials for image formation used in the ninth embodiment will be explained. The liquid developer 2428 comprises a resin which becomes a binder such as epoxy resin, a charge control agent which gives predetermined electric charge to the toner (positive charge in the ninth embodiment), a color pigment, a toner comprising a dispersing agent which uniformly disperses the toner, and a carrier liquid. The toner is basically the same as that of being used in the conventional liquid developer, but the formula is changed so as to suit silicone oil, for the adjustment of the charging property and the dispersibility. As the average particle diameter of the toner becomes smaller, the resolution is further improved. If the particle diameter thereof is small, a physical bonding force increases, and at the time of transfer, it becomes hard to peel the toner. Therefore, the average particle diameter of the toner in the ninth embodiment is adjusted such that the center is around 2 to 4 μm for improving the transfer property.

The viscosity of the liquid developer is determined by the material and the density of the carrier liquid, resin, color pigment and charge control agent to be used. In the ninth embodiment, the viscosity is changed in the range of from 50 to 6000 mPa·s, and the toner density is changed in the range of from 5 to 40%, to carry out experiments.

As the carrier liquid, a dimethylpolysiloxane oil or a cyclic polydimethylsiloxane oil which shows high electric resistance is used. Since the carrier liquid is contained in the liquid developer on the developing roller 2422 in a very small amount, the amount of the carrier liquid contained in the liquid developer supplied to the latent image face on the photosensitive drum 2410 is also small. Therefore, the amount of the carrier liquid absorbed in paper or the like at the time of transfer is very small, and if the viscosity is not higher than 1000 mPa·s, the carrier liquid remaining after fixation is hardly seen. According to the experiments carried out by the present inventors, when SH200 having a viscosity of 50 mPa·s, and one having a viscosity of 100 mPa·s, manufactured by Dow Corning Corp. in USA was used as the carrier liquid to perform image formation experiments, there was not seen any carrier liquid remaining on the paper after fixation, but since volatility is high, it was necessary to make the development apparatus have a sealed structure. When KF-96-20 having a viscosity of 20 mPa·s manufactured by Shin-Etsu Silicon Co., Ltd. was used as the carrier liquid to perform image formation experiments, there was not seen any carrier liquid remaining on the paper after fixation, and since it hardly volatiles, it was not necessary to make the development apparatus have a sealed structure. As for the carrier liquid, there are many kinds other than KF96 manufactured by Shin-Etsu Silicon Co., Ltd., and hence any one may be selected, so long as the electric resistance, evaporation characteristic, surface tension and safety are satisfied.

In the experiments performed by the present inventors, when the surface tension is large, fogging may occur or a lump of toner may adhere, and it has been experimentally found that when the surface tension is 21 dyn/cm or higher, wettability deteriorates, and a problem is likely to occur in the image quality. Hence, it is desired that the surface tension is as small as possible.

The electric resistance is desired to be at least $10^{14}$ Ωcm, in diagram of the charging stability of the toner. If the electric resistance is lower than $10^{12}$ Ωcm, nonconductivity deteriorates, and conductive problem occurs in the toner, and as a result, this developer cannot be used. Therefore, it is desired that the electric resistance is as high as possible, and at least $10^{12}$ Ωcm is required. In the explanation of the ninth embodiment, taking these experiments results into consideration, there is shown an example used SH200 (50 mPa·s) which is cheap and easily available.

The operation of the image formation apparatus 2401 will now be explained. At first, the surface of the photosensitive drum 2410 is charged with an electric charge having a polarity opposite to that of the toner, in the instance of the ninth embodiment, with negative charge, by the charging apparatus 2414. Generally, a corona discharge device is used as the charging apparatus 2414. Then, an inverse image is exposed by a laser scanner on the charged photosensitive drum 2410 by the exposure apparatus 2415, to thereby form an electrostatic latent image. The portion where the beam of the laser scanner is irradiated is made conductive, and hence the electric charge disappears, and the portion where the beam of the laser scanner is not irradiated remains as the electrostatic latent image, being a charge pattern.

The electrostatic latent image is manifested by the development apparatus 2420. The liquid developer 2428 stored in the tank 2429 is fed to the carrier roller 2423 by the feed roller 2424*a*, and after having been carried to the application rollers 2421*a* and 2421*b*, is applied on the developing roller 2422. In this manner, by applying the liquid developer 2428 via a plurality of rollers, a uniform and thin liquid developer layer is formed on the developing roller 2422. Since a bias voltage is applied to the feed roller 2424*a*, the carrier roller 2423 and the application rollers 2421*a* and 2421*b* respectively by the power units 2504, 2503 and 2502, the feed amount of the liquid developer 2428 with respect to the developing roller 2422 can be adjusted. By bringing the liquid developer layer on the developing roller 2422 into soft contact with the photosensitive drum 2410, the developer layer is made to approach the electrostatic latent image formed on the photosensitive drum 2410, and the charged toner is shifted onto the photosensitive drum 2410 by the electrostatic force. As a result, a toner image is formed on the photosensitive drum 2410.

The toner image formed on the photosensitive drum 2410 is transferred to the paper, being a recording medium, by the transfer apparatus 2405. The toner formed on the photosensitive drum 2410 is first primarily transferred onto the intermediate transfer drum 2406, by an electrostatic force generated between the toner and the intermediate transfer drum 2406 which is charged with an electric charge having a polarity opposite to that of the toner by the power unit (not shown). The toner image primarily transferred onto the intermediate transfer drum 2406 is secondarily transferred onto the paper fed to the space between the intermediate transfer drum 2406 and the secondary transfer roller 2407, by an electrostatic force generated by a pressing force of the secondary transfer roller 2407 to the intermediate transfer drum 2406 and a secondary transfer bias applied to the secondary transfer roller 2407. On the other hand, the photosensitive drum 2410 is removed by the charge removing apparatus 2409, after the liquid developer 2428 remaining on the surface of the photosensitive drum 2410 has been removed by the cleaning apparatus 2412.

The toner image secondarily transferred onto the paper is fixed by the fixing apparatus 2402. Fixation is carried out by thermally dissolving the toner transferred onto the paper by a fixing heater 94 provided in the fixing roller 2403 of the fixing apparatus 2402.

According to the embodiment, by applying the liquid developer on the developing roller 2422 via the feed roller 2424*a*, the carrier roller 2423 and the application rollers 2421*a* and 2421*b*, the thickness of the liquid developer on each roller is regulated to be thin and uniform by the abutment section with the adjoining roller. As a result, the high-density and high-viscosity liquid developer 2428 can be applied on the developing roller 2422 thinly and uniformly.

According to the above embodiment, since the power unit 2504 which applies bias voltage to the feed roller 2424*a* is provided, and the back plate 2427 connected to the power unit is internally provided in the developing tank 2429, an electric field is generated between the feed roller 2424*a* and the back plate 2427, and the pumping amount of the liquid developer 2428 can be adjusted by an electrostatic force acting on the toner. Further, by providing the power unit 2503 which applies bias voltage to the carrier roller 2423 and the power unit 2502 which applies bias voltage to the application rollers 2421*a* and 2421*b*, the density of the liquid developer 2428 to the developing roller 2422, that is, the density of the liquid developer on the developing roller 2422 can be adjusted by an electrostatic force acting between the toner and the carrier roller 2423 and an electrostatic force acting between the toner and the application rollers 2421*a* and 2421*b*.

When the application rollers 2421*a* and 2421*b* come in contact with the developing roller 2422, and the carrier roller 2423 comes in contact with the application rollers 2421*a* and 2421*b*, it is preferable to maintain the equipotential in order to maintain the potential of the developing roller 2422, and it is necessary to optimize the electrical resistance of each roller in order to generate a potential difference between all rollers, as explained above. Further, when the construction is such that the feed roller 2424*a*, the application rollers 2421*a* and 2421*b* and the developing roller 2422 come in contact with each other sequentially, and the bias setting of each roller is set to the developing bias, it is possible to sufficiently control the density of the developer with the electric field between the feed roller 2424*a* and the carrier roller 2423, and the number of revolution of the feed roller 2424*a*.

According to the above embodiment, by providing the developer density measuring apparatus 2416 which measures the optical reflectance of the liquid developer layer on the developing roller 2422, and calculates the density of the developer based on this optical reflectance, and a control unit 2505 which adjusts the voltage of the power unit 2503 and the power unit 2504 based on the density of the developer calculated by the developer density measuring apparatus 2416, the liquid developer 2428 always having optimum developer density can be supplied to the developing roller 2422.

According to the above embodiment, by providing two application rollers 2421*a* and 2421*b* which apply the liquid developer 2428 on the developing roller 2422, application nonuniformity (ruffle) which occurs due to the influence of the viscosity of the liquid developer 2428 and the dispersibility of the toner is made dense, thereby a uniform liquid developer layer can be formed on the developing roller.

According to the above embodiment, by using silicone oil as the carrier liquid of the liquid developer 2428, advantages as described below can be obtained as compared to the conventional liquid developer.

For the conventional liquid developer, IsoparG (trademark, manufactured by Exxon Corp.) is generally used as the carrier liquid. This Isopar does not have a resistance as low as silicon oil. Hence, if the toner density is made high, that is, if the distance between particles becomes small, the charging characteristic of the toner deteriorates. Therefore, when the Isopar is used, there is a limitation in the toner density. On the other hand, the silicone oil used in the ninth embodiment has a sufficiently high resistance, and hence the toner density can be made high. Generally when the Isopar is used, the toner is well dispersed, and even if the toner density is from 1 to 2%, the toner particles are repulsive to each other, and hence the toner is uniformly dispersed. On the other hand, the silicone oil is not well dispersed when the toner density is from 1 to 2%, and is deposited immediately. However, when the toner density is from 5 to 40%, the silicon oil becomes dense, and is stably dispersed. Therefore, in the ninth embodiment, a toner having an average particle diameter of from 0.1 to 5 $\mu$m is contained in a density of from 5 to 40% as a liquid developer, and a high-viscosity liquid developer in which the toner is densely dispersed is used. The resolution of the toner is improved, substantially inversely proportional to the size of the particle diameter. Since the toner usually exists in a lump of 5 to 10 pieces on the printed paper, when the average particle diameter of the toner becomes higher than 5 $\mu$m, the resolution deteriorates. If the average particle diameter of the toner becomes smaller than 0.1 $\mu$m, physical bonding force increases, and at the time of transfer, the toner is hard to be peeled. Hence, the liquid amount of the developer can be greatly reduced as compared to the conventional low-density liquid developer, and as a result, the development apparatus can be made small. Further, the liquid developer in the ninth embodiment is high-viscosity liquid, storage and handling become easier than the conventional low-viscosity liquid developer and a powder developer.

The Isopar used in the conventional liquid developer is, as described above, highly volatile and stinking, and hence there is a problem in that not only the working environment is deteriorated but also causes environmental contamination. On the other hand, silicone oil used in this embodiment is safe liquid, as is obvious from the fact that it is also used for cosmetic purposes, and is odorless. Therefore, it can improve the working environment, and a problem of environmental contamination does not occur.

In the above embodiment, there has been explained a so-called regular development in which an image support is charged with an electric charge having a polarity opposite to that of the toner, and thereafter, light is irradiated to the image support to expose an inverse image, and an electrostatic latent image to be visualized is formed in a portion where the light has not been irradiated, that is, a portion which is not made conductive. However, the present invention is not limited thereto, and may use a so-called inverse development in which an image support is charged with an electric charge having a polarity same as that of the toner, and thereafter, light is irradiated to the image support to expose a regular image, and an electrostatic latent image to be visualized is formed in a portion where the light has been irradiated. The present inventors has used a positively charged toner and set the developing bias voltage to 500V, in the apparatus employing the inverse development, and has confirmed that there is a relationship, as shown in Table 4, between a bias voltage applied to each roller and an amount of coating of the liquid developer. Here, V1 denotes a bias voltage applied to the application rollers 2421*a* and 2421*b*, V2 denotes a bias voltage applied to the carrier roller 2423, V3 denotes a bias voltage applied to the feed roller 2424*a*, and Vp denotes the voltage of the back plate 2427.

TABLE 4

| | Bias voltage | Density of developer |
|---|---|---|
| Application Roller | V1 > developing bias (−150 V) | As V1 increases, developer density to developing roller approaches that on the application roller |
| | V1 < developing bias (−500 V) | As V1 decreases, developer density to developing roller decreases than that on the application roller |
| Carrier Roller | V2 > V1 | As V2 increases, developer density to developing roller approaches that on the application roller |
| | V2 < V1 | As V1 decreases, developer density to developing roller decreases than that on the application roller |
| Feed roller | V3 > V2 | As V2 increases, developer density to developing roller approaches that on the application roller |
| | V3 < V2 | As V1 decreases, developer density to developing roller decreases than that on the application roller |
| | V3 > Vp | Developer density to be carried increases as compared with V3 = Vp |
| | V3 < Vp | Developer density to be carried decreases as compared with V3 = Vp |

When the application rollers 2421*a* and 2421*b* come in contact with the developing roller 2422, and the carrier roller 2423 comes in contact with the application rollers 2421*a* and 2421*b*, it is preferable to maintain the equipotential in order to maintain the potential of the developing roller 2422, and it is necessary to optimize the electrical resistance of each roller in order to generate a potential difference between all rollers, as described above. Further, when the construction is such that the feed roller 2424*a*, the application rollers 2421*a* and 2421*b* and the developing roller 2422 come in contact with each other sequentially, and the bias setting of each roller is set to the developing bias, it is possible to sufficiently control the density of the developer with the electric field between the feed roller 2424*a* and the carrier roller 2423, and the number of revolution of the feed roller 2424*a*.

The present invention is not limited to the above embodiment, and various modifications are possible within the range of the essential points. For example, in the above embodiment, an example used a photosensitive drum as the image support has been explained. However, the present invention is not limited thereto, and the image support may be one in which an insulator layer is formed on various photosensitive bodies used in the Carlson method or on a conductor on which an electrostatic latent image such as iconography is directly formed, or an electrostatic recording paper used in an electrostatic plotter.

The electrostatic transfer method has been explained in the above embodiment as the primary transfer in the transfer apparatus, but the present invention is not limited thereto, and maybe a method for performing primary transfer by an adhesive power and then performing intermediate transfer. In the above embodiment, there has been explained an example for secondarily transferring the toner image on the intermediate transfer drum 2406 to paper by a pressing force of the secondary transfer roller 2407 to the intermediate transfer drum 2406 and an electrostatic force generated by a bias voltage applied to the secondary transfer roller 2407, as the secondary transfer in the transfer apparatus, but the present invention is not limited thereto. The transfer apparatus needs only to be able to secondarily transfer the toner image on the intermediate transfer body to paper. For example, a fixing heater is provided inside the intermediate transfer body, and when the toner on the intermediate transfer body is heated, the toner image on the intermediate transfer body can be secondarily transferred to paper and also fixed at the same time.

The present invention may be applied to image formation apparatus in which the image formation apparatus 2401 explained in the above embodiment is arranged for each desired color to thereby obtain a color image. The present invention can be also applied to image formation apparatus in which a plurality of toner images are formed on the intermediate transfer body, and these toner images are collectively transferred onto a recording medium.

The present invention is not limited to the above embodiment, and if the thickness of the liquid developer is from 5 to 40 μm, the viscosity of the high-viscosity developer maybe 10000 mPa·s. Under current state, it is considered that a high-viscosity developer of 6000 mPa·s or higher is not suitable in diagram of the cost, since stirring of the carrier liquid and the toner becomes difficult. However, if such a developer having a viscosity of 6000 mPa·s or higher becomes available at a low price, this may be used. One having a viscosity of higher than 10000 mPa·s is not practical. The carrier liquid of the liquid developer is not limited to silicone oil.

[Tenth Embodiment]

An example of an embodiment applied the present invention to an electrophotographic copying machine (hereinafter referred to a copying machine), being wet-type image formation apparatus, will now be explained.

Figure 28:
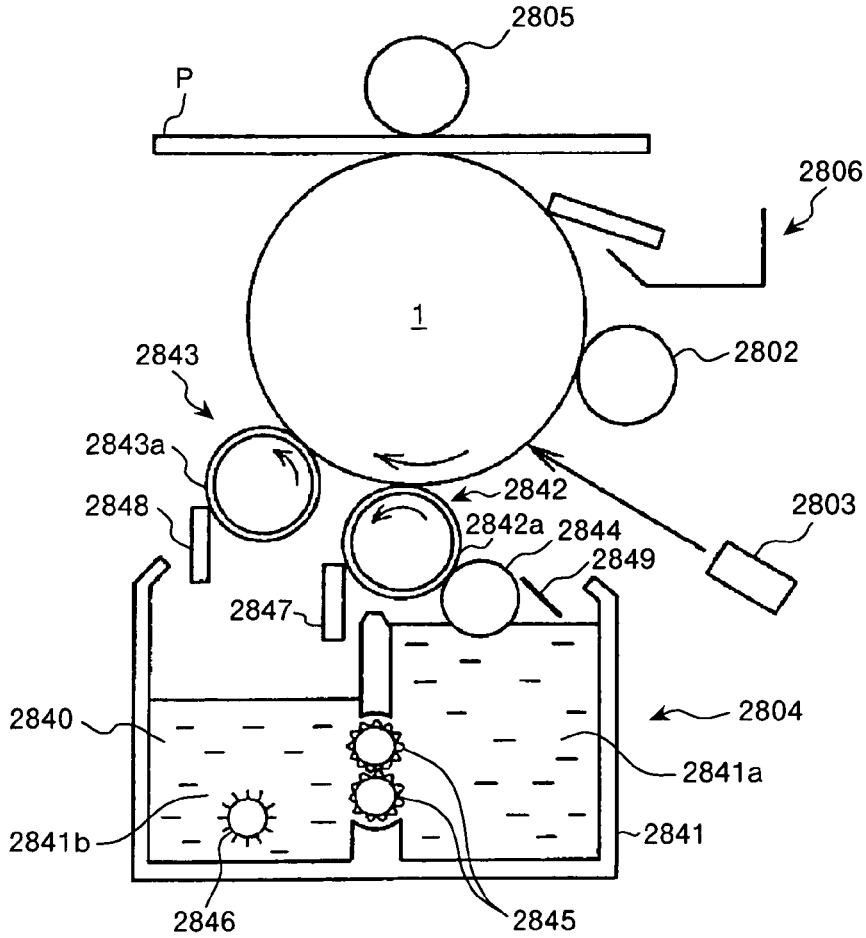
FIG. 28 is an explanatory diagram of the main part of wet-type image formation apparatus according to a tenth embodiment of the present invention.

FIG. 28 is a schematic configuration diagram of the main part of the copying machine according to a tenth embodiment of the present invention. The copying machine according to the tenth embodiment comprises a charging roller 2802, exposure apparatus 2803, development apparatus 2804, transfer apparatus 2805 and cleaning apparatus 2806 arranged around a photosensitive drum 2801 as a latent image support. The material of the photosensitive drum 2801 includes a-Si, OPC and the like. The exposure apparatus 2803 includes an LED, a laser scanning optical system and the like.

An example for forming an image by the inverse development using a copying machine having the above construction will be explained. The photosensitive drum 2801 is rotated in the direction of an arrow at a certain speed, at the time of copying, by a driving unit such as a motor (not shown). After the photosensitive drum 2801 is uniformly charged up to about 600V in the dark by the charging roller 2802, an original optical image is irradiated and formed by the exposure apparatus 2803, thereby an electrostatic latent image is supported on the outer peripheral face of the photosensitive drum 2801. Thereafter, the electrostatic latent image is developed while it is passing through the portion of the development apparatus 2804. The toner image developed on the electrostatic latent image is transferred onto a transfer paper P by the transfer apparatus 2805. After the transfer paper P has been separated, the residual toner on the photosensitive drum 2801 is removed by the cleaning apparatus 2806. Then the residual potential on the surface of the photosensitive drum 2801 is removed by a charge removing lamp (not shown), for the preparation of the next copying. The transfer paper P on which the toner image has been transferred passes through a fixing apparatus (not shown) and ejected outside the machine. The transfer apparatus 2805 can use various methods, such as a method using the charging roller 2802, a method by corona discharge, an adhesive transfer method, or a heat transfer method. As the fixing apparatus, there can be used for example a heat transfer method, solvent fixation or pressure fixation.

The developer 2840 used in the copying machine in the tenth embodiment is not a low-viscosity (about 1 cSt) and low-density (about 1%) liquid developer using Isopar (trademark of Exxon), which is available in the market and generally used conventionally, as a carrier, but a high-viscosity and high-density liquid developer. As the range of the viscosity and density of the developer 2840, for example, a liquid developer having a viscosity of from 50 cSt to 5000 cSt, and density of from 5% to 40% is used. In the tenth embodiment, one having a density of 15% is used. As the carrier liquid, one having high conductivity such as silicone oil, normal paraffin, IsoparM (trademark of Exxon), vegetable oil, or mineral oil is used. The volatility or nonvolatility can be selected according to the purpose. The particle diameter of the toner can be selected from submicron to 6 μm, according to the purpose.

The development apparatus 2804, which is the characteristic part in the tenth embodiment, will now be explained. The development apparatus 2804 is mainly composed of a developer storing tank 2841 which stores the developer 2840 therein, a developing roller 2842 as a developer support, a sweep roller 2843 as a removal member, a gravure roller 2844, a gear pump 2845, and a stirring roller 46, as shown in the figure. The developing roller 2842 and the sweep roller 2843 are respectively provided with a cleaning member 2847, 2848 comprising a metal blade or a rubber blade. Each of the cleaning members 2847 and 2848 is not limited to a blade, and may be a roller type. The gravure roller 2844 is provided with a doctor blade 2849.

The developing roller 2842 and the sweep roller 2843 are respectively provided with an elastic layer 2842*a*, 2843*a* having conductivity on the outer periphery thereof. Urethane rubber can be used as the material of these elastic layers 2842*a* and 2843*a*. For the rubber hardness of the layers 2842*a* and 2843*a* of each elastic body, it is desired to be not higher than 50 degrees as measured by JIS-A hardness. The material of the layers 2842*a* and 2843*a* of each elastic body is not limited to the urethane rubber, and may be any material which has conductivity, and does not swell or dissolve in a solvent. The construction may be such that the elastic layer is not provided in the developing roller 2842 and the sweep roller 2843, but is provided on the photosensitive body side. Further, the photosensitive body may be formed by an endless belt-like member.

The sweep roller 2843 is constructed such that the surface thereof has a smoothness of not higher than Rz 3 μm, by means of a coating or a tube.

When the developing roller 2842 and the sweep roller 2843 are abutted against the photosensitive drum 2801 with appropriate pressure, the elastic layers 2842*a* and 2843*a* of each roller elastically deform, to thereby form a developing nip and a removal nip. Particularly, by forming the developing nip, a certain developing time for the toner in the liquid developer 2840 to move towards the photosensitive drum 2801 due to a developing electric field in the developing area, and adhere thereon can be ensured. By adjusting the abutment pressure, the nip width, being the size in the moving direction on the surface in each nip section, can be adjusted. Each nip width is set to be at least a product of the linear velocity of each roller and the developing time constant. The developing time constant is a time required for the developed amount to saturate, and obtained by dividing the nip width by the process velocity. For example, if the nip width is 3 mm, and the process velocity is 300 mm/sec, the developing time constant becomes 10 msec.

At the time of development operation, a thin layer of the developer 2840 is formed on the developing roller 2842 by the gravure roller 2844. At this time, the thickness of the liquid developer 2840 applied onto the developing roller 2842 is set such that the pigment content in the toner supported on the surface per 1 $cm^2$ becomes at least 0.1 $\mu$g, and not higher than 2 $\mu$g. Therefore, the thin layer of the liquid developer 2840 is applied in the thickness of from 5 to 10 $\mu$m. This is because if the application thickness of the liquid developer 2840 is such that the pigment content in the toner supported on the surface of the developing roller 2842 per 1 $cm^2$ becomes smaller than 0.1 $\mu$g, pigment in a sufficient amount does not move to the image section of the latent image formed on the photosensitive drum 2801, and hence there is the possibility that the image density of the image section becomes weak. Further, if the application thickness of the liquid developer 2840 is such that the pigment content in the toner supported on the surface of the developing roller 2842 per 1 $cm^2$ becomes higher than 2 $\mu$g, the residual toner remaining in the background section on the photosensitive drum 2801 after development increases, and there is the possibility that removal by the sweep roller 2843 is insufficient. In the tenth embodiment, the thickness of the developer layer applied on the developing roller 2842 is set to 8 $\mu$m, and the thickness of the photosensitive drum 2801 is set to 30 $\mu$m.

The thin layer of the developer 2840 formed on the surface of the developing roller 2842 passes through a developing nip formed by the photosensitive drum 2801 and the developing roller 2842.

In general, with the electrophotographic development apparatus, the surface traveling speed of the developing roller 2842 is set to be faster than that of the photosensitive body, in order to feed sufficient toner to the area where the photosensitive body faces the development apparatus. Therefore, the toner has a fast traveling speed with respect to the surface of the photosensitive body, to thereby cause a misregistration with the latent image. As a result, in the image, there appears a phenomenon such that the point is blurred, or the balance between the longitudinal line and the horizontal line is deteriorated. This phenomenon is seen also in the wet development. With the copying machine according to the tenth embodiment, the surface of the developing roller 2842 and the surface of the photosensitive drum 2801 moves substantially at the same speed, so that the velocity vector in the tangential direction of the photosensitive drum 2801 is not relatively given to the toner, and hence the above phenomenon does not occur.

Figure 29A:
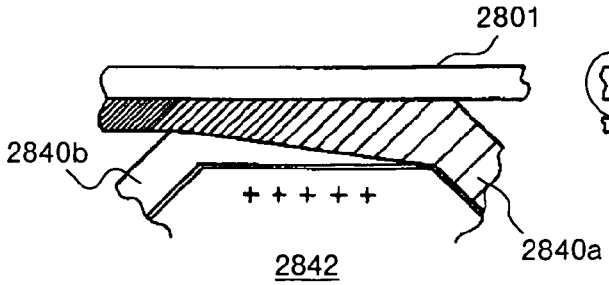
FIG. 29A and FIG. 29B are schematic diagrams which show the condition of a developer in a developing nip.
Figure 29B:
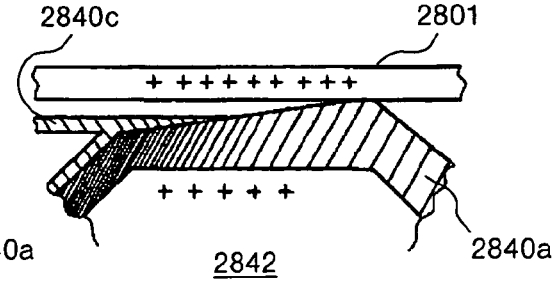

A development bias voltage (400V), which is lower than the surface potential of the photosensitive body (600V), is applied to the developing roller 2842, and a developing electric field is generated between the developing roller 1709 and the image face which has been exposed by the exposure apparatus 2803 and the potential thereof becomes lower than 50V. FIG. 29A and FIG. 29B are schematic diagrams which show the state of the developer 1840 in the developing nip.

In the image section of the photosensitive drum 2801, as shown in FIG. 29A, the toner 2840*a* in the developer 2840 moves towards the photosensitive drum 2801 due to the electric field, to thereby manifest the latent image. On the other hand, in the background section, as shown in FIG. 29B, the background residual toner remaining in the background section is attracted towards the surface of the developing roller 2842 by the electric field formed by the developing bias potential and the potential of the photosensitive body (hereinafter referred to as background electric field), so that the toner 2840*a* is not left in the background section.

The developer storage tank comprises a feed section 2841*a* which stores the liquid developer for supplying it to the gravure roller 2844, and a recovery section 2841*b* which recovers the residual toner removed from the developing roller 2842 and the sweep roller 2843. These feed section 2841*a* and recovery section 2841*b* are arranged side by side via a gear pump 2845, and the recovery section 2841*b* is located below the cleaning members 2847 and 2848 provided in the developing roller 2842 and the sweep roller 2843. Thereby, the residual toner remaining on the developing roller 2842 without being used, and the background residual toner attracted from the surface of the photosensitive drum by the sweep roller 2843 and removed by the cleaning member 2848 are recovered in the recovery section 2841*b*, so that it is carried to the feed section again by the gear pump and can be reused for development. Thereby, a residual toner recycle mechanism and a residual toner recycle mechanism on the removal member are formed.

Conventionally, in order to prevent the residual toner which adheres in the background section on the photosensitive drum 2801, a sufficient background section developing electric field is formed between the background section and the developing roller 2842, to attract the residual toner towards the developing roller 2842, to thereby prevent fogging due to the residual toner. However, if the sufficient background section developing electric field is formed so that the toner does not adhere in the background section, the fog toner can be prevented, but the developer on the developing roller 2842 which has finished the developing process may flocculate due to compression by the electric field. This becomes a problem when the developer is repetitively used. Further, the shifted amount of the toner to the image section decreases, thereby the image density may be deteriorated.

Figure 30:
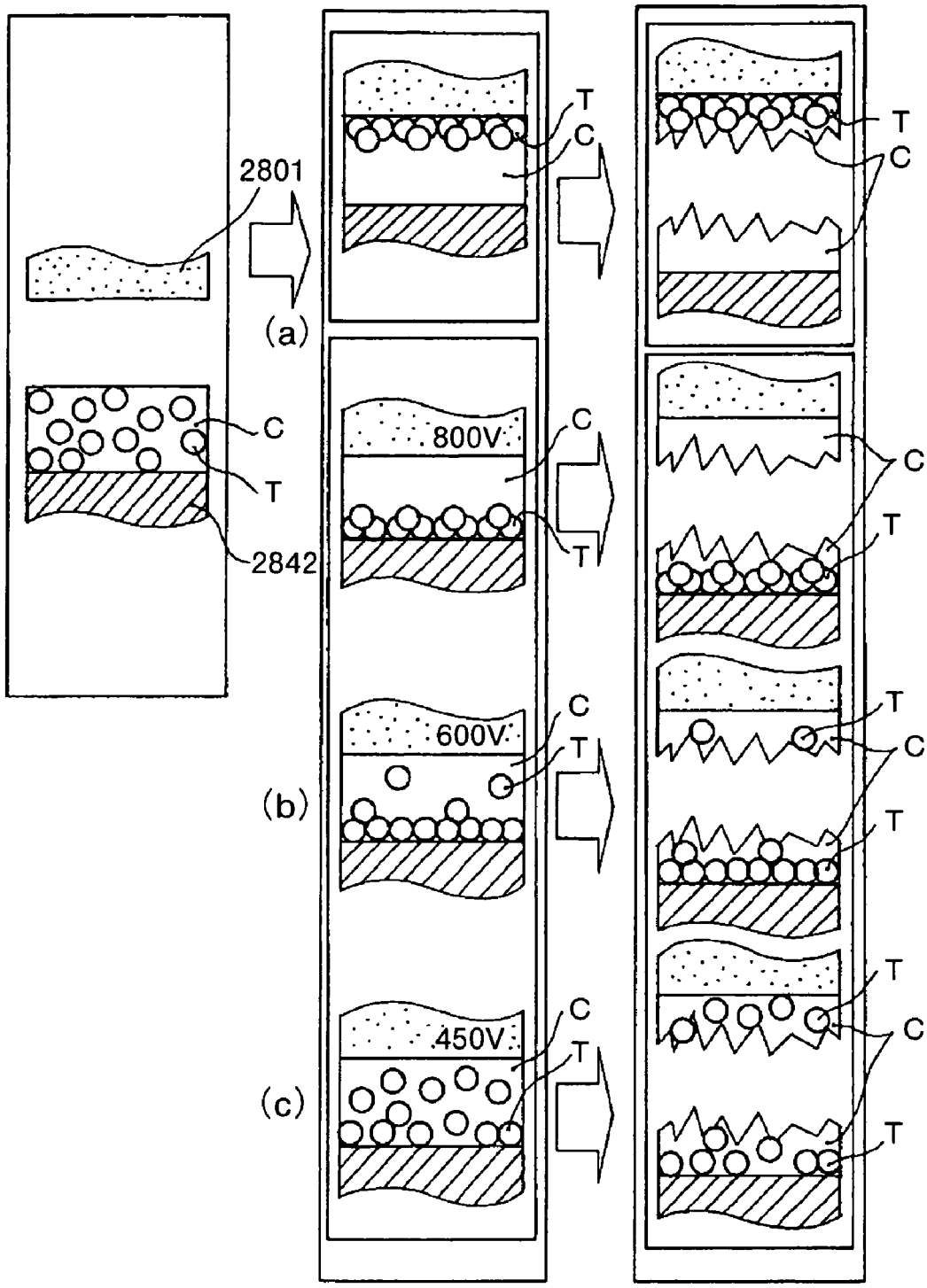
FIGS. 30A to 30C are schematic diagrams which show the condition of a developer in a developing nip, when a voltage applied to a developing roller is changed.

FIG. 30 is a schematic diagram which shows the condition of the background residual toner when the potential in the image section on the photosensitive drum 2801 is set 0V, the potential of the developing roller 2842 is set to 400V, and the potential in the background section on the photosensitive drum 2801 is changed in three stages, that is, to 800V (FIG. 30A), 600V (FIG. 30B) and 450V (FIG. 30C). As shown in this figure, the developer on the developing roller 2842 is transferred to and adheres on the image section on the photosensitive drum 2801 to form an image, by the developing electric field generated between the image section and the developing roller 2842.

In the background section on the photosensitive drum 2801, as shown in FIG. 30A, when the potential in the background section is as high as 800V, the background electric field generated between the background section and the developing roller 2842 becomes as strong as $2.9\times10^7$ Vm, and fog toner in the background section does not occur, but the residual toner on the developing roller 2842 flocculates.

On the other hand, as shown in FIG. 30C, when the background electric field is as low as 450V, the background electric field generated between the background section and the developing roller 2842 becomes $3.6\times10^6$ Vm, and the residual toner cannot be successfully attracted towards the developing roller 2842, thereby causing fog toner on the photosensitive drum 2801.

As shown in FIG. 30B, when the background electric field is set to 600V, which is a value between FIG. 30A and FIG. 30C, the background electric field generated between the background section and the developing roller 2842 becomes $1.4\times10^7$ Vm, and the residual toner can be successfully attracted towards the developing roller 2842. As a result, the residual toner on the developing roller 2842 does not flocculate.

As already explained, Table 5 shows the result which is obtained by the present inventors by studying the evaluations of lump generation rank of the toner with respect to the background electric field, and background density.

TABLE 5

| Electric field V/m | Lump generation rank 5:none~1:any lamps | Background density |
|---|---|---|
| 0 | 5 | bad |
| 1.00E+07 | 5 | stain |
| 1.50E+07 | 5 | stain |
| 2.00E+07 | 4 | stain |
| 2.50E+07 | 4 | stain |
| 3.00E+07 | 3 | stain |
| 3.50E+07 | 2 | clear |
| 4.00E+07 | 2 | clear |
| 5.00E+07 | 1 | clear |

In Table 5, it is seen that flocculation of the toner occurs conspicuously, with an increase of the background electric field, and the background density occurs conspicuously, with a decrease of the background electric field. Following result has been obtained, that is, when the background electric field is about $3.5\times10^7$ Vm, the lump generation rank of the toner is "2" or higher, and flocculation of the toner particles in the developer stays within the allowable range. When the developing electric field is close to 0 V/m, the boundary between the image section and the background section is not clear, and though good results can be obtained in diagram of flocculation of the toner particles, there are lots of stains in the background section, and even if a removal unit described later is used, the condition is not practical. When the background electric field is $3.5\times10^7$ Vm, the background density is evaluated as "clear", and even if the background electric field is lower than this, the background density is evaluated as "stain", and still within the allowable range.

From the above results, it is desired to set the absolute value of the background electric field to $3.5\times10^7$ Vm or less. In particular, in the tenth embodiment, the background electric field is set to about $2\times10^7$ Vm. By setting like this, the lump generation rank of the toner can be "4", and the background density can be "stain", and thus such a condition that the flocculating toner is few, and the flocculating force is also small can be obtained. Thereby, the toner can be easily dispersed while the removed developer is recovered, and undeveloped developer which has not been used for development can be repetitively used.

In the above embodiment, since the background electric field is set weak, the background density may increase. In this instance, other than the method of removing the developer in the background section by the sweep roller 2843, a charge removing phenomenon may be generated by a high electric field at the time of transfer to thereby remove the developer.

It is also possible to set the absolute value of the background electric field to $5.0\times10^7$ Vm or less. In this instance, the developer adheres to the background section, but it adheres to the developing nip, and does not exceed 15%, being the developer density which mechanically transfers from the developing roller. The developer adhered to the background section can be removed by the sweep roller 2843.

Figure 31A:
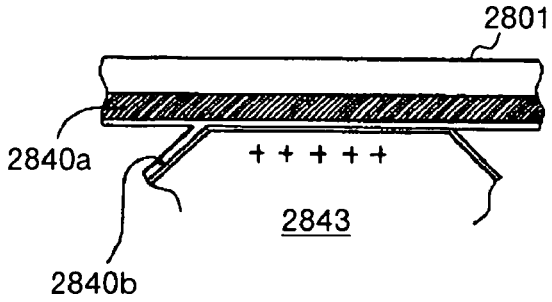
FIG. 31A and FIG. 31B are schematic diagrams which show the condition of a developer in a developing nip formed by a photosensitive drum and a sweep roller.
Figure 31B:
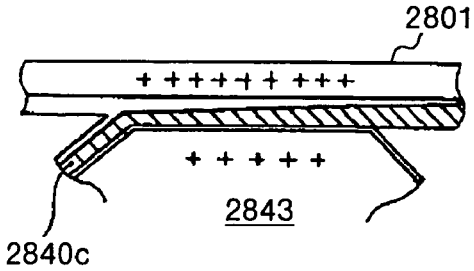

The printer in the tenth embodiment has a sweep roller 2843 as a removal member which attracts and removes the background residual toner remaining in the background section on the surface of the photosensitive drum, in addition to the above construction. When a part of the toner 2840*a* in the background section cannot move completely to the surface of the developing roller 2842 and remains on the side of the photosensitive drum 2801, it causes fogging. The sweep roller 2843 is to sweep (clean) the toner causing this fogging (hereinafter referred to as "fogtoner") 40*c*. This sweep roller 2843 is arranged on the downstream side of the developing roller 2842 in the rotation direction of the photosensitive drum 2801, pressed against the photosensitive drum 2801 so as to put the developed toner layer therebetween. The surface of the sweep roller 2843 moves substantially at the same speed with the surface of the photosensitive drum 2801. FIG. 31A and FIG. 31B are schematic diagrams which show the condition of the developer at the removal nip formed by the photosensitive drum 2801 and the sweep roller 2843.

To the sweep roller 2843, there is applied a bias voltage (250V) which is close to the toner layer surface potential on the photosensitive drum 2801 (100V to 200V), so that the toner 2840*a* does not return to the sweep roller 2843 from the toner layer after the development. In the background section, as shown in FIG. 31B, the floating fog toner 40*c* is moved to the sweep roller 2843, by an electric field generated due to a potential difference between the background section on the photosensitive drum 2801 and the bias voltage. The developer layer in the background section in this stage is such that the thickness is about half the thickness of the developing nip section of the developing roller 2842, and the toner density decreases to about 20% of the density before the development, and hence removal of the fog toner 40*c* can be easily performed. Thereby, fogging in the background section can be completely prevented. The relationship of the potential described above can be indicated by the following expression 1.

[Expression 1]

potential of photosensitive body>VB1>VB2>potential in toner layer wherein, VB1 denotes a potential between the photosensitive drum 2801 and the developing roller 2842, VB2 denotes a potential between the photosensitive drum 2801 and the sweep roller 2843.

By providing the sweep roller 2843, about half of the excessive carrier liquid C adhered in the background section on the photosensitive drum 2801 at the time of development can be removed.

Since removal of the fog toner 40*c* can be efficiently performed by the sweep roller 2843, the fog toner 40*c* may remain in a small amount in the developing nip between the photosensitive drum 2801 and the developing roller 2842, and hence the fog removal electric field (a potential difference between the developing bias applied to the developing roller 2842 and the charging potential of the photosensitive body) can be suppressed to be low. As a result, it becomes possible to reduce the charging potential of the photosensitive drum 2801. Thereby, there can be obtained various advantages such as improvement in durability of the photosensitive drum 2801, derating with respect to the charging roller 2802, and reduction of exposure power.

In the image formation method explained in the related art, it is possible to perform development and removal of fog toner in the background section at the same time by the developer support. However, it is necessary to ensure relatively long developing time (for example, about 40 msec), and hence it is necessary to increase the width of the developing nip formed between the latent image support and the developer support. With this conventional image formation method, since the nip section is formed by abutting the developer support having an elastic layer against the latent image support, the abutment pressure tends to increase in order to increase the width of the developing nip.

On the other hand, with the development apparatus 2804 in the copying machine according to the tenth embodiment, since the sweep roller 2843 is provided, it becomes possible to separate the function of development and the function of removing the fog toner 40*c* in the developing roller 2842. As a result, the width of the developing nip can be made smaller than that in the conventional apparatus, and the abutment pressure can be decreased (for example, 0.3 kgf/mm or less). Thereby, the load applied on the photosensitive drum 2801, the developing roller 2842 and the sweep roller 2843 can be reduced, to thereby improve the durability.

Figure 32:
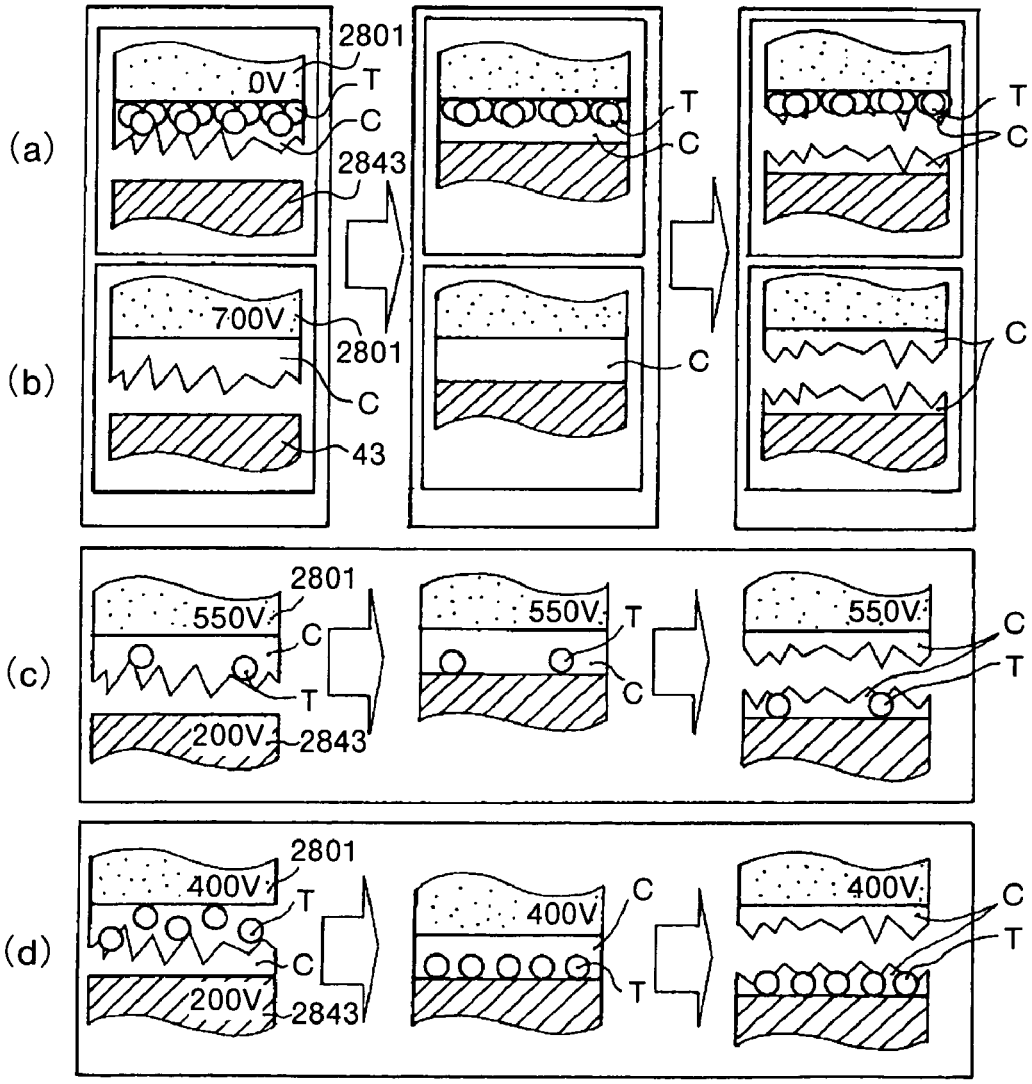
FIGS. 32A to 32D are explanatory diagrams of a removal process of a fog toner by a sweep roller.

FIGS. 32A to 32D are explanatory diagrams which show the removal process of the fog toner by the sweep roller 2843. In this embodiment, the liquid development apparatus is constituted such that the thickness of the developer layer developed on the photosensitive drum 2801 is set to 5 $\mu$m, and the thickness of the photosensitive body is set to 30 $\mu$m. In these figures, FIG. 32A shows the image section on the photosensitive drum 2801, and FIGS. 32B to 32D show the background section, when the bias applied to the sweep roller 2843 is set to 200V. Each figure shows the surface potential, wherein FIG. 32A shows when the potential in the image section is 0V, FIG. 32B shows when the potential is 700V, 32C shows when the potential is 550V, and 32D shows when the potential is 400V. The intensity of the sweeping electric field as the removal electric field generated between the background section and the sweep roller 2843 is such that $4.5\times10^7$ V/m in FIG. 32B, $3.2\times10^7$ V/m in FIG. 32C, and $1.8\times10^6$ V/m in FIG. 32D. As shown in the figure, the fog toner moves by the sweeping electric field formed by the potential of the photosensitive body and the potential of the sweep roller in the background section. Figures in which the intensity of the electric field respectively changes due to the potential of the photosensitive body show the cohesive power of fog toner particles moving to the sweep roller 2843 or the moving condition of the toner T.

In the image section in FIG. 32A, the sweep roller 2843 is separated from the surface of the photosensitive drum, while slightly removing only the carrier C, leaving the toner T in the developer adhered on the photosensitive drum 2801 as it is.

When the surface potential of the photosensitive drum is sufficiently high in the background section as shown in FIG. 32B, the sweep roller 2843 is separated from the surface of the photosensitive drum, while removing nearly half of the carrier C adhered on the background section.

When the toner T adheres more or less on the surface of the photosensitive drum in the background section as shown in FIG. 32C, the sweeping electric field becomes $3.2\times10^7$ V/m, and the sweep roller 2843 is separated from the surface of the photosensitive drum, while removing about half of the carrier C adhered on the background section, together with the toner T.

In FIG. 32D, the toner T adheres relatively in a large amount on the background section, but the sweeping electric field becomes $1.8\times10^6$ V/m, and the sweep roller 2843 is separated from the surface of the photosensitive drum, while removing about half of the carrier C adhered on the background section, and removing the toner T substantially completely.

However, if the sweeping electric field is set as a removal electric field which prevents the toner T from adhering to the background section, the developer on the sweep roller 2843 which has finished the sweeping process may flocculate because of being compressed by the electric field. As already explained, Table 6 shows the removal electric field, the lump generation rank of the toner in each electric field, and background density.

TABLE 6

| Electric field V/m | Lump generation rank 5:none~1:many lamps | Background density |
|---|---|---|
| 0 | 5 | bad |
| 1.00E+07 | 5 | stain |
| 1.50E+07 | 5 | stain |
| 2.00E+07 | 5 | clear |
| 2.50E+07 | 5 | clear |
| 3.00E+07 | 5 | clear |
| 3.50E+07 | 4 | clear |
| 4.00E+07 | 4 | clear |
| 5.00E+07 | 3 | clear |

In Table 6, it is seen that flocculation of the toner occurs conspicuously, with an increase of the sweeping electric field, and on the contrary, the background density occurs conspicuously, with a decrease of the sweeping electric field. Following result has been obtained, that is, when the sweeping electric field is about $5.0\times10^7$ Vm or less, the lump generation rank of the toner is "3" or higher, and flocculation of the toner particles stays within the allowable range. When the sweeping electric field is about $3.2\times10^7$ Vm, flocculation of toner particles in the developer does not occur, and an excellent image can be obtained. When the sweeping electric field is close to 0 Vm, the image section and the fog toner T cannot be removed.

As shown in Table 6, the lump generation rank of the toner with respect to the electric field of the sweeping electric field is higher than that with respect to the developing electric field, that is, flocculation is unlikely to occur. It can be considered that this is because the number of toner particles in the sweeping step is small in the carrier liquid. However, when there is the fog toner in a large amount, the fog toner recovered on the sweep roller 2843 after having finished the sweeping step maybe compressed by the sweeping electric field. In this instance, it is necessary to carry out the sweeping step with a weaker electric field.

Figure 33:
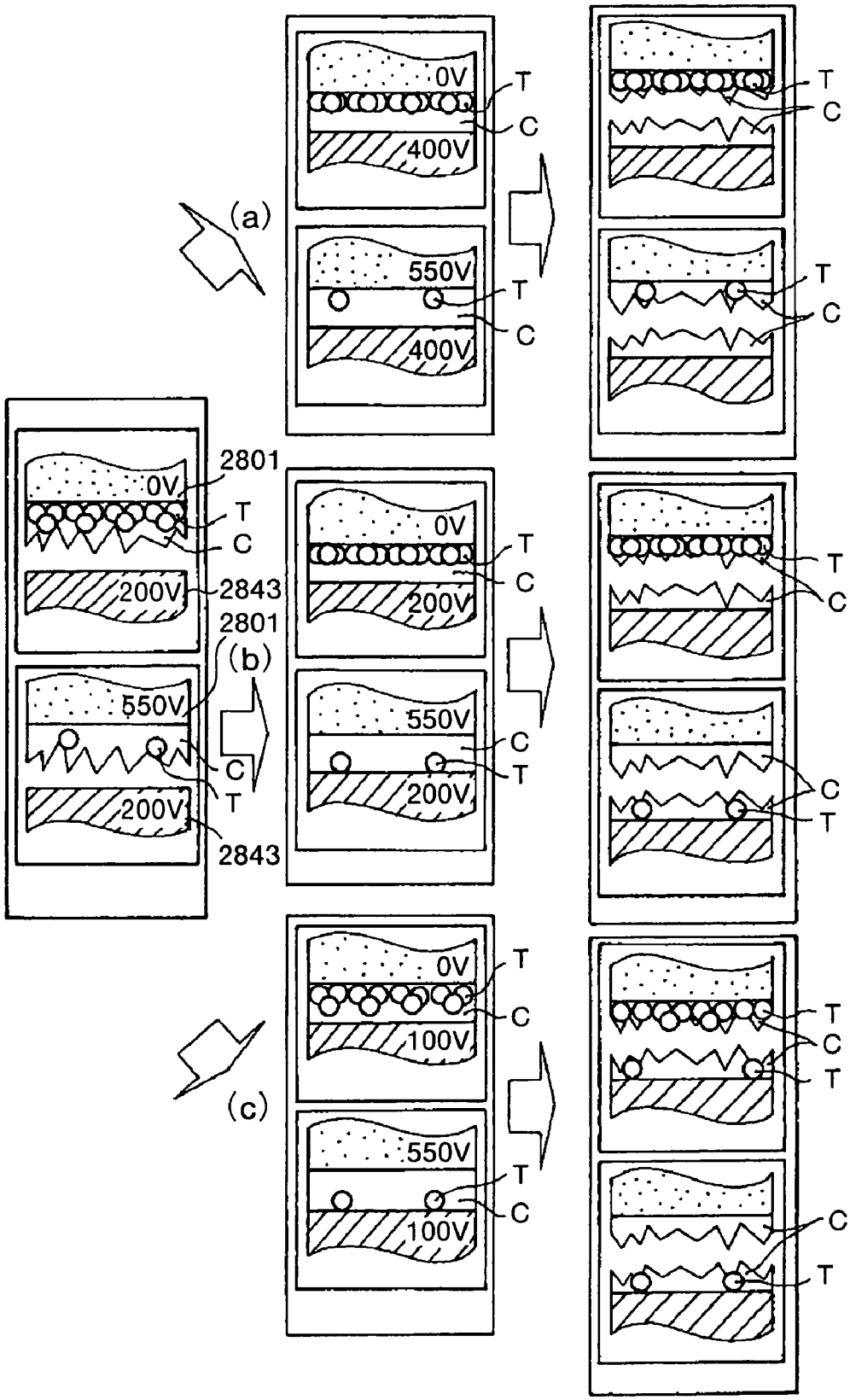
FIGS. 33A to 33C are schematic diagrams which show the influence of a sweeping electric field with respect to an image section.

FIG. 33 is a schematic diagram which shows the influence of the sweeping electric field on the image section. When the surface potential of the photosensitive body is 0V in the image section and 550V in the background section, the potential applied to the sweep roller 2843 is set 400V in FIG. 33A, 200V in FIG. 33B, and 100V in FIG. 33C. Thereby, the electric field in the respective image section becomes $-3.6\times10^7$ V/m in FIG. 33A, $-1.8\times10^7$ V/m in FIG. 33B, and $-9.1\times10^6$ V/m in FIG. 33C. Further, the developing roller 2842 in the background section becomes $1.4\times10^7$ V/m in FIG. 33A, $3.2\times10^7$ V/m in FIG. 33B and $4.1\times10^7$ V/m in FIG. 33C.

As shown in FIG. 33C, when 100V is applied to the sweep roller 2843 to increase the sweeping electric field, the sweep roller 2843 peels off the toner particles adhered on the image section on the surface of the photosensitive drum.

As shown in FIG. 33A, when 400V is applied to the sweep roller 2843 to decrease the sweeping electric field, the sweep roller 2843 does not peel off the toner particles adhered on the image section, but cannot remove the fog toner T adhered to the background section.

As shown in FIG. 33B, when 200V is applied to the sweep roller 2843, thereby the sweeping electric field generated between the background section and the sweep roller 2843 becomes $3.2\times10^7$ V/m, and the electric field generated between the image section and the sweep roller 2843 becomes $-1.8\times10^7$ V/m, the above problems do not occur.

From the results described above, in the tenth embodiment, 200V is applied to the sweep roller 2843, to set the sweeping electric field between the background section and the sweep roller 2843 to about $3.2\times10^7$ V/m. Thereby, the lump generation rank of the toner can be made "5", the background density can be made "clear", and since the cohesive toner is few and the cohesive power is small, the toner can be dispersed while fog toner is recovered. As a result, the recovered fog toner can be used repetitively.

The lower limit of the sweeping electric field can be made $5.0\times10^7$ V/m. In this instance, it becomes difficult to attract the developer in the background section towards the sweep roller by the electric field, but the developer mechanically transferred to the sweep roller side at the abutting position of the sweep roller can be removed. Thereby, it needs only to have an optical density (ID) in the background section after removal of the developer within the allowable range, and preferably not higher than 0.01.

It is necessary to optimize the background electric field and the sweeping electric field described in the tenth embodiment so that factors of the image density in the background section and in the image section, and of the cohesive state of the toner can be satisfied, and the background electric field and the sweeping electric field are determined, after optimization is performed.

The intensity of the preferable background electric field also depends on the mobility of the toner. Therefore, in the developer used in the tenth embodiment, the electric field is preferable, but when a toner of a different kind is used, the electric field is not limited thereto. The only requirement is that the developer adhered and remaining on the developing roller after development does not flocculate.

The results shown in Table 5 and Table 6 are obtained by carrying out experiments using the inverse development method for manifesting an electrostatic latent image on the photosensitive drum 2801 at a process speed of 300 mm/sec. Table 5 shows the results of flocculation of toner particles due to an electric field of the undeveloped developer used in the experiments, and Table 6 shows the results of flocculation of toner particles due to an electric field of the developer used in the experiments. Needless to say, the range of the electric field which can reduce flocculation of toner particles differs depending on the properties of the developer. In the tenth embodiment, the inverse development has been explained, but the present invention is also applicable to the regular development, if an absolute value is given to the background electric field and the sweeping electric field.

As explained above, according to one aspect of the present invention, by forming the width of the developing nip at the developing nip in a predetermined size, there are the effects that high image density contrasts can be obtained, and a high quality image can be formed by preventing fogging.

According to another aspect of the present invention, a potential difference which makes the toner move can be provided between the developer support and the before-development toner compression member. The developer layer on the developer support is separated to the carrier layer and the toner layer, and at the time of development, the carrier layer of the developer layer on the developer support first comes in contact with the latent image support, and hence toner adhesion onto the background section on the latent image support can be prevented. Depending on the potential difference, on the developer support, the developer layer is separated to the toner layer and the carrier layer to thereby compress the toner layer. Hence, at the time of development, a rib is not formed on the latent image support, and a toner image having a uniform density can be formed in the portion where the density is uniform.

According to still another aspect of the present invention, the carrier liquid on the developer support can be efficiently removed, without the toner adhering on the before-development toner compression member, with a small potential difference.

According to still another aspect of the present invention, a potential difference which makes the toner move can be provided between the developer support and the before-development toner compression member. The developer layer on the developer support is separated to the carrier layer and the toner layer, and at the time of development, the carrier layer of the developer layer on the developer support first comes in contact with the latent image support, and hence toner adhesion onto the background section on the latent image support can be prevented. Depending on the potential difference, on the developer support, the developer layer is separated to the toner layer and the carrier layer to thereby compress the toner layer. Hence, at the time of development, a rib is not formed on the latent image support, and a toner image having a uniform density can be formed in the portion where the density is uniform.

Also, since the carrier liquid can be removed from the developer on the developer support, the amount of carrier taken out to the outside of the apparatus can be reduced, thereby enabling realization of low cost.

According to still another aspect of the present invention, the voltage application unit applies voltage between the feed roller and the conductive plate to control the number of revolutions of the feed roller, thereby the density of the liquid developer is controlled. As a result, the density of the liquid developer can be controlled by controlling the amount of toner particles to be carried to the developer support. Thereby, the liquid developer having a desired density can be stably and uniformly supplied to the latent image face on the image support. Further, since a bias is applied to a plurality of rollers, the toner particles in the developer migrates, thereby application nonuniformity (ruffle) is unlikely to occur. A developer having a stable density can be supplied to the developer support, and a thickness of the developer can be provided, which does not change the gap in the developing space where the image support and the developer support are contiguous to each other with the developer layer interposed therebetween.

According to still another aspect of the present invention, in the construction in which the residual toner in the background section on the latent image support is removed by force the background electric field, there can be obtained an excellent effect that the residual toner removed from the background section is prevented from flocculating. Thereby, improvement in the image quality and reuse of the residual toner for development can be realized.

According to still another aspect of the present invention, by setting the upper limit of the absolute value of the removal electric field to a value which prevents the residual toner removed from the background section from flocculating, flocculation of the toner can be prevented.

According to still another aspect of the present invention, by reutilizing the residual toner in the background section for development, the toner can be used effectively.

According to still another aspect of the present invention, in the construction in which the residual toner in the background section on the latent image support is removed by the force of background electric field, there can be obtained an excellent effect that the residual toner removed from the background section is prevented from flocculating. Thereby, improvement in the image quality and reuse of the residual toner for development can be realized.

According to still another aspect of the present invention, by setting the upper limit of the absolute value of the removal electric field to a value which prevents the residual toner removed from the background section from flocculating, flocculation of the toner can be prevented.

According to still another aspect of the present invention, by reutilizing the residual toner in the background section for development, the toner can be used effectively.

According to still another aspect of the present invention, since the residual toner in the background section on the latent image support can be removed in two stages, there is the excellent effect that the residual toner removed from the background section can be reliably prevented from flocculating, while preventing the background section on the latent image support from being stained. Also it becomes possible to set the absolute values of the background electric field and the removal electric field to a relatively low value, and hence it is effective to prevent the residual toner from flocculating.

According to still another aspect of the present invention, such a phenomenon does not occur that the image density becomes weak, or fogging occurs.

The present document incorporates by reference the entire contents of Japanese priority documents, 2001-080032 filed in Japan on Mar. 21, 2001, 2001-083471 filed in Japan on Mar. 22, 2001, 2001-083535 filed in Japan on Mar. 22, 2001, 2001-087126 filed in Japan on Mar. 26, 2001, 2001-106779 filed in Japan on Apr. 5, 2001 and 2001-225952 filed in Japan on Jul. 26, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A liquid development method comprising:

applying a liquid developer containing a toner dispersed in a carrier liquid, via an application member, to a surface of a developer support used to develop a latent image on a surface of a latent image support;

before developing the latent image, compressing the toner on the developer support surface by press-contacting a before-development toner compression member against the developer support surface at a location downstream, in a moving direction of the developer support surface, of where the developer support faces the application member and upstream, in a moving direction of the developer support surface, of where the developer support faces the latent image support; and applying independent voltages to the developer support and the before-development toner compression member.

2. The liquid development method of claim 1, wherein one of the developer support and the before-development toner compression member are flexible.

3. The liquid development method of claim 1, wherein the independent voltages applied to the developer support and the before-development toner compression member have a potential difference which moves the toner towards the developer support.

4. The liquid development method of claim 1, further comprising:

cleaning a surface of the before-development toner compression member at a location downstream, in a moving direction of the before-development toner compression member surface, of where the before-development toner compression member faces the developer support.

5. The liquid development method of claim 1, wherein the independent voltages applied to the developer support and the before-development toner compression member have a potential difference which prevents adhesion of toner to the before-development toner compression member.

6. The liquid development method of claim 1, wherein the developer support and the application member have substantially a same potential in a portion where the developer support application member communicate via the developer.

7. The liquid development method of claim 1, wherein the latent image support comprises a-Si.

8. A liquid development method comprising:

applying a liquid developer containing a toner dispersed in a carrier liquid, via an application member, to a surface of a developer support used to develop a latent image on a surface of a latent image support;

before developing the latent image, compressing the toner on the developer support surface by applying independent voltages to the developer support and a before-development toner compression member, the before-development toner compression member facing the developer support surface at a location downstream, in a moving direction of the developer support surface, of where the developer support faces the application member and upstream, in a moving direction of the developer support surface, of where the developer support faces the latent image support, wherein the before-development toner compression member and the developer support are separated by a gap therebetween.

9. The liquid development method of claim 8, wherein a surface roughness of the developer support and a surface roughness of the before-development toner compression member are Rz=10 $\mu$m or less.

10. The liquid development method of claim 8, wherein the independent voltages applied to the developer support and the before-development toner compression member have a potential difference which moves the toner towards the developer support.

11. The liquid development method of claim 8, further comprising:

cleaning a surface of the before-development toner compression member at a location downstream, in a moving direction of the before-development toner compression member surface, of where the before-development toner compression member faces the developer support.

12. The liquid development method of claim 8, wherein the independent voltages applied to the developer support and the before-development toner compression member have a potential difference which prevents adhesion of the toner to the before-development toner compression member.

13. The liquid development method of claim 8, wherein the developer support and the application member have substantially a same potential in a portion where the developer support and the application member communicate via the developer.

14. The liquid development method of claim 8, wherein the latent image support comprises a-Si.

15. A liquid development method comprising:

applying a liquid developer containing a toner dispersed in a carrier liquid, via an application member, to a surface of a developer support used to develop a latent image on a surface of a latent image support;

before developing the latent image, compressing the toner on the developer support surface by applying independent voltages to the developer support and a conductive surface of a before-development toner compression member, the before-development toner compression member facing the developer support surface at a location downstream, in a moving direction of the developer support surface, of where the developer support faces the application member and upstream, in a moving direction of the developer support surface, of where the developer support faces the latent image support, wherein the before-development toner compressing member and the developer support do not directly touch one another.

16. The liquid development method of claim 15, further comprising:

if a gap is not formed between the before-development toner compression member and the developer support, insulating the developer support from the before-development toner compression member in a portion where the developer is not applied the to the developer support.

17. The liquid development method according to claim 16, wherein if a gap is not provided between the before-development toner compression member and the developer support, or if the before-development toner compression member abuts against the developer support with a nip, the before-development toner compression member abuts against the developer support via an insulation member in the portion where the developer is not applied.

18. The liquid development method according to claim 16, wherein if a gap is not provided between the before-development toner compression member and the developer support, or if the before-development toner compression member abuts against the developer support with a nip, at least the surface of at least either one of the before-development toner compression member and the developer support is formed of an insulation member, in the portion where the developer is not applied.

19. The liquid development method of claim 15, further comprising:

if a gap is not provided between the before-development toner compression member and the developer support, shortening one of the before-development toner compression member and the developer support to less than an application width of the developer.

20. The liquid development method of claim 15, wherein the latent image support comprises a-Si.

21. A liquid development method comprising:

applying a liquid developer containing a toner dispersed in a carrier liquid to a surface of a developer support used to develop a latent image on a surface of a latent image support; and before developing the latent image, compressing the toner on the developer support surface by applying a voltage to a conductive surface of a before-development toner compression member, wherein the before-development toner compression member faces the developer support via the developer so as not to directly touch with each other.

22. The liquid development method of claim 11, further comprising:

if a gap is not formed between the before-development toner compression member and the developer support, insulating the developer support from the before-development toner compression member in a portion where the developer is not applied the to the developer support.

23. The liquid development method according to claim 12, wherein if a gap is not provided between the before-development toner compression member and the developer support, or if the before-development toner compression member abuts against the developer support with a nip, the before-development toner compression member abuts against the developer support via an insulation member in the portion where the developer is not applied.

24. The liquid development method according to claim 22, wherein if a gap is not provided between the before-development toner compression member and the developer support, or if the before-development toner compression member abuts against the developer support with a nip, at least the surface of at least either one of the before-development toner compression member and the developer support is formed of an insulation member, in the portion where the developer is not applied.

25. The liquid development method of claim 21, further comprising:

if a gap is not provided between the before-development toner compression member and the developer support, shortening one of the before-development toner compression member and the developer support to less than an application width of the developer.

26. The liquid development method of claim 21, wherein the latent image support comprises a-Si.

27. A liquid development method comprising:

applying a liquid developer containing a toner dispersed in a carrier liquid, via an application member, to a surface of a developer support used to develop a latent image on a surface of a latent image support;

before developing the latent image, compressing the toner on the developer support surface by charging a before-development toner compression member facing the developer support surface at a location downstream, in a moving direction of the developer support surface, of where the developer support faces the application member and upstream, in a moving direction of the developer support surface, of where the developer support faces the latent image support; and applying a voltage to the developer support.

28. The liquid development method of claim 27, wherein the before-development toner compression member comprises a photosensitive body.

29. The liquid development method of claim 27, wherein the latent image support comprises a-Si.

30. A liquid development method comprising:

applying a liquid developer containing a toner dispersed in a carrier liquid to a surface of a developer support used to develop a latent image on a surface of a latent image support; and before developing the latent image, compressing the toner on the developer support surface by press-contacting an insulation surface of a before-development toner compression member against the developer support surface, wherein a voltage is applied to the developer support and the before-development toner compression member is charged by a charging mechanism.

31. The liquid development method of claim 30, wherein the before-development toner compression member comprises a photosensitive body.

32. The liquid development method of claim 30, wherein the latent image support comprises a-Si.

33. A liquid development method of an electrostatic latent image comprising:

applying a liquid developer containing a toner dispersed in a carrier liquid and having a viscosity of from 100 to 1000 mPa·s, via an application unit having a plurality of rollers, to a surface of a developer support used to develop an electrostatic latent image;

applying a voltage to at least one roller of the plurality of rollers; and applying a voltage between a feed roller soaked in the liquid developer and a conductive plate arranged in a tank holding the developer to thereby control the number of revolutions of the feed roller and the density of the liquid developer.

34. The liquid development method of claim 33, further comprising:

measuring the density of the liquid developer applied on the developer support, to thereby control the application of voltage to the at least one roller of the plurality of rollers.

35. The liquid development method of claim 33, further comprising:

measuring the density of the liquid developer applied on the developer support to thereby control a peripheral velocity of the plurality of rollers.

36. The liquid development method of claim 33, wherein the plurality of rollers, excluding the feed roller, are of substantially a same potential as a voltage applied to the developer support.

37. The liquid development method of claim 33, wherein the density of the liquid developer is controlled by generating a potential difference between a carrier roller of the plurality of rollers and the feed roller, and the carrier roller is separated by a predetermined gap from the feed roller.

38. The liquid development method of claim 33, wherein the plurality of rollers has an application roller which makes contact with the developer support, and the density of the liquid developer is controlled by generating a potential difference between the application roller and the developer support.

39. The liquid development method of claim 33, wherein the plurality of rollers has an application roller which makes contact with the developer support, a carrier roller is separated by a predetermined gap from the feed roller and brought into contact with the application roller, and the density of the liquid developer is controlled by generating a potential difference between the carrier roller and the application roller.

40. The liquid development method of claim 33, wherein the liquid developer includes an insulation liquid having a viscosity from 0.5 to 1000 mPa·s, an electrical resistance of at least $10^{12}$ Ωcm, a surface tension of 21 dyn/cm or less, and a boiling point of 100° C. or higher.

41. The liquid development method of claim 40, wherein the insulation liquid includes silicon oil.

42. The liquid development method of claim 33, wherein the toner of the liquid developer has an average particle diameter of from 0.1 to 5 μm in a density of from 5 to 40%.

43. A wet-type image formation method comprising:

applying a liquid developer containing a toner dispersed in a carrier liquid to a surface of a developer support used to develop an electrostatic latent image on a surface of a latent image support;

generating an electric field between the latent image support and the developer support, to develop the electrostatic latent image on the latent image support with the liquid developer on the developer support;

generating a background electric field between a background section on the latent image support and the developer support, to attract a background residual toner remaining in the background section on the latent image support towards the developer support after development by the background electric field, to thereby remove the background residual toner from the background section; and setting an absolute value of the background electric field substantially equal to or less than a value at which the background residual toner attracted towards the developer support does not flocculate.

44. The wet-type image formation method of claim 43, wherein the range of the background electric field is set to be not higher than $3.5\times10^7$ V/m in an absolute value.

45. The wet-type image formation method of claim 44, comprising:

attracting and removing the background residual toner remaining in the background section on the latent image support after development; and generating a removal electric field between the background section on the latent image support and the removal member, an absolute value thereof being less than or equal to a value at which the background residual toner attracted towards the developer support does not flocculate.

46. The wet-type image formation method of claim 44, wherein the range of the removal electric field is set to be not higher than $5.0\times10^7$ V/m in an absolute value.

47. The wet-type image formation method of claim 44, further comprising:

attracting and removing the background residual toner remaining in the background section on the latent image support after development; and recycling the background residual toner attracted to the removal member for development.

48. The wet-type image formation method of claim 43, further comprising:

recycling the residual toner remaining on the developer support for development.

49. The wet-type image formation method of claim 48, further comprising:

attracting and removing the background residual toner remaining in the background section on the latent image support after development; and generating a removal electric field between the background section on the latent image support and the removal member, the absolute value thereof being set to less than or equal to a value at which the background residual toner attracted towards the developer support does not flocculate.

50. The wet-type image formation method of claim 48, wherein the range of the removal electric field is set not higher than $5.0\times10^7$ V/m in an absolute value.

51. The wet-type image formation method of claim 48, further comprising:

attracting and removing the background residual toner remaining in the background section on the latent image support after development; and recycling the background residual toner attracted to the removal member for development.

52. The wet-type image formation method of claim 43, further comprising:

attracting and removing the background residual toner remaining in the background section on the latent image support after development; and generating a removal electric field between the background section on the latent image support and the removal member, the absolute value thereof being set less than or equal to a value at which the background residual toner attracted towards the developer support does not flocculate.

53. A wet-type image formation method comprising:

developing an electrostatic latent image on a latent image support which supports the electrostatic latent image via a developer support which supports a liquid developer containing a toner dispersed in a carrier liquid;

attracting and removing a background residual toner remaining in the background section on the latent image support after development; and generating a removal electric field between the background section on the latent image support and the removal member, the absolute value thereof being set to less or equal to a value at which the background residual toner attracted towards the removal member does not flocculate.

54. The wet-type image formation method of claim 53, wherein the range of the removal electric field is set to not higher than $5.0\times10^7$ V/m in an absolute value.

55. The wet-type image formation method of claim 53, further comprising:

recycling the background residual toner attracted to the removal member for development.

56. The wet-type image formation method of claim 53, wherein the range of the removal electric field is set to not higher than $5.0\times10^7$ V/m in an absolute value.

57. The wet-type image formation method of claim 53, further comprising:

attracting and removing the background residual toner remaining in the background section on the latent image support after development; and recycling the background residual toner attracted to the removal member for development.

58. The wet-type image formation method of claim 53, wherein the thickness of the liquid developer applied on the developer support is such that a content of a pigment in the toner which is supported per 1 $cm^2$ on the surface of the developer support is set to at least 0.1 $\mu$g and not higher than 2 $\mu$g.

59. An image formation method comprising:

applying a liquid developer containing a toner dispersed in a carrier liquid to a surface of a developer support used to develop a latent image on a surface of a latent image support;

transferring a manifest image on the latent image support developed by the liquid developer to a transfer material;

pressing the developer support against the latent image support to thereby form a developing nip corresponding to a pressurizing force applied by the developer support; and setting the width of the developing nip, being the size in the moving direction on the surface of the developer support and of the latent image support, in a portion at which the developer support comes in contact with the latent image support, to a predetermined size by adjusting the size of the pressurizing force.

60. The image formation method of claim 59, wherein an elastic surface layer forms the surface of the developer support.

61. The image formation method of claim 59, further comprising:

increasing the pressurizing force by moving the developer support in a direction of the latent image support.

62. The image formation method of claim 59, wherein the developer support and the latent image support are formed by a roller member, respectively, and the size of the pressurizing force is set by a distance between axes of the roller members.

63. The image formation method according to claim 59, wherein the pressurizing unit has a pressurizing force adjusting unit which adjusts the size of the pressurizing force.

64. An image formation method comprising:

applying a liquid developer containing a toner dispersed in a carrier liquid to a surface of a developer support used to develop a latent image on a surface of a latent image support;

transferring a manifest image on the latent image support developed by the liquid developer to a transfer material;

pressing the developer support against the latent image support to thereby form a developing nip corresponding to a pressurizing force applied by the developer support;

setting the width of the developing nip, being the size in the moving direction on the surface of the developer support and of the latent image support, in a portion at which the developer support comes in contact with the latent image support, to a predetermined size corresponding to a pressurizing force; and restricting a movement of the developer support, via a spacer member, toward the latent image support.

65. The image formation method according to claim 64, wherein the developing nip width setting unit includes:

a pressurizing unit which makes the developer support apply pressure to the latent image support to thereby form a developing nip, and the width of the developing nip in the developing nip is set to a predetermined size by adjusting the size of the press-contacting pressure of the pressurizing unit.

66. The image formation method of claim 65, further comprising:

increasing the pressurizing force by moving the developer support in the direction of the latent image support, wherein the developer support is moved in the direction of the latent image support by an energizing force.

67. The image formation method of claim 66, wherein the size of the energizing force is set to at least a force necessary for the developer support to move until being restricted by the spacer member, and an elastic surface layer forms the surface of the developer support.

68. The image formation method according to claim 64, further comprising a developing nip width change unit which changes the width of the developing nip.

69. The image formation method of claim 68, wherein the latent image support is formed in a belt.

70. The image formation method of claim 68, wherein the developer support is formed in a belt.

71. The image formation method of claim 68, wherein a plurality of developer supports approach and separate from the surface of the latent image support to change the width of the developing nip.

72. The image formation method of claim 71, further comprising:

rotating an eccentric cam to shift an axial position of the developer support or an axial position of a support roller which supports a belt-form developer support.

73. The image formation method of claim 64, wherein at least one of the developer support and a liquid removal member is configured to approach and separate from the latent image support.

74. The image formation method of claim 64, wherein at least one of the developer support and a liquid removal member includes an elastic inner layer and a resin surface layer.

75. The image formation method of claim 74, wherein the inner layer includes a reconditioned rubber and the surface layer includes PFA.

76. The image formation method of claim 74, wherein the inner layer includes a urethane rubber and the surface layer includes PFA.

77. The image formation method of claim 74, wherein the inner layer and the surface layer are bonded using a conductive adhesive.

78. The image formation method of claim 74, wherein the inner layer includes a urethane rubber and the surface layer includes a urethane coating layer obtained by coating a urethane resin on the inner layer.

79. The image formation method of claim 64, wherein in the developing nip, the developer support surface and the latent image support surface are moved in the same direction at substantially a same linear velocity.

80. The image formation method of claim 64, wherein the latent image support includes an amorphous silicon type photosensitive body.

81. An image formation method comprising:

applying a liquid developer containing a toner dispersed in a carrier liquid to a surface of a developer support used to develop a latent image on a surface of a latent image support;

developing the latent image on the latent image support by a liquid developer supported on the developer support;

transferring a manifest image on the latent image support developed by the liquid developer to a transfer material;

pressing the developer support against the latent image support to form a developing nip of a predetermined width, as measured in a moving direction of the contacting surfaces of the developer support and the latent image support; and adjusting the width of the developing nip by changing an encroaching quantity of the latent image support with respect to the developing roller.

82. The image formation method of claim 81, wherein the developer support is a developing roller in a roller form, and an elastic surface layer which forms the surface of the developing roller.

83. The image formation method of claim 81, further comprising:

rotating an eccentric cam to shift an axial position of the developer support or an axial position of a support roller which supports the belt-like developer support.

84. An image formation method comprising:

applying a liquid developer containing a toner dispersed in a carrier liquid to a surface of a developer support used to develop a latent image on a surface of a latent image support; and developing the latent image on the latent image support by a liquid developer supported on the developer support;

transferring a manifest image on the latent image support developed by the liquid developer to a transfer material;

pressing the developer support against the latent image support to form a developing nip of a predetermined developing nip width, as measured in a moving direction of the contacting surfaces of the developer support and the latent image support;

removing the liquid developer remaining on the latent image support surface, after development, downstream in a moving direction of the contacting surfaces of the developer support and the latent image support; and restricting the movement of the liquid removal member toward the latent image support via a spacer member.

85. The image formation method of claim 84, further comprising:

pressing the liquid removal member against the latent image support to thereby form a removal nip of a predetermined removal nip width corresponding to a pressurizing force of the liquid removal member;

moving the liquid removal member, via an energizing force, in a direction of increasing the pressurizing force of the liquid removal member.

86. The image formation method of claim 85, wherein the size of the energizing force is set to at least a force necessary for the liquid removal member to move until being restricted by the spacer member.

87. The image formation method according to claim 84, wherein the liquid removal member pressurizing unit has a liquid removal member pressurization adjusting unit which adjusts the size of the pressurizing force.

88. The image formation method according to claim 84, further comprising a developing nip width change unit which changes the width of the developing nip.

89. The image formation method of claim 88, wherein the latent image support is formed in a belt.

90. The image formation method of claim 88, wherein the developer support is formed in a belt.

91. The image formation method of claim 88, wherein a plurality of developer supports approach and separate from the surface of the latent image support to change the width of the developing nip.

92. The image formation method of claim 91, further comprising:

rotating an eccentric cam to shift an axial position of the developer support or an axial position of a support roller which supports a belt-form developer support in order to make at least one of the plurality of developer supports approach and separate from the surface of the latent image support.

93. The image formation method of claim 84, wherein at least one of the developer support and the liquid removal member is made to approach and separate from the latent image support.

94. The image formation method of claim 84, wherein at least one of the developer support and the liquid removal member includes an elastic inner layer and a resin surface layer.

95. The image formation method of claim 94, wherein the inner layer includes a reconditioned rubber and the surface layer includes PFA.

96. The image formation method of claim 94, wherein the inner layer includes a urethane rubber and the surface layer includes PFA.

97. The image formation method of claim 94, wherein the inner layer and the surface layer are bonded using a conductive adhesive.

98. The image formation method of claim 94, wherein the inner layer is made of a urethane rubber and the surface layer is made of a urethane coating layer obtained by coating a urethane resin on the inner layer.

99. The image formation method of claim 84, wherein, in the developing nip, the developer support surface and the latent image support surface are moved in the same direction at substantially the same linear velocity.

100. The image formation method of claim 84, wherein the latent image support include an amorphous silicon type photosensitive body.

* * * * *